US008831485B2

(12) United States Patent
Okoshi et al.

(10) Patent No.: US 8,831,485 B2
(45) Date of Patent: Sep. 9, 2014

(54) POWDER CONTAINER, IMAGE FORMING APPARATUS AND COVER MOVING METHOD

(75) Inventors: Takeshi Okoshi, Kanagawa (JP); Kiyohito Horii, Kanagawa (JP); Akihiko Terao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 767 days.

(21) Appl. No.: 13/088,153

(22) Filed: Apr. 15, 2011

(65) Prior Publication Data

US 2012/0114388 A1 May 10, 2012

(30) Foreign Application Priority Data

Nov. 10, 2010 (JP) ..... 2010-252392

(51) Int. Cl.
*G03G 15/08* (2006.01)

(52) U.S. Cl.
USPC ..... 399/262

(58) Field of Classification Search
USPC ..... 399/107, 110, 111, 119, 120, 252–262; 222/DIG. 1
See application file for complete search history.

(56) References Cited

U.S. PATENT DOCUMENTS

| | | | | |
|---|---|---|---|---|
| 6,292,644 | B1 | 9/2001 | Goto et al. | |
| 6,438,345 | B1 * | 8/2002 | Ban et al. | 399/262 |
| 8,050,591 | B2 * | 11/2011 | Koido | 399/106 |
| 8,200,127 | B2 * | 6/2012 | Nozawa | 399/262 |

FOREIGN PATENT DOCUMENTS

JP 2000-162861 A 6/2000

* cited by examiner

*Primary Examiner* — Hoan Tran
(74) *Attorney, Agent, or Firm* — Sughrue Mion, PLLC

(57) ABSTRACT

A powder container includes a container section that contains powder, an opening that is formed in the container section so as to pass the powder therethrough, a first covering member that is supported by the container section, a second covering member that is supported by the container section, a disengagement restricting portion that is disposed in an area where the second covering member moves between the second uncovered position and the second covered position, and a restricted portion that is disposed in the second covering member so as to restrict the disengagement of the second covering member by coming in contact with the disengagement restricting portion when the second covering member having moved to the second covered position moves to disengage from the container section.

8 Claims, 36 Drawing Sheets

51
51a
51b
52
52a
52b
53
53a
54
56
57
57a
57b
XVC
XVD
XVE
XVF
XVG
XVB
X
Y
Z
(-X)
(-Y)
(-Z)

XVIIC
XVIID
XVIIE
XVIIF
XVIIG
XVIIH

POWDER CONTAINER, IMAGE FORMING APPARATUS AND COVER MOVING METHOD

CROSS-REFERENCE TO RELATED APPLICATION

This application is based on and claims priority under 35 USC 119 from Japanese Patent Application No. 2010-252392 filed on Nov. 10, 2010.

BACKGROUND

Technical Field

The present invention relates to a powder container, an image forming apparatus and a cover moving method.

SUMMARY

According to an aspect of the invention, there is provided a powder container including:

a container section that contains powder;

an opening that is formed in the container section so as to pass the powder therethrough;

a first covering member that is supported by the container section so as to be movable between a first uncovered position where the opening is uncovered and a first covered position where the opening is covered;

a second covering member that is supported by the container section so as to be movable between a second covered position where the opening is double covered by covering the outside of the first covering member and a second uncovered position where the first covering member is externally exposed;

a disengagement restricting portion that is disposed in an area where the second covering member moves between the second uncovered position and the second covered position; and a restricted portion that is disposed in the second covering member so as to restrict the disengagement of the second covering member by coming in contact with the disengagement restricting portion when the second covering member having moved to the second covered position moves to disengage from the container section.

BRIEF DESCRIPTION OF THE DRAWINGS

Exemplary embodiments of the present invention will be described in detail based on the following figures, wherein:

FIG. 5A is a perspective view and FIG. 5B is a partially-enlarged view of an inner shutter lock.

FIG. 7A is a diagram illustrating a state where the inner shutter lock moves to a locked position, FIG. 7B is a diagram illustrating a state where the inner shutter lock moves to an unlocked position, and FIG. 7C is an enlarged view of gear teeth.

FIG. 12A is a view as obliquely viewed from the front-left downside and FIG. 12B is a view as obliquely viewed from the rear-right downside.

FIG. 13A is a view as obliquely viewed from the front-left downside and FIG. 13B is a view as obliquely viewed from the rear-right downside.

FIG. 14A is a sectional view taken along line XIVA-XIVA of FIG. 8, FIG. 14B is a sectional view taken along line XIVB-XIVB of FIG. 9, and FIG. 14C is a diagram illustrating a state where the inner shutter is removed from the state shown in FIG. 14A.

FIG. 15A is a perspective view, FIG. 15B is a view as viewed in the direction of arrow XVB of FIG. 15A, FIG. 15C is a view as viewed in the direction of arrow XVC of FIG. 15B, FIG. 15D is a view as viewed in the direction of arrow XVD of FIG. 15B, FIG. 15E is a view as viewed in the direction of arrow XVE of FIG. 15B, FIG. 15F is a view as viewed in the direction of arrow XVF of FIG. 15B, and FIG. 15G is a view as viewed in the direction of arrow XVG of FIG. 15F.

FIG. 16A is a view as obliquely viewed from the upside and FIG. 16B is a view as viewed in the direction of arrow XVIB of FIG. 16A.

FIG. 17A is a perspective view as obliquely viewed from the rear downside, FIG. 17B is a perspective view as obliquely viewed from the front upside, FIG. 17C is a view as viewed in the direction of arrow XVIIC of FIG. 17B, FIG. 17D is a view as viewed in the direction of arrow XVIID of FIG. 17C, FIG. 17E is a view as viewed in the direction of arrow XVIIE of FIG. 17C, FIG. 17F is a view as viewed in the direction of arrow XVIIF of FIG. 17C, FIG. 17G is a view as viewed in the direction of arrow XVIIG of FIG. 17C, and FIG. 17H is a view as viewed in the direction of arrow XVIIH of FIG. 17G.

FIG. 19A is a diagram illustrating a state before the toner cartridge is mounted on the cartridge holder and FIG.

Figure 19A:
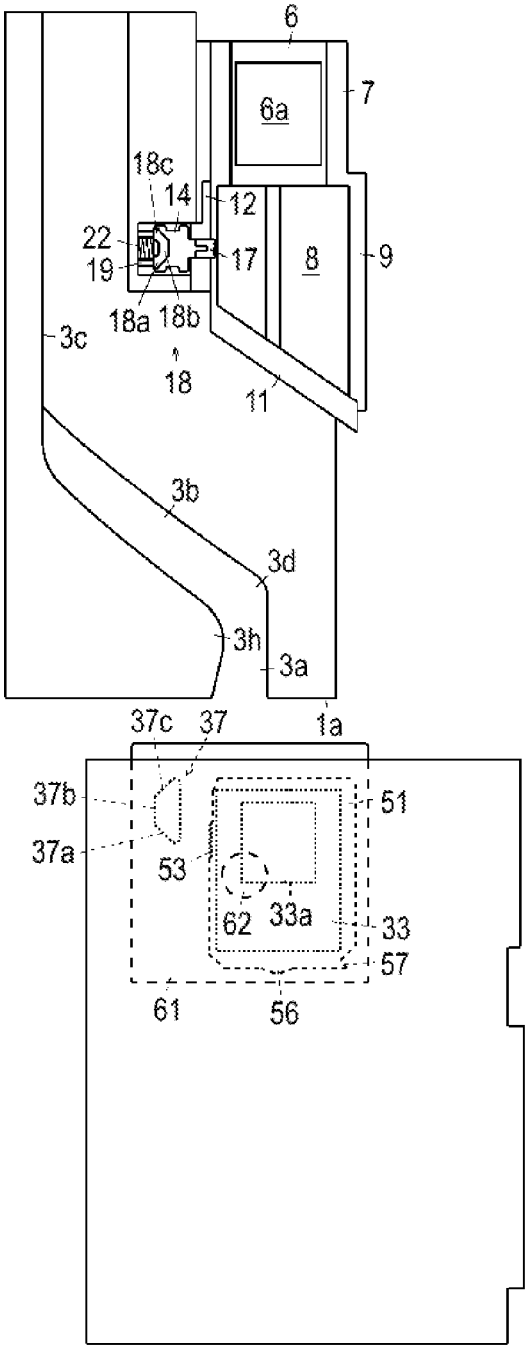
FIGS. 19A and 19B are diagrams illustrating an operation of mounting the toner cartridge according to the first example, where

19B is a diagram illustrating a state where the toner cartridge is inserted rearward from the state shown in FIG. 19A and the outer covering protrusion reaches the front end of a spiral groove.

Figure 19B:
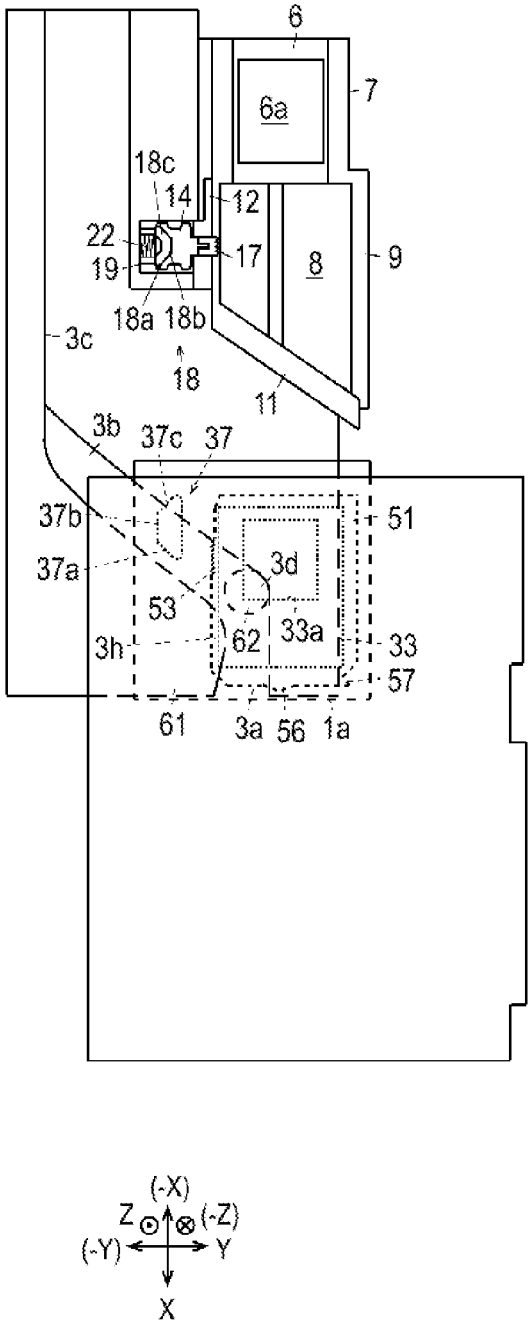
Figure 20A:
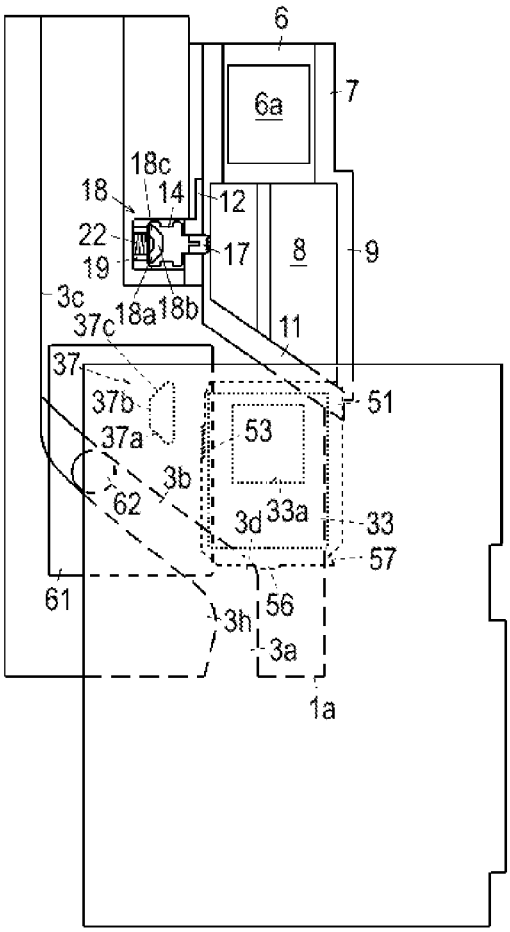
Figure 20B:
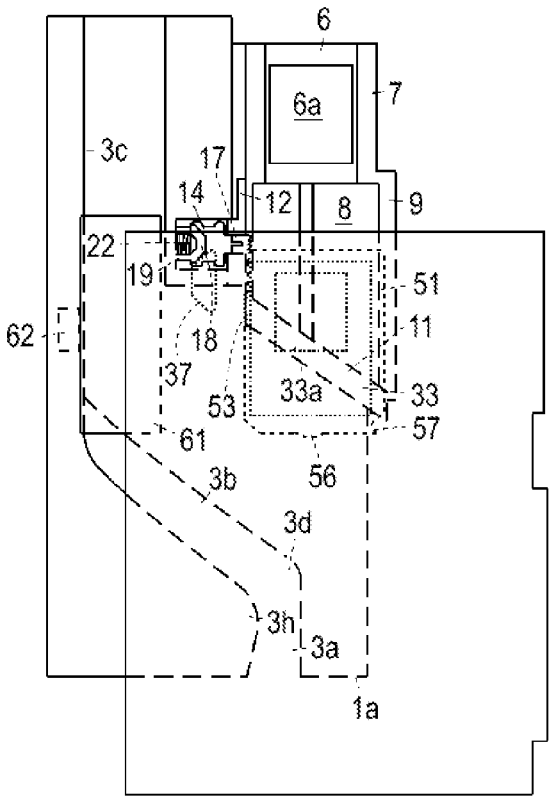
Figure 20B:
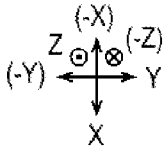

FIGS. 20A and 20B are diagrams illustrating a subsequent operation of mounting the toner cartridge, where FIG. 20A is a diagram illustrating a state where the toner cartridge is further inserted rearward from the state shown in FIG. 19B and the outer shutter is opened halfway and FIG. 20B is a diagram illustrating a state where the toner cartridge is further inserted rearward from the state shown in FIG. 20A and an unlocking protrusion comes in contact with the front end of a slider protrusion.

Figure 21A:
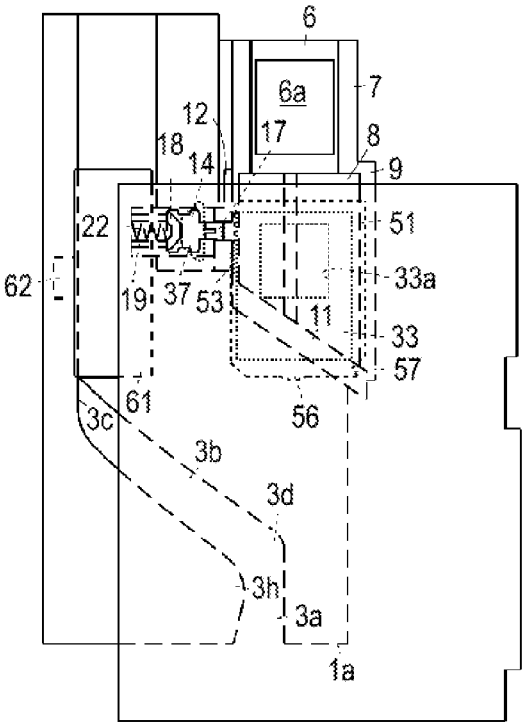
Figure 21C:
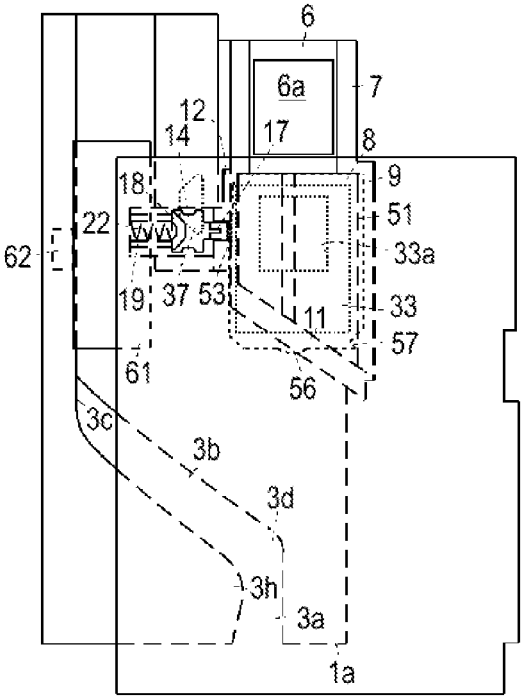
Figure 21C:
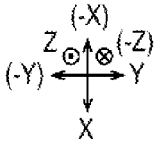
Figure 21B:
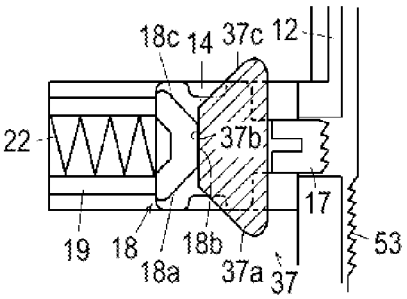
Figure 21D:
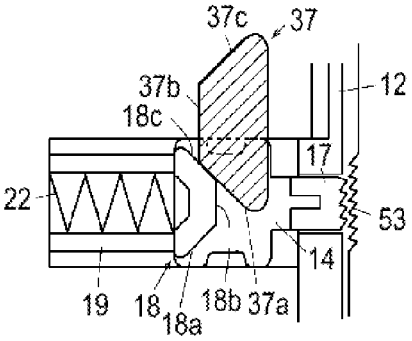

FIGS. 21A to 21D are diagrams illustrating a subsequent operation of mounting the toner cartridge, where FIG. 21A is a diagram illustrating a state where the toner cartridge is further inserted rearward from the state shown in FIG. 20B and the unlocking protrusion presses the slider protrusion to the left, FIG. 21B is a partially-enlarged view of the inner shutter lock shown in FIG. 21A, FIG. 21C is a diagram illustrating a state where the toner cartridge is further inserted rearward from the state shown in FIG. 21A and the inner shutter lock is located between the locked position and the unlocked position, and FIG. 21D is a partially-enlarged view of the inner shutter lock shown in FIG. 21C.

Figure 22A:
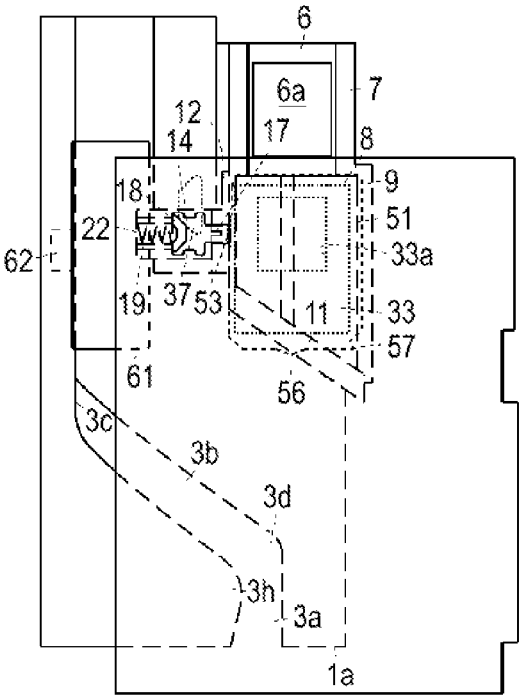
Figure 22C:
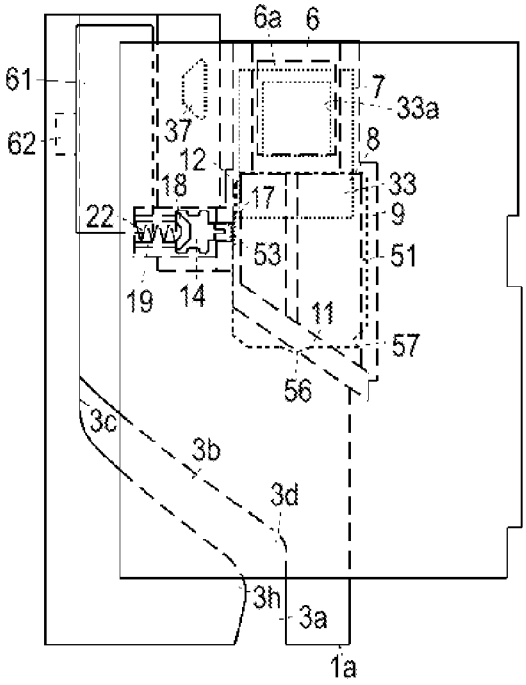
Figure 22C:
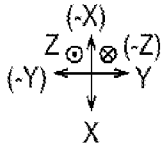
Figure 22B:
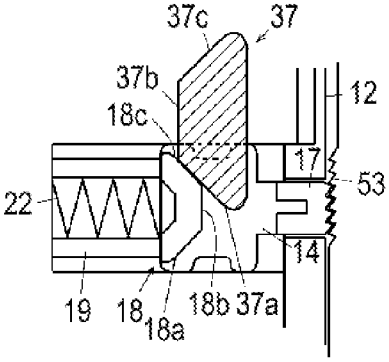
Figure 22D:
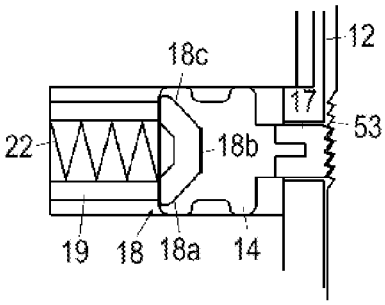

FIGS. 22A to 22D are diagrams illustrating a subsequent operation of mounting the toner cartridge, where FIG. 22A is a diagram illustrating a state where the toner cartridge is further inserted rearward from the state shown in FIG. 21C and the unlocking protrusion moves rearward of the slider protrusion, FIG. 22B is a partially-enlarged view of the inner shutter lock shown in FIG. 22A, FIG. 22C is a diagram illustrating a state where the toner cartridge is further inserted rearward from the state shown in FIG. 22A and the mounting is finished, and FIG. 22D is a partially-enlarged view of the inner shutter lock shown in FIG. 22C.

Figure 18:
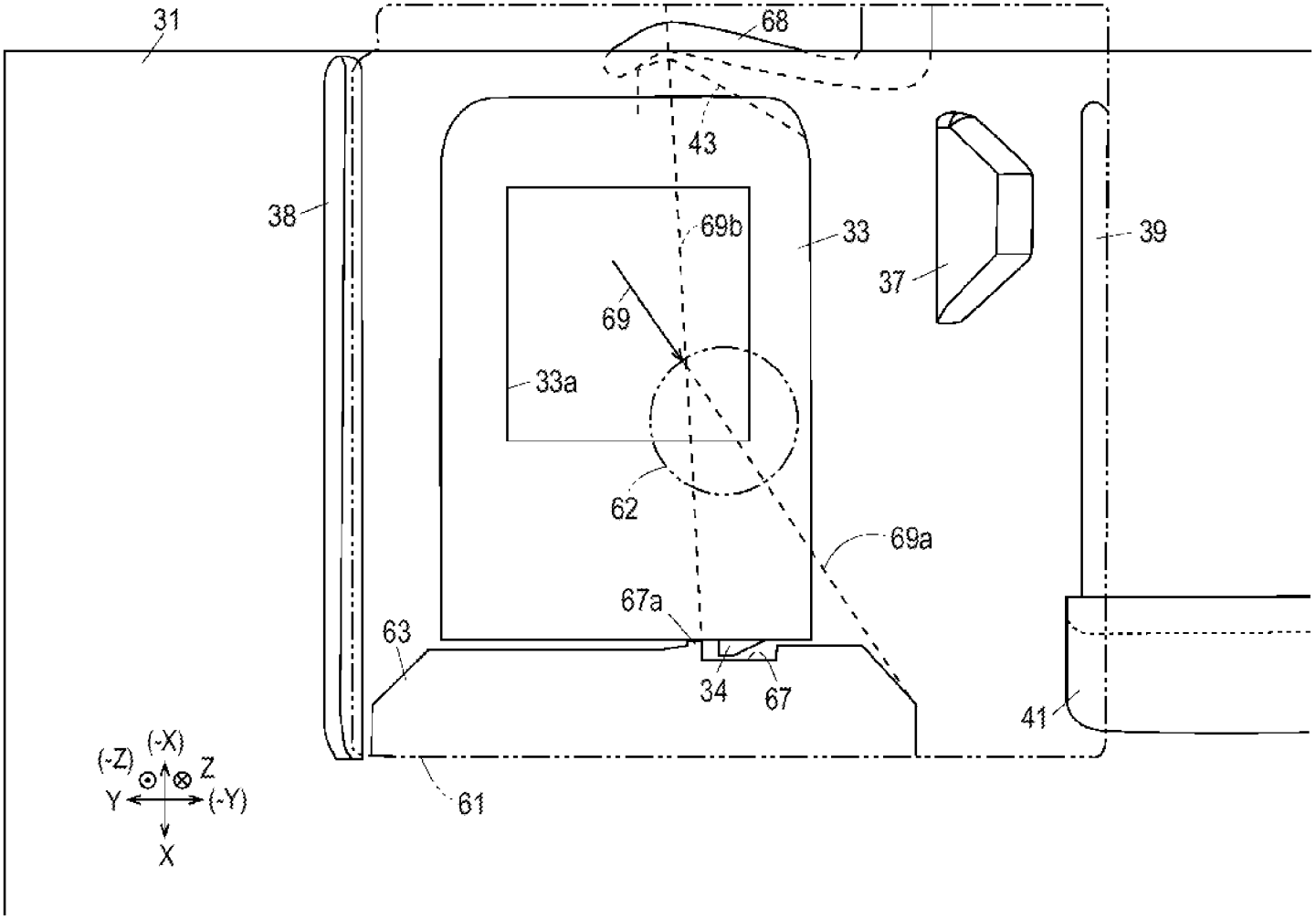
FIG. 18 is a diagram illustrating the positional relation of an outer covering protrusion, a leaf spring portion, and an outer locking recess of the outer shutter according to the first example.
Figure 23A:
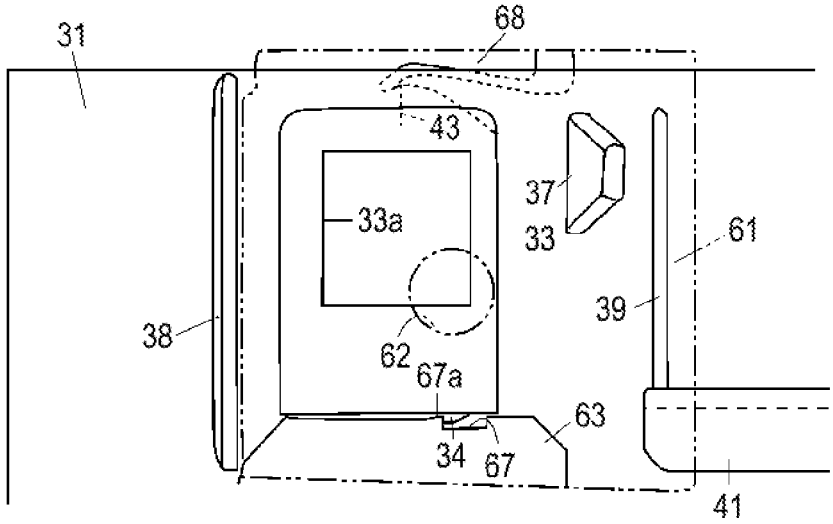
Figure 23C:
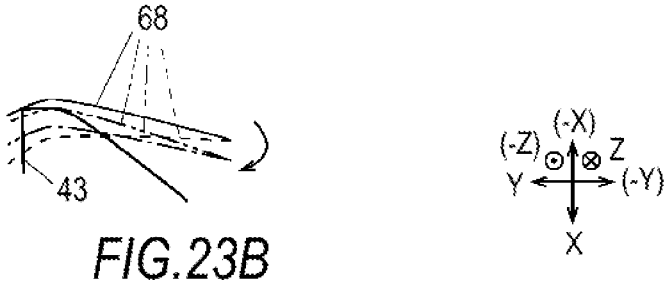
Figure 23B:
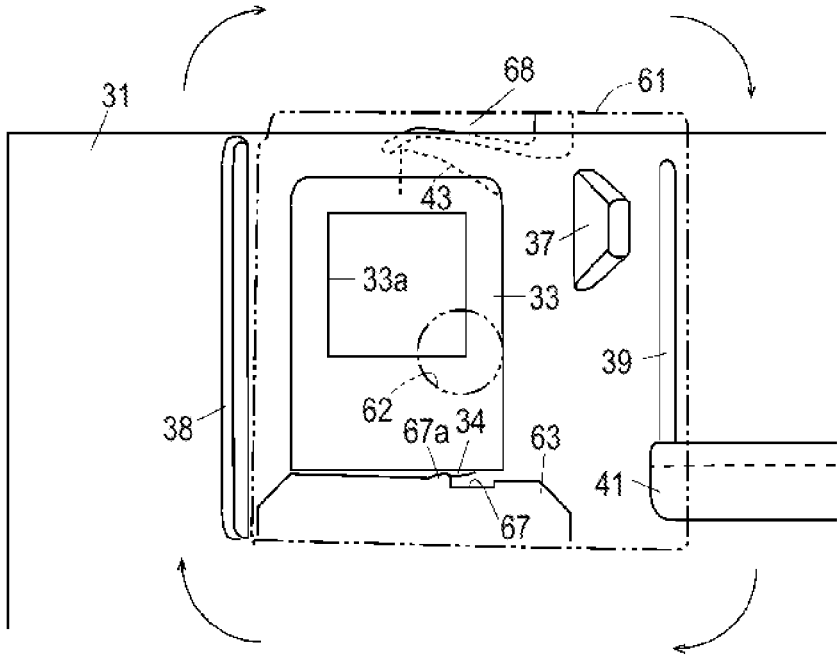

FIGS. 23A to 23C are diagrams partially illustrating the outer shutter according to the first example, where FIG. 23A is a diagram illustrating a state where the outer shutter moves to an outer-shutter opened position from the state shown in FIG. 18, FIG. 23B is a diagram illustrating a state where the outer shutter is inclined from the state shown in FIG. 23A, and FIG. 23C is a diagram illustrating states before and after the leaf spring portion is inclined.

Figure 24A:
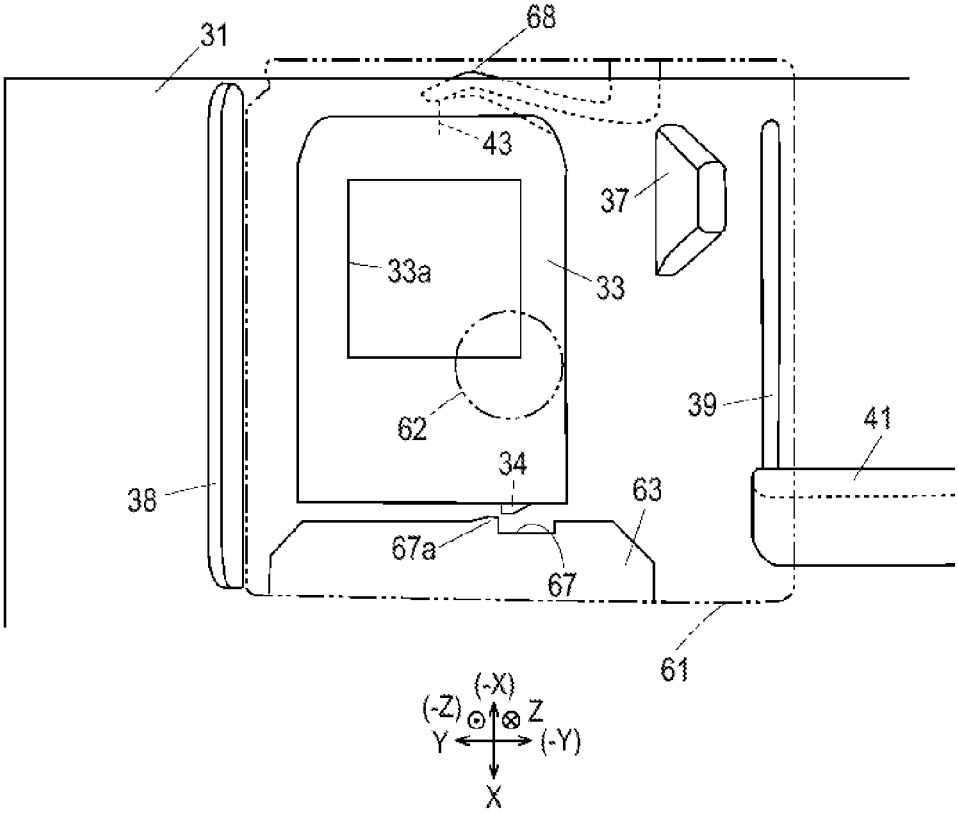
Figure 24B:
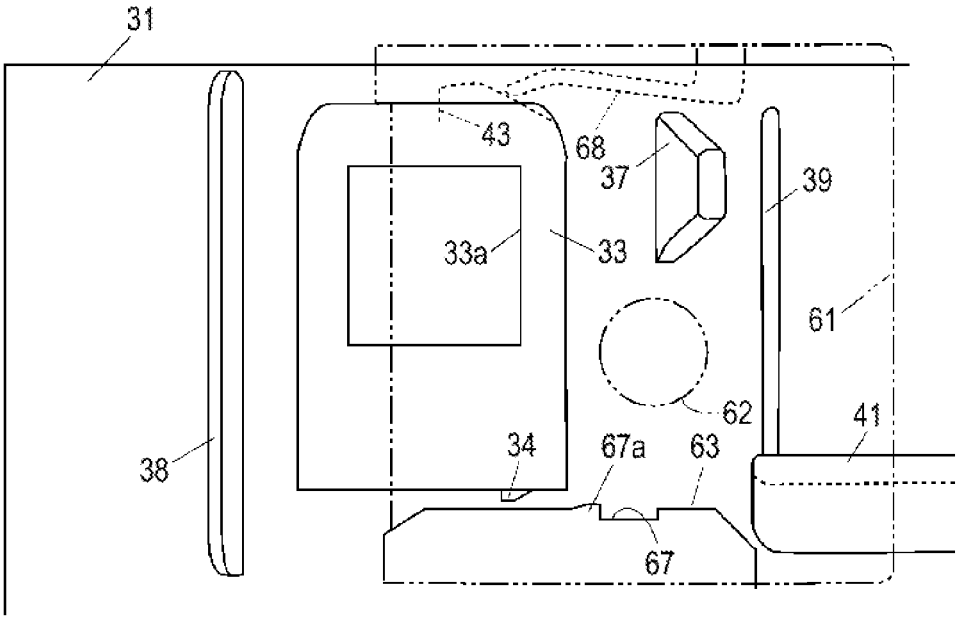

FIGS. 24A and 24B are diagrams partially illustrating the outer shutter according to the first example, where FIG. 24A is a diagram illustrating a state where the outer shutter is unlocked from the state shown in FIG. 23B and FIG. 24B is a diagram illustrating a state where the outer shutter moves to an outer-shutter opened position from the state shown in FIG. 24A.

Figure 25A:
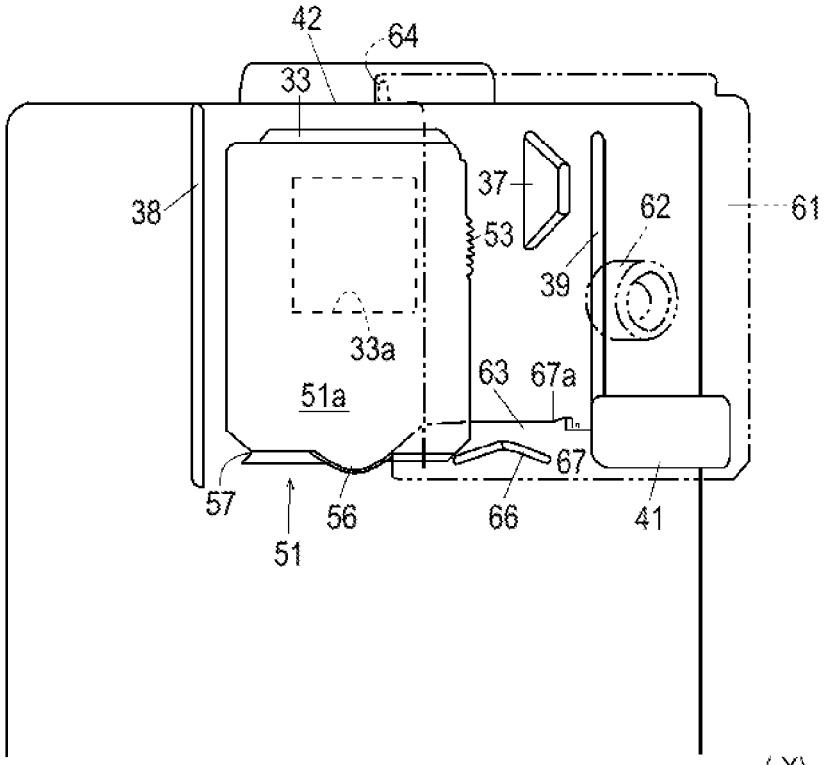
Figure 25B:
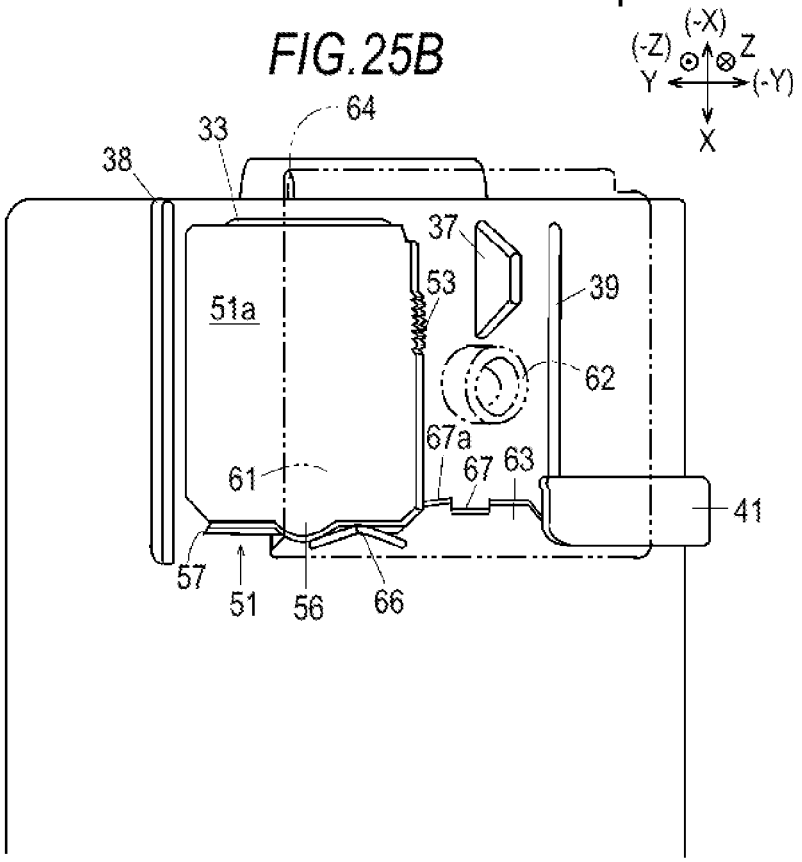

FIGS. 25A and 25B are diagrams illustrating a state where the inner shutter according to the first example completely moves to an inner-shutter closed position, where FIG. 25A is a diagram illustrating an intermediate state where the outer shutter is moving to an outer-shutter closed position and FIG. 25B is a diagram illustrating a state where the outer shutter further moves to the outer-shutter closed position from the state shown in FIG. 25A and a pressing protrusion starting its contact with a pressed protrusion.

Figure 26A:
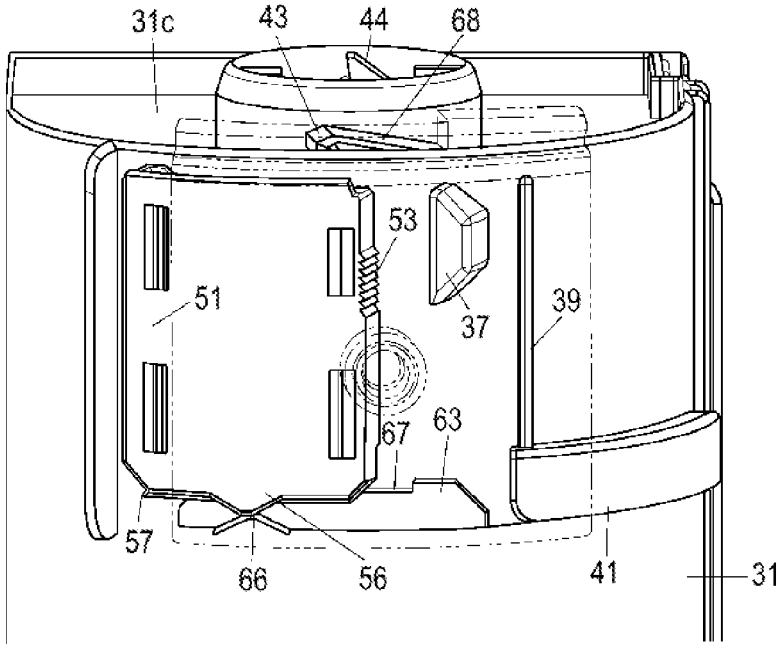
Figure 26A:
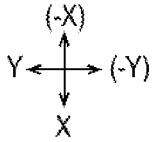
Figure 26B:
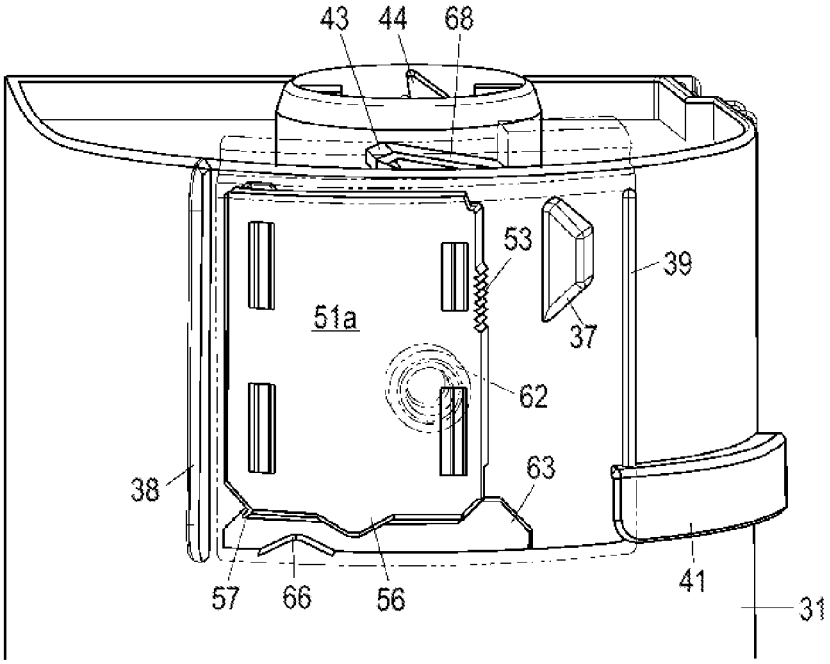

FIGS. 26A and 26B are diagrams illustrating an operation subsequent to the operation shown in FIGS. 25A and 25B, where FIG. 26A is a diagram illustrating a state where the outer shutter further moves to the outer-shutter closed position from the state shown in FIG. 25B and the pressing protrusion presses the pressed protrusion and FIG. 26B is a diagram illustrating a state where the outer shutter further moves to the outer-shutter closed position from the state shown in FIG. 26A and the pressing protrusion passes through the position of the pressed protrusion.

Figure 27:
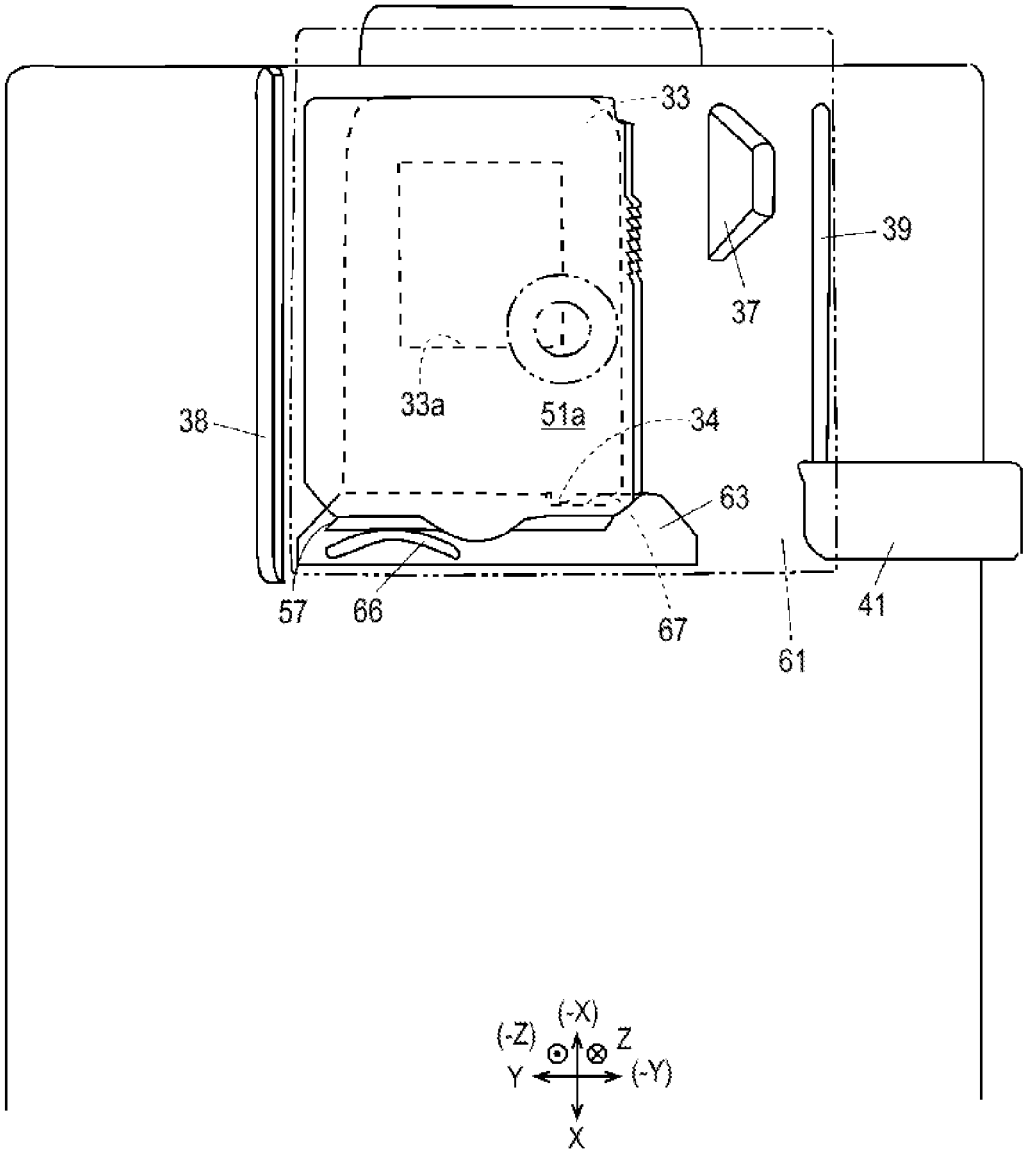

FIG. 27 is a diagram illustrating an operation subsequent to the operation shown in FIGS. 26A and 26B, where the outer shutter moves to the outer-shutter closed position from the state shown in FIG. 26B.

Figure 28A:
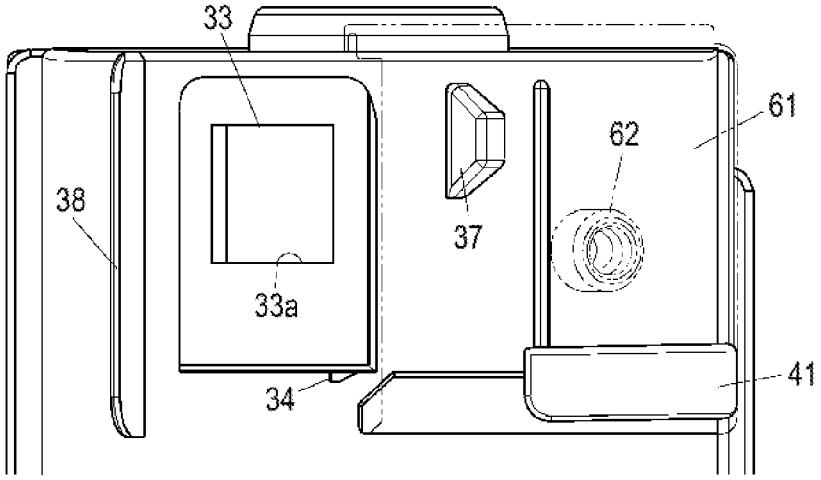
Figure 28B:
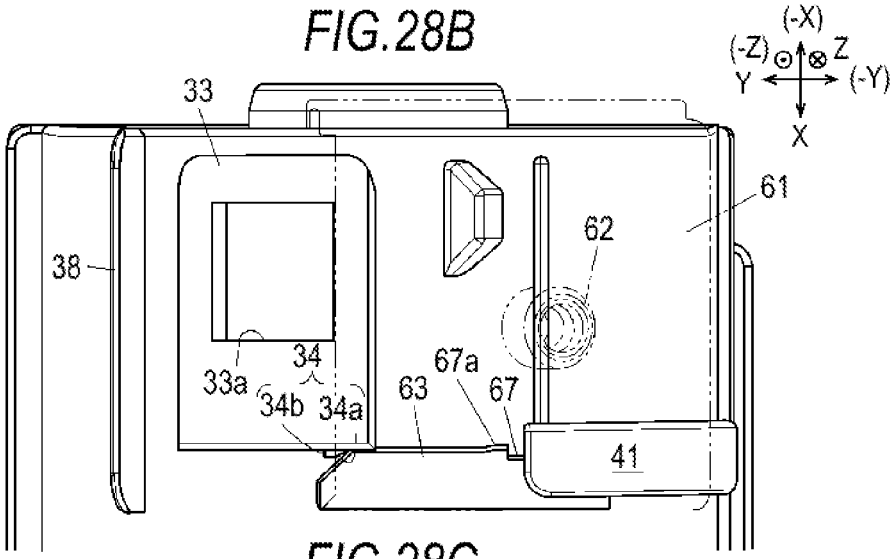
Figure 28C:
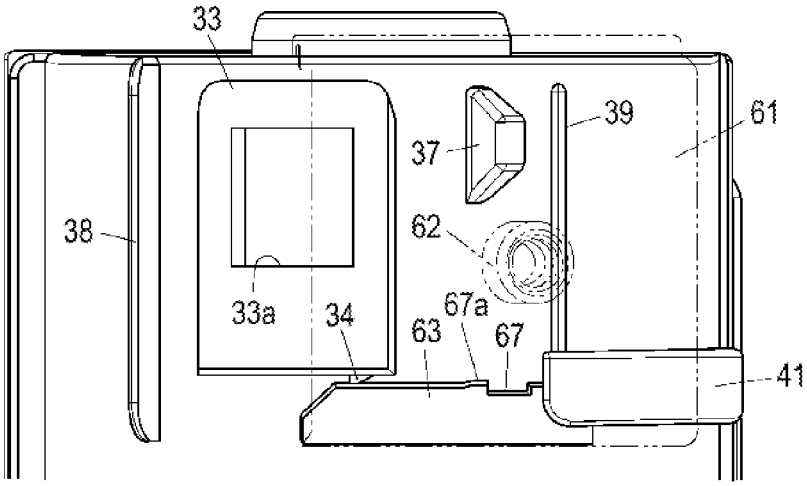

FIGS. 28A to 28C are diagrams illustrating a state where the outer shutter according to the first example completely moves to the outer-shutter closed position, where FIG. 28A is a diagram illustrating an intermediate state where the outer shutter is moving to the outer-shutter closed position, FIG. 28B is a diagram illustrating a state where the outer shutter moves to the outer-shutter closed position from the state shown in FIG. 28A and a front guide rail starts its contact with an outer locking hook, and FIG. 28C is a diagram illustrating a state where the rear end surface of the front guide rail is guided by the outer locking hook and the outer shutter moves to the outer-shutter opened position.

Figure 29A:
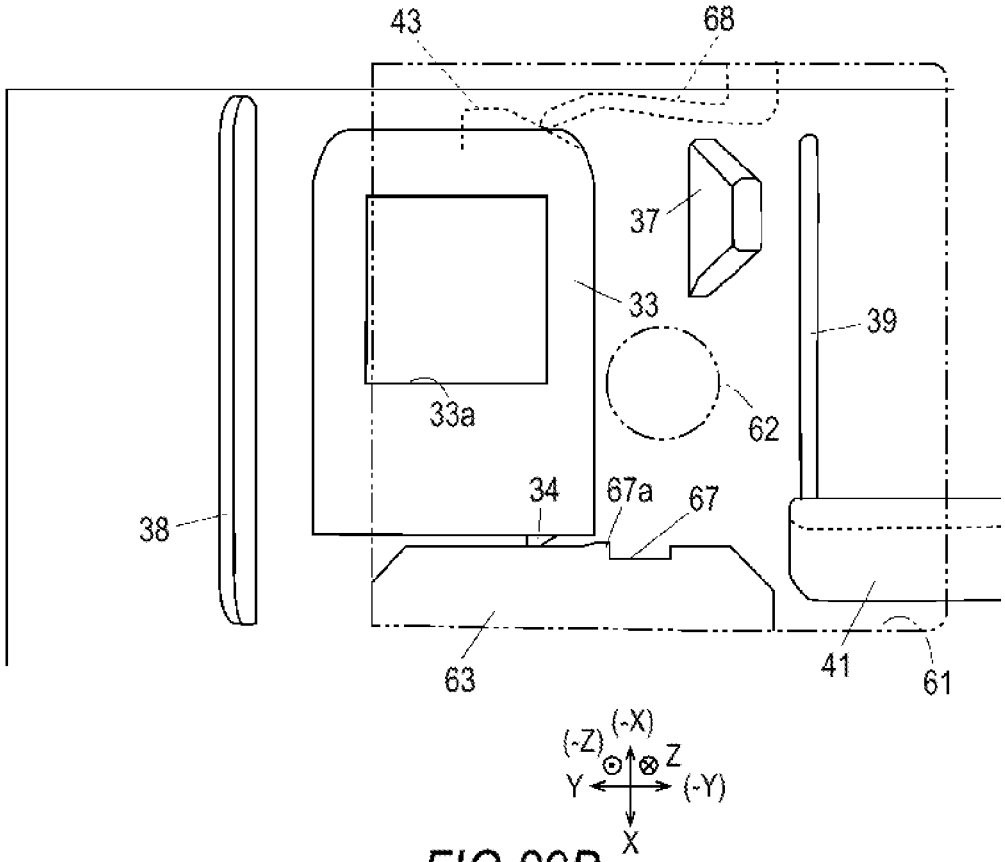
Figure 29B:
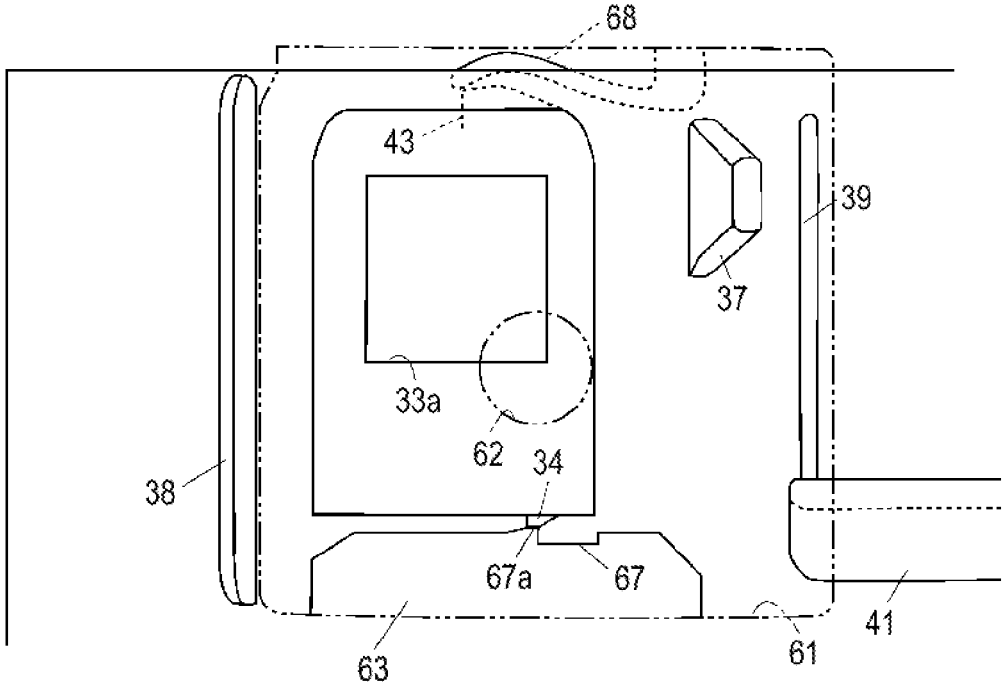

FIGS. 29A and 29B are diagrams illustrating an operation subsequent to the operation shown in FIGS. 28A to 28C, where FIG. 29A is a diagram illustrating a state where the leaf spring portion starts its contact with a spring contact protrusion and FIG. 29B is a diagram illustrating a state where the outer shutter further moves to the outer-shutter closed position from the state shown in FIG. 29A just before the outer locking recess and the outer locking hook engage with each other.

Figure 30A:
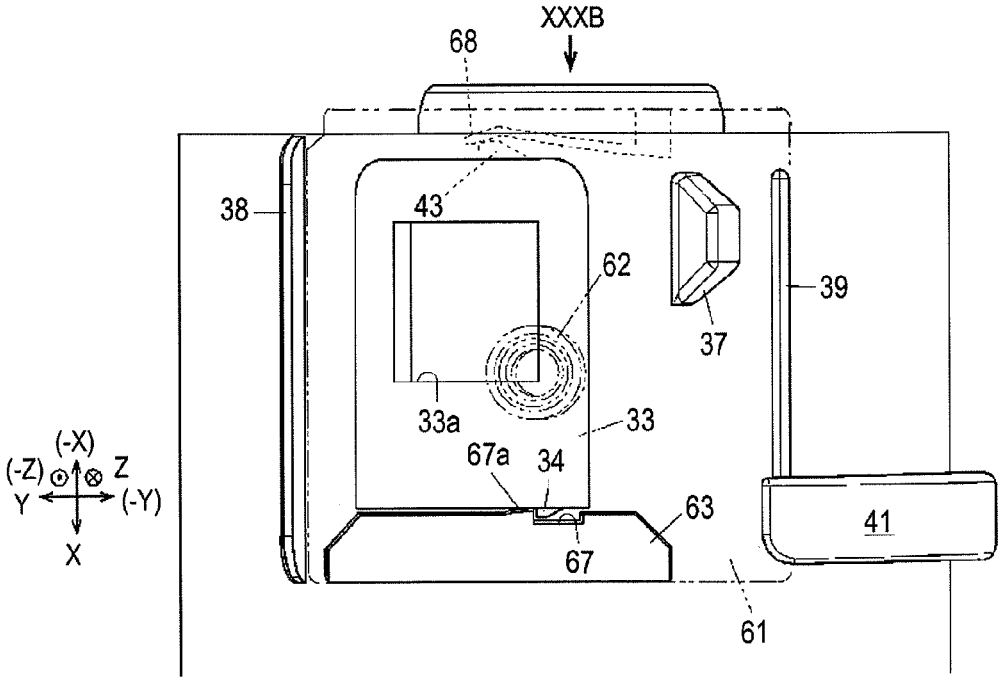
Figure 30B:
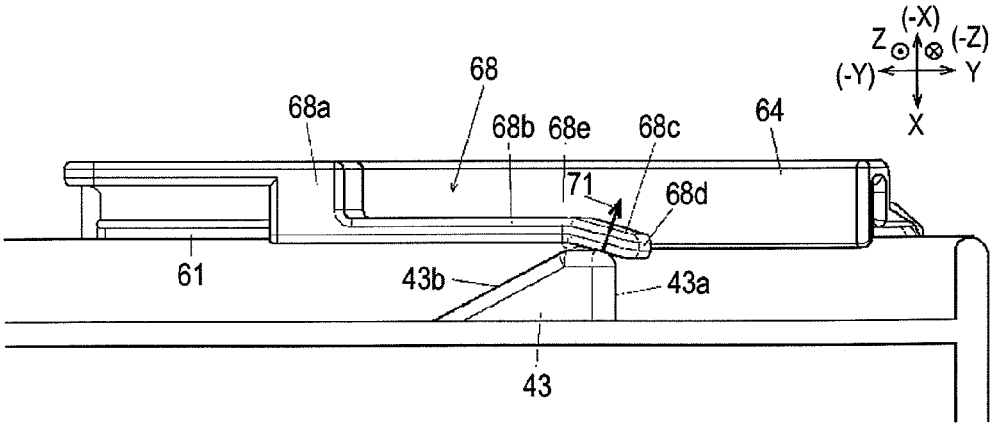

FIGS. 30A and 30B are diagrams illustrating an operation subsequent to the operation shown in FIGS. 29A and 29B, where FIG. 30A is a diagram illustrating a state where the outer shutter further moves to the outer-shutter closed position from the state shown in FIG. 29B and the outer locking recess and the outer locking hook engage with each other and FIG. 30B is a view as viewed in the direction of arrow XXXB of FIG. 30A.

Figure 31A:
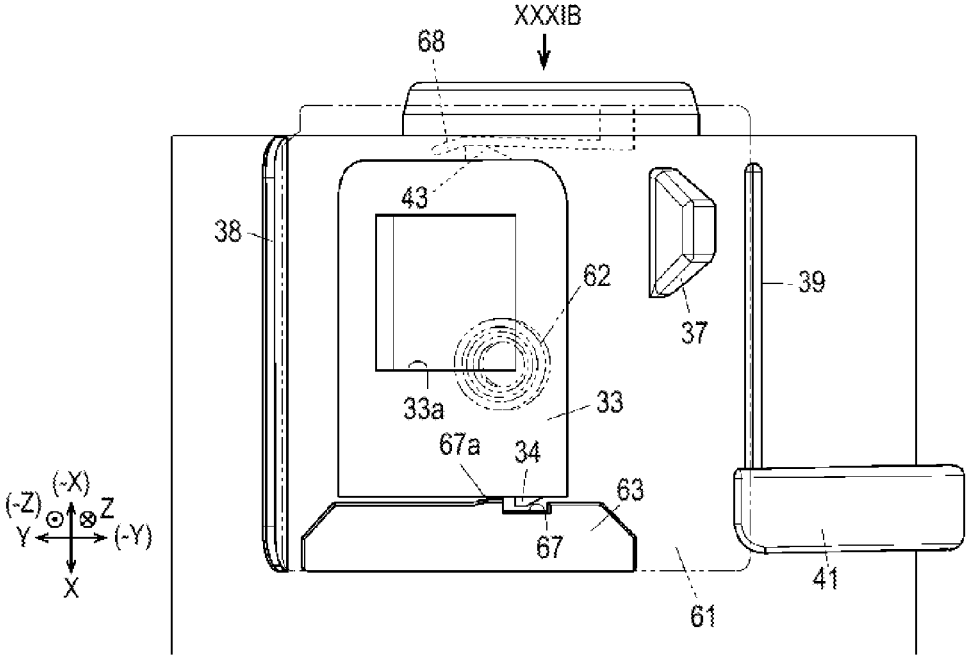
Figure 31B:
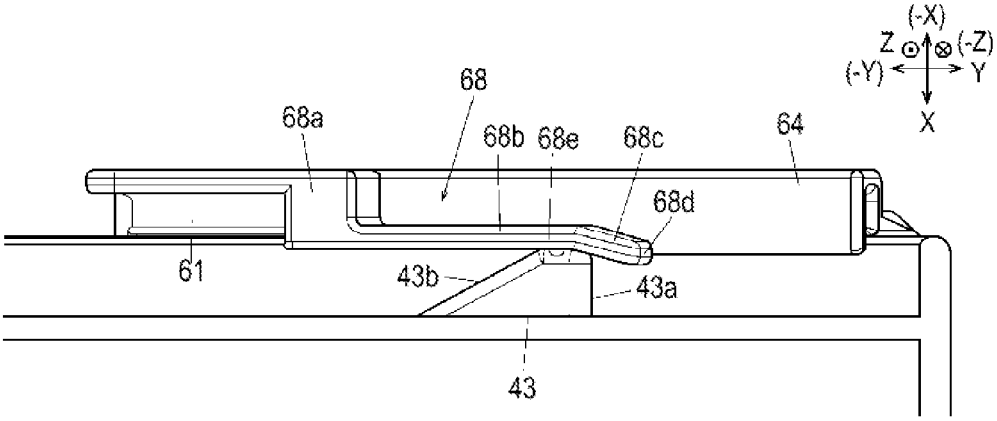

FIGS. 31A and 31B are diagrams illustrating an operation subsequent to the operation shown in FIGS. 30A and 30B, where FIG. 31A is a diagram illustrating a state where the outer shutter completely moves to the outer-shutter closed position and FIG. 31B is a view as viewed in the direction of arrow XXXIB of FIG. 31A.

Figure 32A:
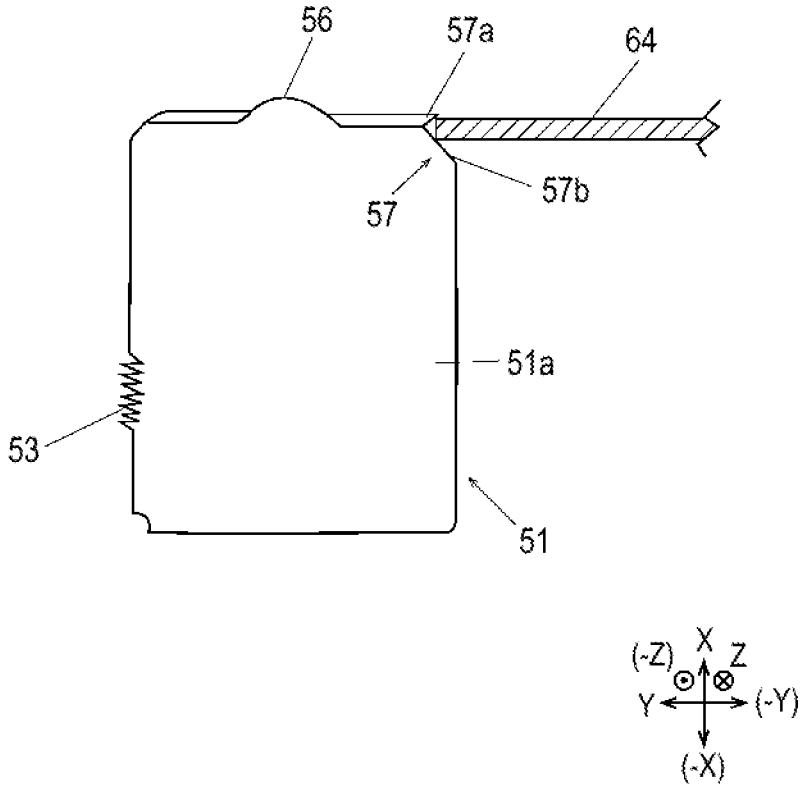
Figure 32B:
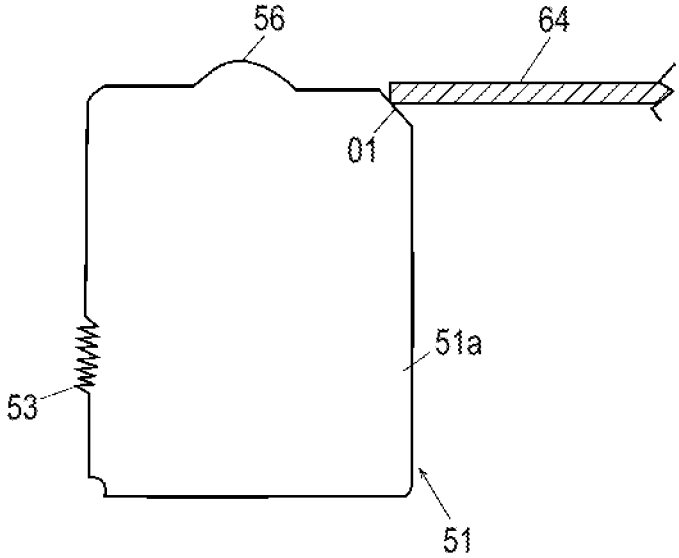

FIGS. 32A and 32B are diagrams illustrating an operation of preventing an erroneous assembly according to the first example, where FIG. 32A is a diagram illustrating a state where the inner shutter according to the first example is erroneously assembled and FIG. 32B is a diagram illustrating a configuration not provided with an erroneous assembly preventing portion.

Figure 33A:
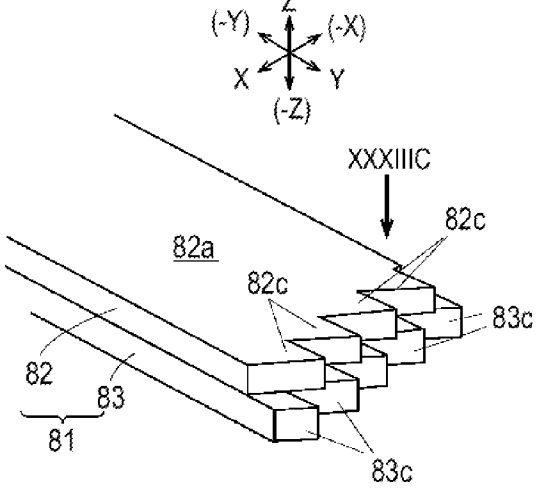
Figure 33B:
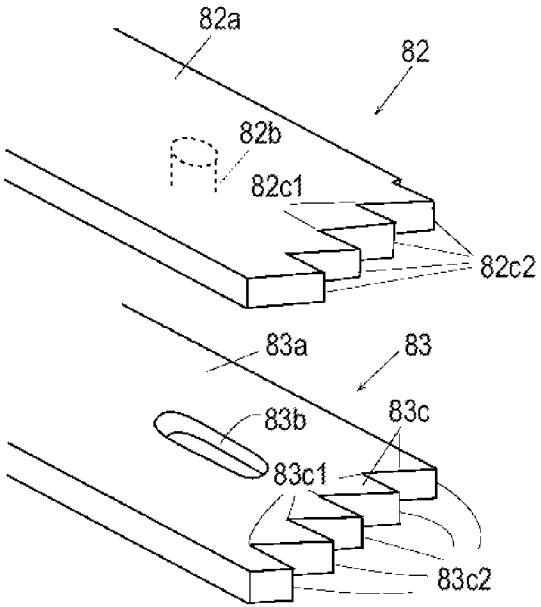
Figure 33C:
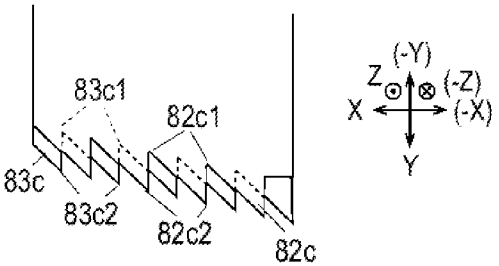

FIGS. 33A to 33C are diagrams illustrating an inner shutter lock according to a second example of the invention, where FIG. 33A is a perspective view, FIG. 33B is a diagram illustrating a state where a first engaging portion and a second engaging portion disengage with each other, and FIG. 33C is a view as viewed in the direction of arrow XXXIIIC of FIG. 33A.

Figure 34A:
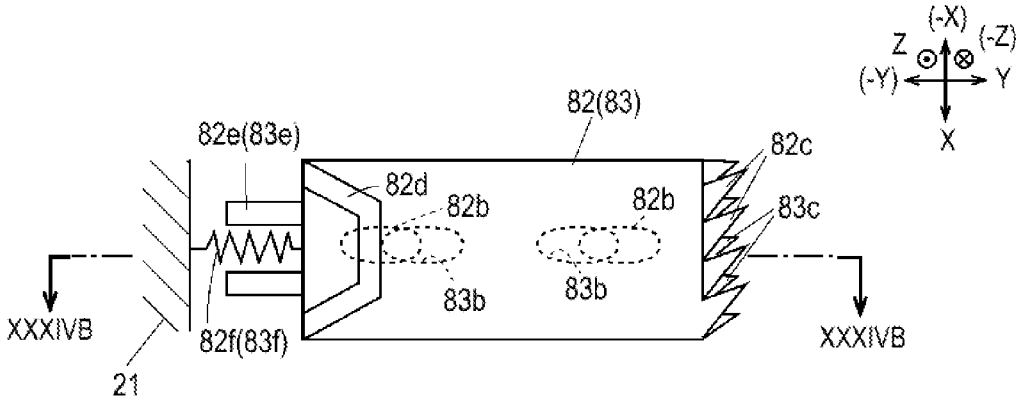
Figure 34B:
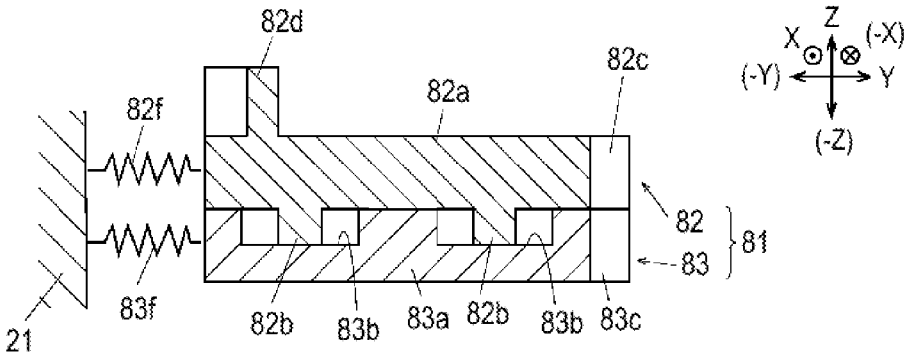

FIGS. 34A and 34B are diagrams illustrating the inner shutter lock according to the second example, where FIG. 34A is a plan view and FIG. 34B is a sectional view taken along line XXXIVB-XXXIVB of FIG. 34A.

Figure 35A:
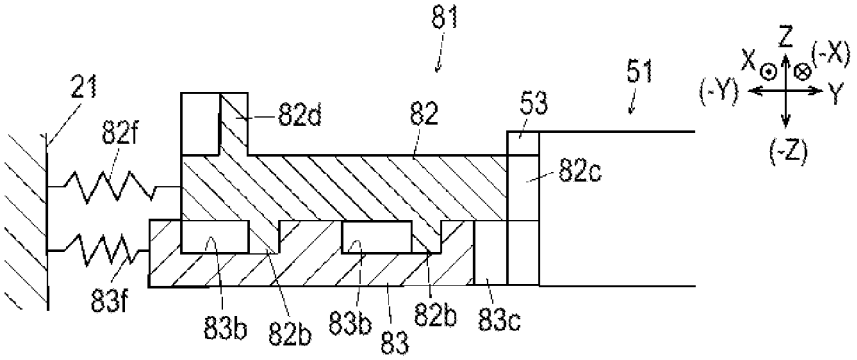
Figure 35B:
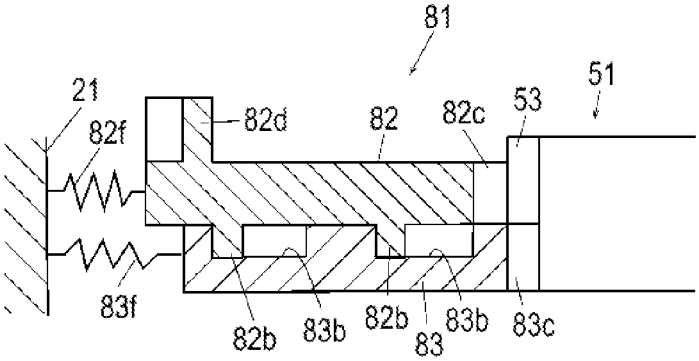
Figure 35C:
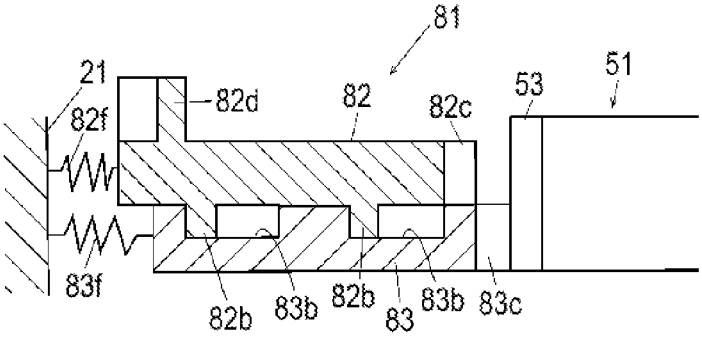
Figure 35D:
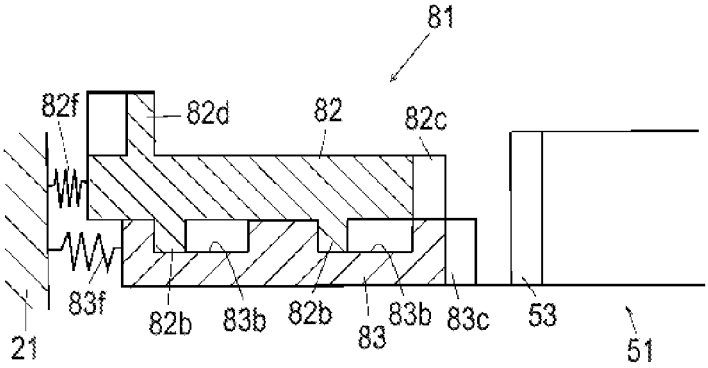

FIGS. 35A to 35D are diagrams illustrating moving states of the inner shutter lock according to the second example, where FIG. 35A is a diagram illustrating a state where an upper lock engages with a locked portion of the inner shutter, FIG. 35B is a diagram illustrating a state where a lower lock engages with the locked portion of the inner shutter, FIG. 35C is a diagram illustrating an intermediate state where the inner shutter lock is moving to the unlocked position, and FIG. 35D is a diagram illustrating a state where the inner shutter lock moves to the unlocked position.

Figure 36B:
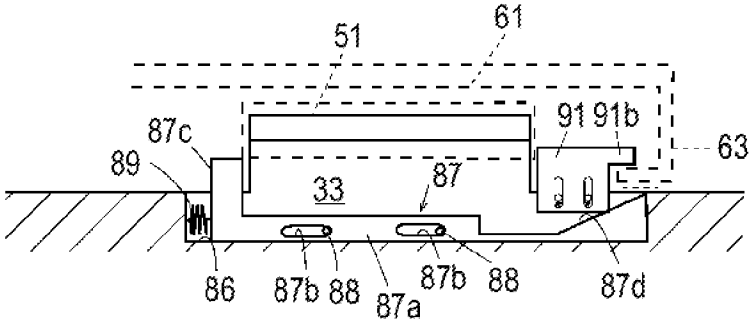
Figure 36A:
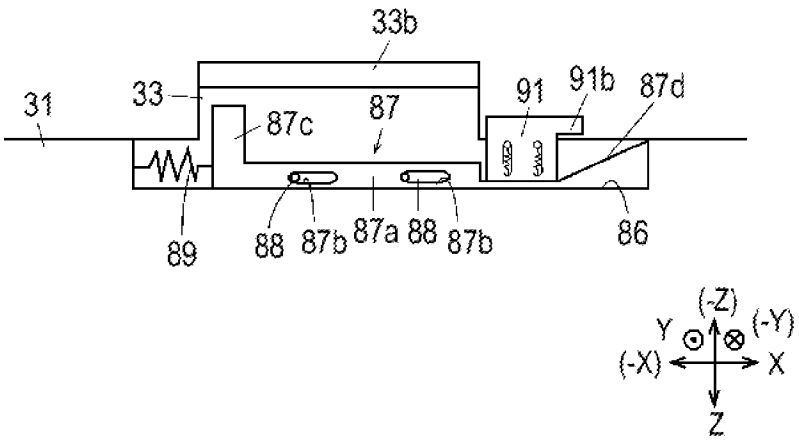
Figure 36C:
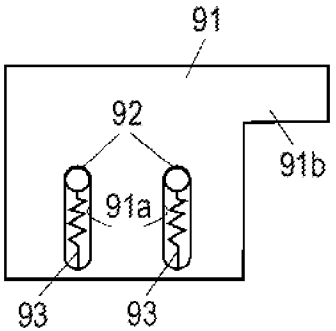

FIGS. 36A to 36C are diagrams illustrating a disengagement restricting portion according to a third example of the invention, where FIG. 36A is a diagram illustrating a state where the inner shutter is not attached, FIG. 36B is a diagram illustrating a state where the inner shutter is attached, and FIG. 36C is a partially-enlarged view of a disengagement restricting member shown in FIG. 36A.

DETAILED DESCRIPTION

Specific embodiments (hereinafter, referred to as "exemplary embodiments") of the invention will be described with reference to the accompanying drawings, but the invention is not limited to the following exemplary embodiments. For the purpose of facilitating the understanding of the below description, it is assumed in the drawings that a front-rear direction is called an X axis direction, a right-left direction is called a Y axis direction, and a top-bottom direction is called a Z axis direction. It is also assumed that directions or sides indicated by arrows X, −X, Y, −Y, Z, and −Z are called front, rear, right, left, top, and bottom directions or front, rear, right, left, top, and bottom sides, respectively.

In the drawings, a mark in which "●" is marked in "○" means an arrow directed from the back to the front of the drawing surface and a mark in which "x" is marked in "○" means an arrow directed from the front to the back of the drawing surface. In the drawings referred to in the below description, only members necessary for the explanation are properly shown for the purpose of facilitating the understanding.

Besides, a developer may be used as an example of powder. That is, in the present invention, a powder container may be a developer container, a powder may be a developer.

FIRST EXAMPLE

Figure 1:
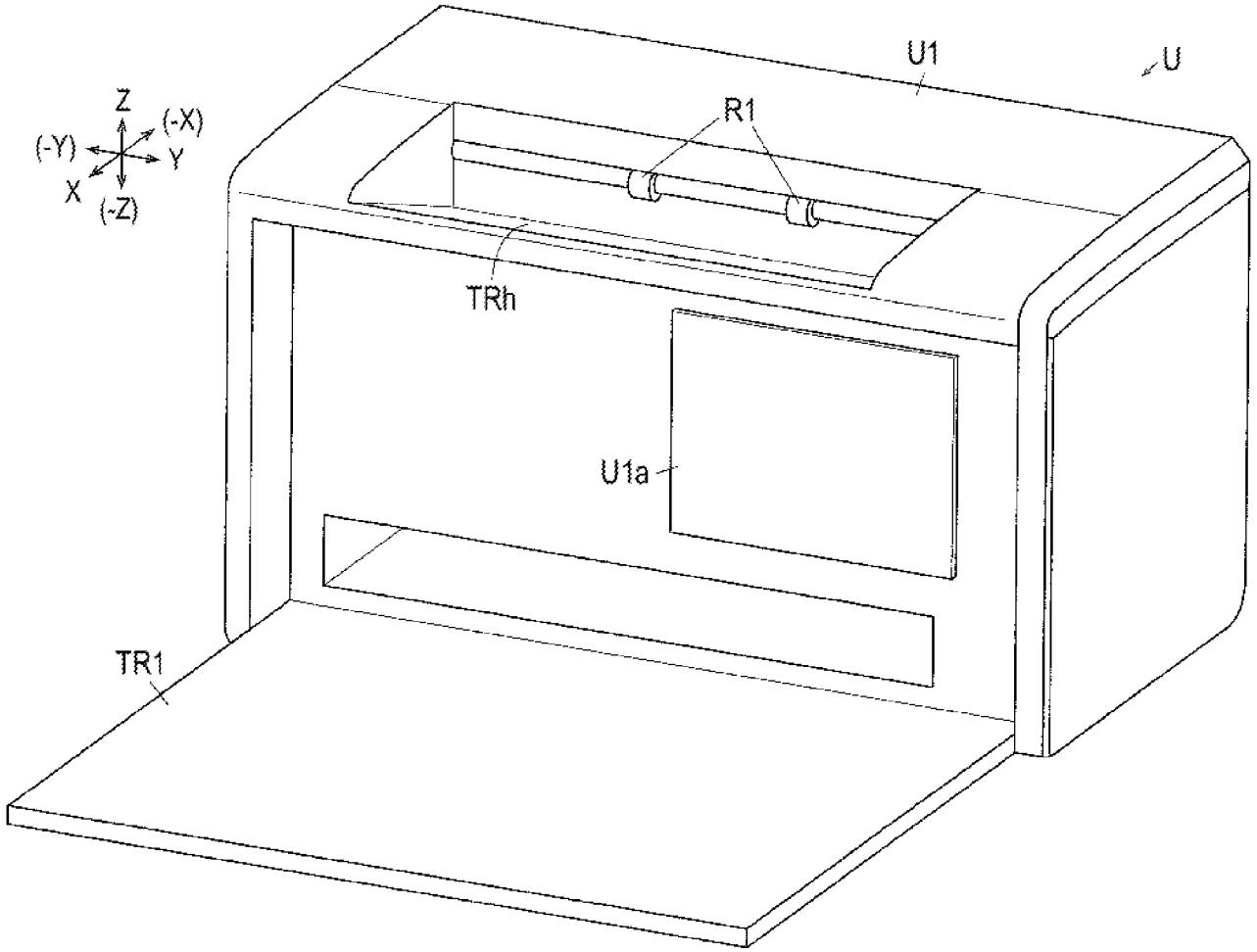
FIG. 1 is a perspective view illustrating an image forming apparatus according to a first example of the invention.

FIG. 1 is a perspective view illustrating an image forming apparatus according to a first example of the invention.

In FIG. 1, a sheet feed tray TR1 as an example of a medium receiver in which recording sheets S are received is disposed on the lower side of the front surface of a printer U as an example of the image forming apparatus according to the first example. A sheet discharge tray TRh as an example of a discharge section to which the sheet S having an image recorded thereon is discharged is formed on the top surface of the printer U. A front cover U1*a* as an example of a covering section to be opened and closed at the time of operating a toner cartridge TC containing developer as an example of a detachable member to be described later and an example of a developer container is formed on the right side of the front surface.

Figure 2:
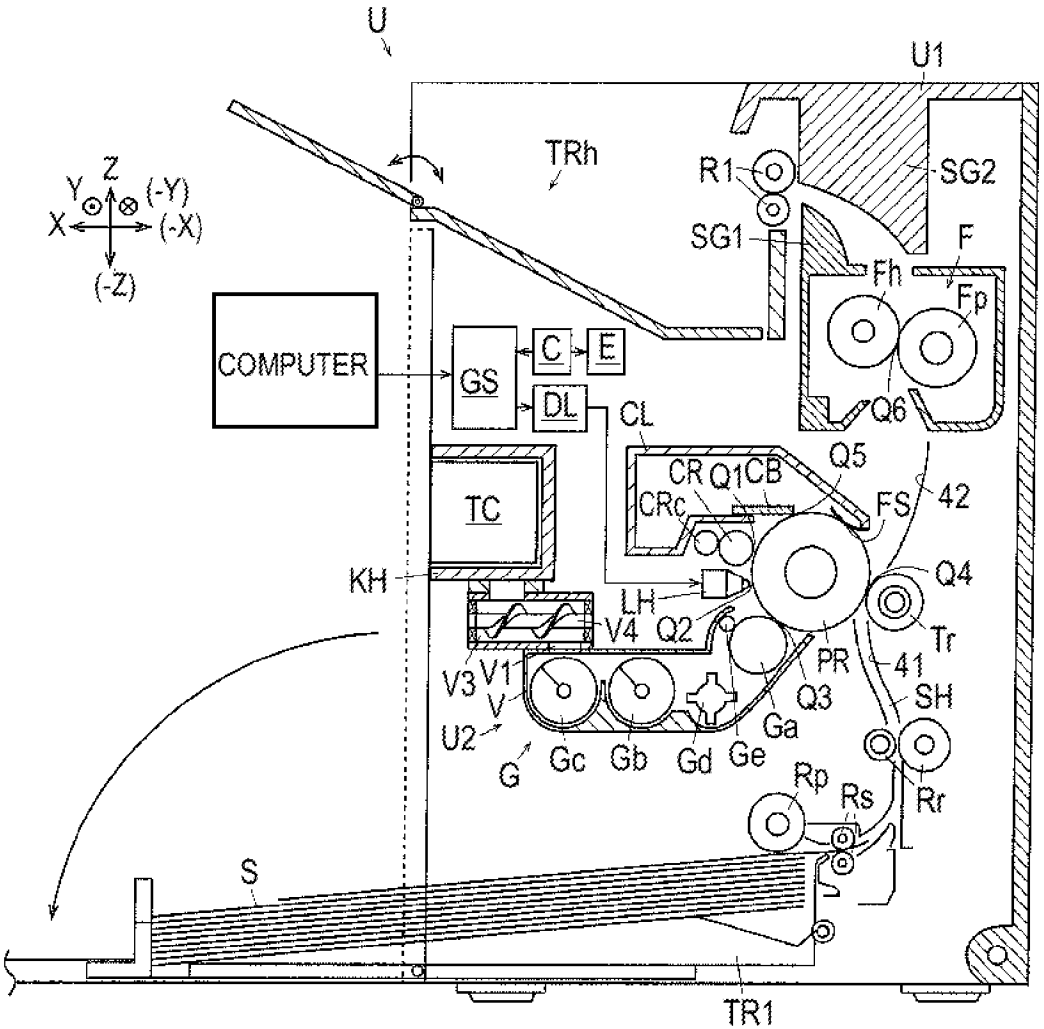
FIG. 2 is a diagram illustrating the entire configuration of the image forming apparatus according to the first example.

FIG. 2 is a diagram illustrating the entire configuration of the image forming apparatus according to the first example.

In FIG. 2, the printer U includes a printer body U1 as an example of the image forming apparatus and an example of a mounting apparatus. The printer body U1 includes a controller C as an example of a control unit, an image processing unit GS of which the operation is controlled by the controller C, a laser driving circuit DL as an example of a latent image forming circuit, and a power supply device E. The power supply device E supplies a voltage to a charging roller CR as an example of a charging device, a developing roller Ga as an example of a developing member, and a transfer roller Tr as an example of a transfer member.

The image processing unit GS converts print information input from a computer as an example of an external information transmitting apparatus into image information for forming a latent image and outputs the image information to the laser driving circuit DL at a predetermined time, that is, at a predetermined timing. The laser driving circuit DL outputs a drive signal based on the input image information to a latent image forming device LH. The latent image forming device LH according to the first example is made up of a device, that is, a so-called LED head, in which LEDs as an example of a latent writing device are arranged in a line in a right-left direction at a predetermined interval.

A photosensitive member PR as an example of a rotating image holding member is supported in the rear part of the printer body U1. The charging roller CR as an example of a charging device, the latent image forming device LH, the developing device G, the transfer roller Tr as an example of a transfer device, and a photosensitive member cleaner CL as an example of a cleaner for the image holding member are arranged around the photosensitive member PR in the rotating direction of the photosensitive member PR.

In FIG. 2, a charging roller cleaner CRc as an example of a charging device cleaner cleaning the surface of the charging roller CR is disposed to face and contact the charging roller CR.

The developing device G includes a developing vessel V containing developer. The developing roller Ga disposed to face the photosensitive member PR, a pair of carriage members Gb and Gc agitating and carrying the developer, a supply member Gd supplying the developer agitated by the carriage members Gb and Gc to the developing roller Ga, and a thickness regulating member Ge regulating the thickness of the developer on the surface of the developing roller Ga are arranged in the developing vessel V.

A developer supply port V1 as an example of a supply section is formed on the upper front surface of the developing vessel V, and a developer supply path V3 as an example of a developer carrying path extending forward is connected to the developer supply port V1. A supply auger V4 as an example of a developer carriage member is rotatably supported in the developer supply path V3. A cartridge holder KH as an example of a detachable section to which a toner cartridge TC is detachably mounted is connected to the front end of the developer supply path V3 and the developer is supplied from the toner cartridge TC. Accordingly, when the supply auger V4 is driven on the basis of the amount of developer consumed in the developing device G, the developer is supplied to the developing device G from the toner cartridge TC.

The surface of the rotating photosensitive member PR is charged in a charging area Q1 by the charging roller CR and an electrostatic latent image is formed thereon at a latent image forming position Q2 by the use of a latent image forming beam emitted from the latent image forming device LH. The electrostatic latent image is developed into a toner image as an example of a visible image in a developing area Q3 by the developing roller Ga and is transferred onto a recording sheet S as an example of a medium in a transfer area Q4, which is formed by the area opposed to the photosensitive member PR and the transfer roller Tr, by the transfer roller Tr. The toner remaining on the surface of the photosensitive member PR is removed in a cleaning area Q5 as an example of a cleaning area, which is located on the downstream side of the transfer area Q4, by a cleaning blade CB as an example of a cleaning member and is recovered in the photosensitive member cleaner CL.

A film seal FS as an example of an anti-scattering member is disposed on the side facing the cleaning blade CB. The film seal FS prevents the toner recovered in the photosensitive cleaner CL from overflowing.

In the lower part of the printer body U1 shown in FIG. 2, a pickup roller Rp as an example of a medium pickup member is disposed in the sheet feed tray TR1. Recording sheets S picked up by the pickup roller Rp are separated sheet by sheet by a handling roller Rs including a retard roller and a feed roller as an example of a medium handling member, are carried along a sheet carrying path SH, and are carried to the transfer area Q4 at a predetermined time by a registration roller Rr as an example of a timing adjusting member disposed upstream in a sheet carrying direction from the transfer area Q4.

The transfer roller Tr to which a transfer voltage is applied from the power supply device E controlled by the controller C transfers the toner image on the photosensitive member PR to the recording sheet S passing through the transfer area Q4.

The recording sheet S to which the toner image is transferred in the transfer area Q4 is carried to a fixing device F with the toner image not fixed yet. The fixing device F includes a pair of fixing rollers Fh and Fp as an example of a fixing member. A fixing area Q6 is formed by a nip area between the pair of fixing rollers Fh and Fp. The toner image is fixed to the recording sheet S carried to the fixing device F in the fixing area Q6 by the pair of fixing rollers Fh and Fp. The recording sheet S having the toner image fixed thereto is guided by sheet guides SG1 and SG2 as an example of a medium guide member and is discharged to the sheet discharge tray TRh on the top surface of the printer body U1 from a discharge roller R1 as an example of a discharge member.

Cartridge Holder KH

Figure 3:
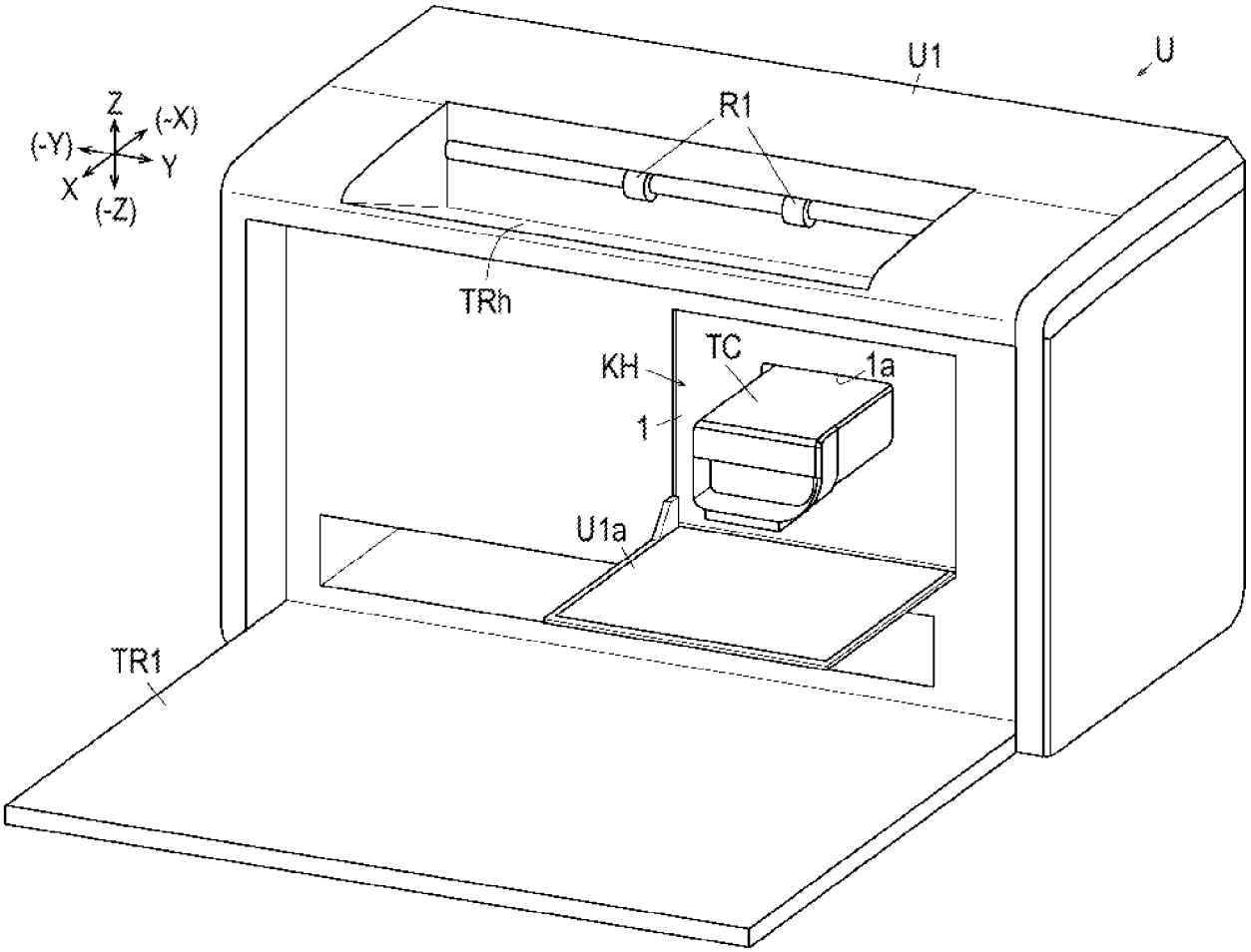
FIG. 3 is a diagram illustrating a state where a front cover of the image forming apparatus according to the first example is opened.

FIG. 3 is a diagram illustrating a state where the front cover is opened in the image forming apparatus according to the first example.

In FIGS. 1 and 3, when the front cover U1*a* of the printer U according to the first example is moved to an operation position shown in FIG. 3 from the normal position shown in FIG. 1, the toner cartridge TC as an example of a developer container and the cartridge holder KH as an example of a container support supporting the toner cartridge TC are externally exposed. In FIG. 3, the cartridge holder KH is supported by the printer body U1 and includes a front panel 1 as an example of a front member. An opening 1*a* through which the toner cartridge TC is attached and detached is formed in the front panel 1.

Figure 4:
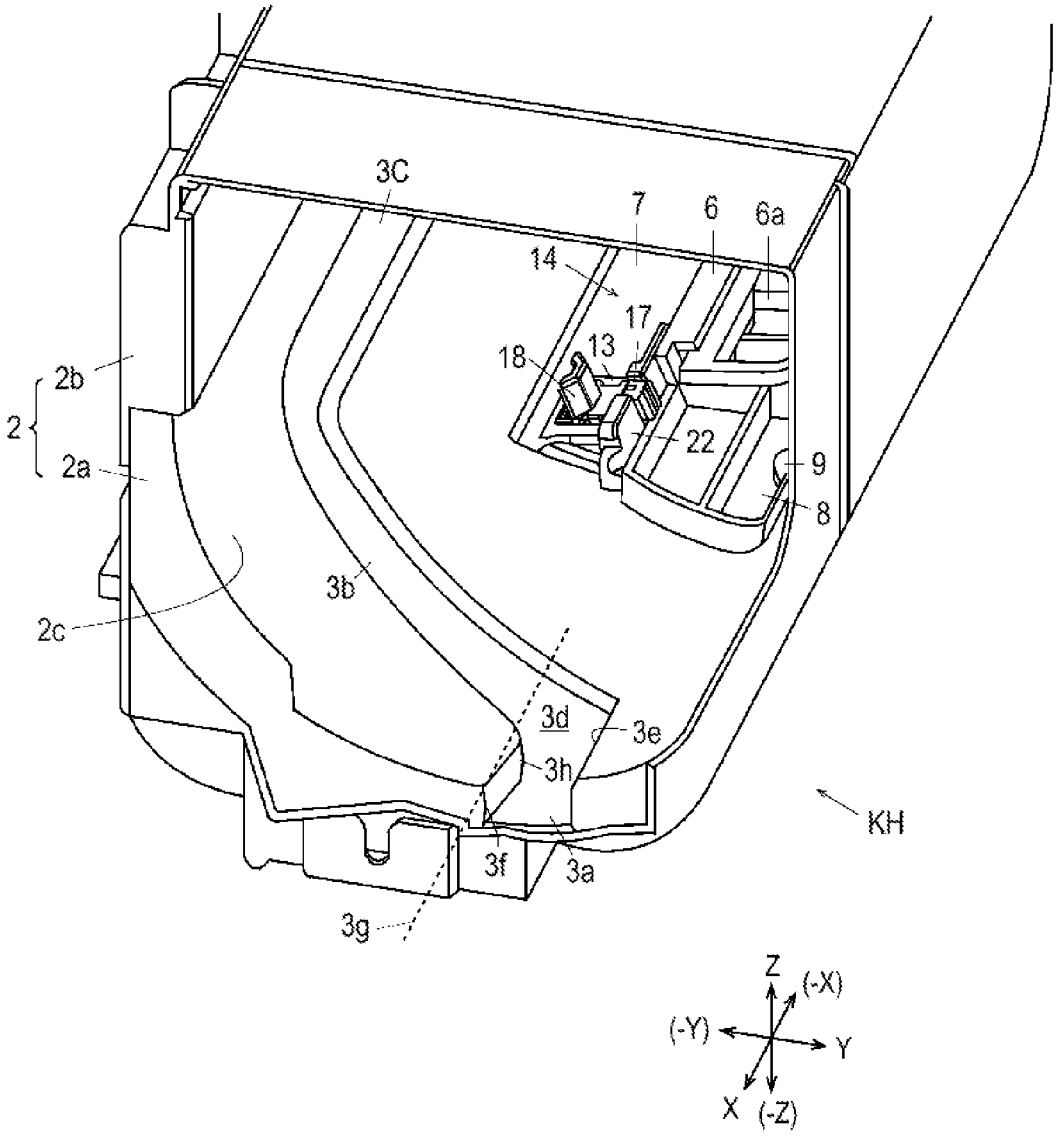
FIG. 4 is a perspective view illustrating a cartridge holder according to the first example.

FIG. 4 is a perspective view illustrating the cartridge holder according to the first example.

Figure 5A:
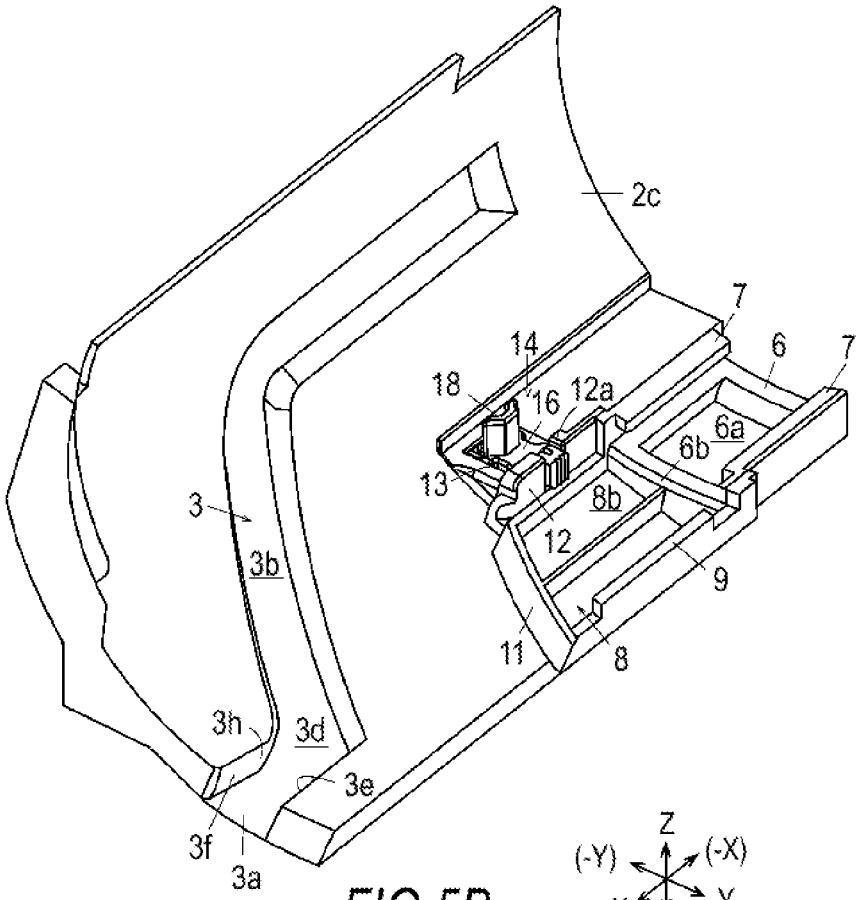
FIGS. 5A and 5B are diagrams partially illustrating the cartridge holder according to the first example, where
Figure 5A:
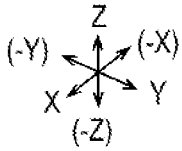
Figure 5B:
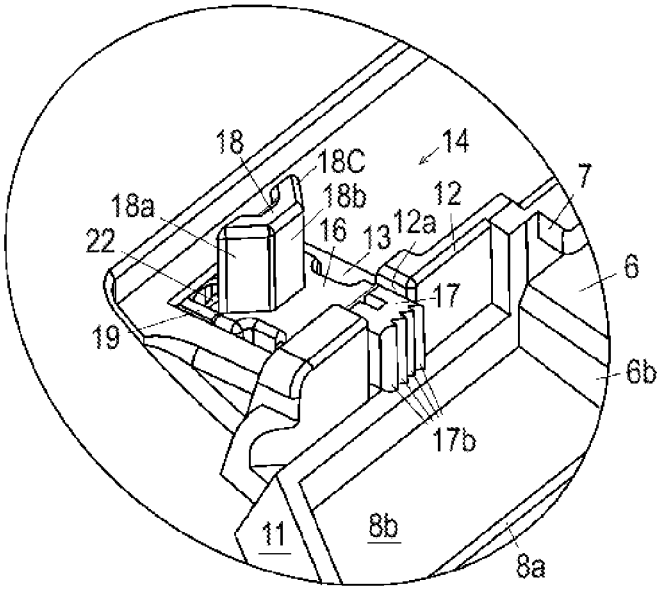
Figure 6:
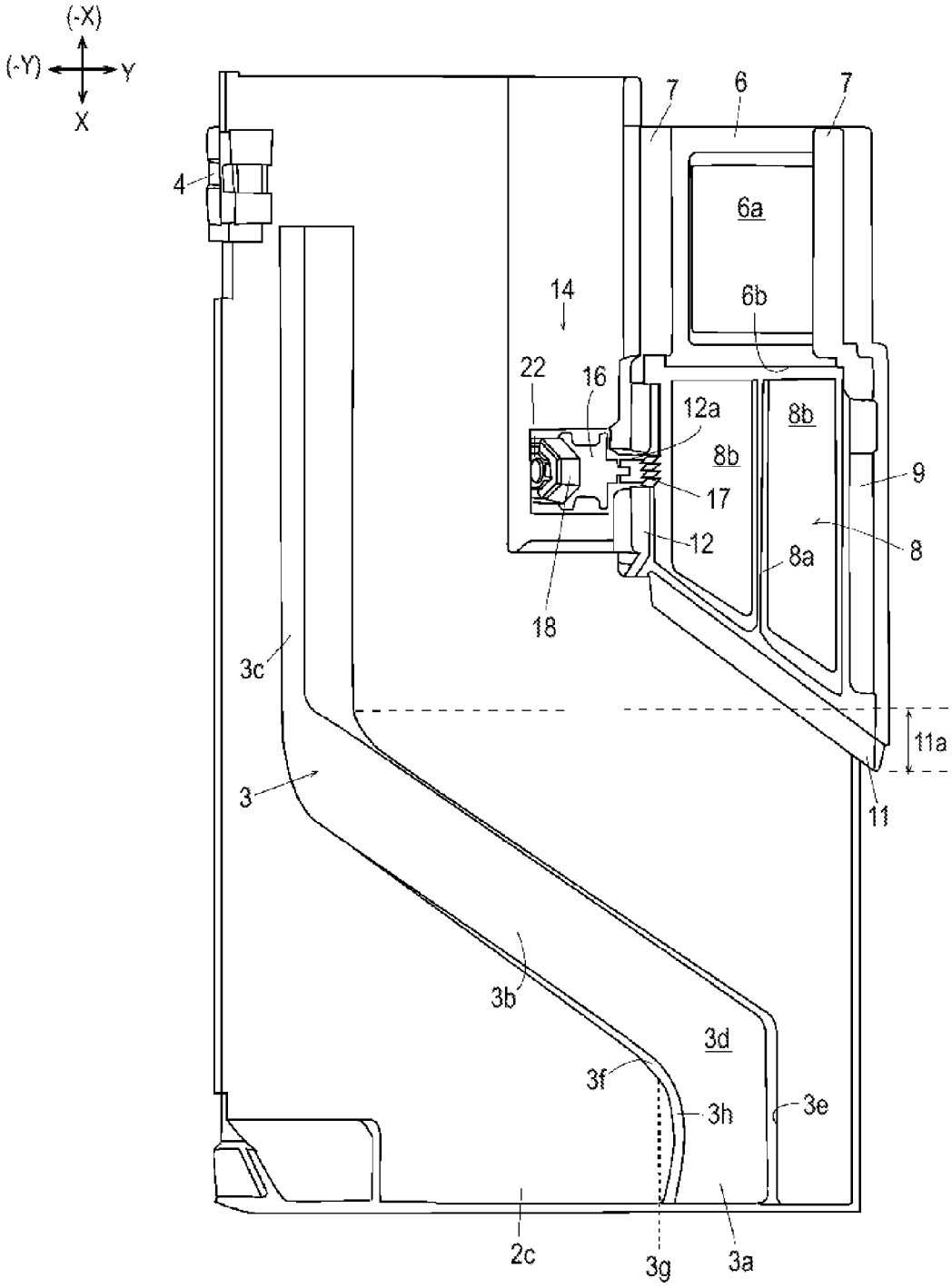
FIG. 6 is a plan view of the cartridge holder according to the first example.

FIGS. 5A and 5B are diagrams partially illustrating the cartridge holder according to the first example, where FIG. 5A is a perspective view and FIG. 5B is a partially-enlarged view of an inner shutter lock. FIG. 6 is a plan view of the cartridge holder according to the first example.

In FIGS. 4 to 6, the cartridge holder KH according to the first example includes a cylindrical holder body 2 as an example of a support body extending rearward from the opening 1*a*. The holder body 2 includes a semi-cylindrical bottom section 2*a* disposed in the lower part and a square-barrel top section 2*b* formed on the bottom section 2*a*. An inner surface 2*c* is formed inside the bottom section 2*a* and the top section 2*b*.

Covering Groove for Outer Shutter

A covering groove 3 as an example of a covering section of a second covering member extending rearward from the front end of the holder body 2 is formed in the inner surface 2*c*. In FIG. 6, the covering groove 3 according to the first example includes a front groove portion 3*a* as an example of a passage extending rearward from the front end in the front-rear direction which is an attaching and detaching direction of the toner cartridge TC, a spiral groove portion 3*b* as an example of a covering contact portion extending obliquely to the left upside from the front end along the inner surface 2*c*, and a rear groove portion 3*c* as an example of a second passage extending rearward from the top end of the spiral groove portion 3*b*. In the covering groove 3 according to the first example, a right inner groove surface 3*e* apart from the spiral groove portion 3*b* is formed in the front-rear direction in a connecting portion 3*d* between the front groove portion 3*a* and the spiral groove portion 3*b* and a swelling portion 3*h* as an example of a convex portion swelling to the right side of the position of the opening 1*a* from a virtual line 3*g* indicated by a broken line in FIG. 6 and extending in the front-rear direction is formed in a left inner groove surface 3*f* close to the spiral groove portion 3*b*.

In FIG. 6, a CRUM reader 4 as an example of a recording medium reader is disposed on the rear side of the upper-left end in the holder body 2 according to the first example.

Supply Port

In FIGS. 5A and 5B and FIG. 6, a supply port portion 6 as an example of a first opening portion formed to protrude upward from the inner surface 2*c* of the bottom section 2*a* is formed at the rear end of the bottom section 2*a* of the holder body 2. A supply port 6*a* as an example of a first opening passing through the bottom section in the top-bottom direction and being connected to the upstream end of the developer supply path V3 is formed at the center of the supply port portion 6. An inner shutter stopper surface 6*b* as an example of a stopper of a first covering member is formed on the front end of the supply port portion 6.

Holder guides 7 as an example of a guide of a second opening extending inwardly in the right-left direction from the top end of both side walls higher than the supply port portion 6 and also extending in the front-rear direction are formed on both sides of the supply port portion 6.

An inner shutter receiver 8 as an example of a receiving portion of the first covering member that is higher than the inner surface 2*c* and lower than the supply port portion 6 is formed on the front side of the supply port portion 6. In the inner shutter receiver 8, a guide rib 8*a* as an example of a friction reducing portion extending in the front-rear direction is formed at the center in the right-left direction and a recess 8*b* recessed downward is formed on both sides of the guide rib 8*a*.

A clearance plugging wall 9 as an example of a posture aligning portion protruding upward is formed at the right end of the inner shutter receiver 8.

A slope 11 inclined from the inner shutter receiver 8 to the inner surface 2*c* is formed at the front end of the inner shutter receiver 8. In FIG. 6, the slope 11 according to the first example is inclined rearward as it goes from the right to the left and the slope has a slope angle corresponding to the slope of the spiral groove portion 3*b* so as to reduce an operator's operating force at the time of inserting and pulling the toner cartridge TC. In the first example, the slope 11 has an overlapping area 11*a* in which a part of the front part in the front-rear direction overlaps with a part of the rear part of the spiral groove portion 3*b* in the front-rear direction.

A lock side wall 12 as an example of a movement restricting portion of an engaging portion extending upward is formed at the left end of the inner shutter receiver 8. A lock passing hole 12*a* as an example of a passage of the engaging portion is formed at the center in the front-rear direction of the lock side wall 12.

Inner Shutter Lock

Figure 7C:
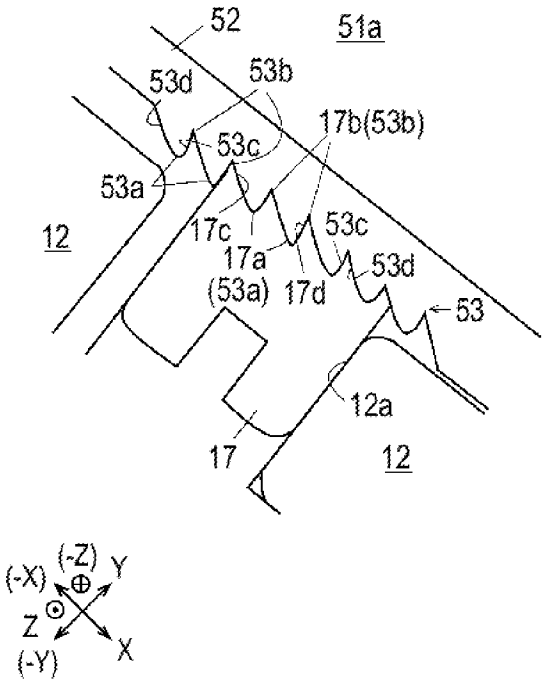
FIGS. 7A to 7C are diagrams illustrating the inner shutter lock according to the first example, where
Figure 7B:
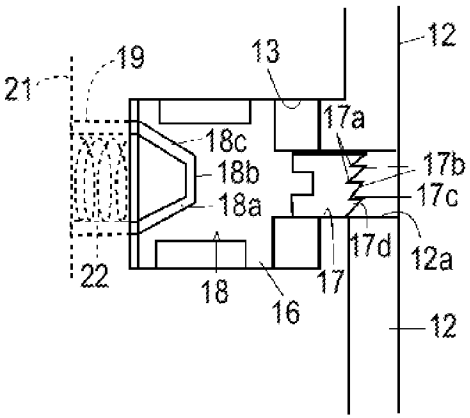
Figure 7A:
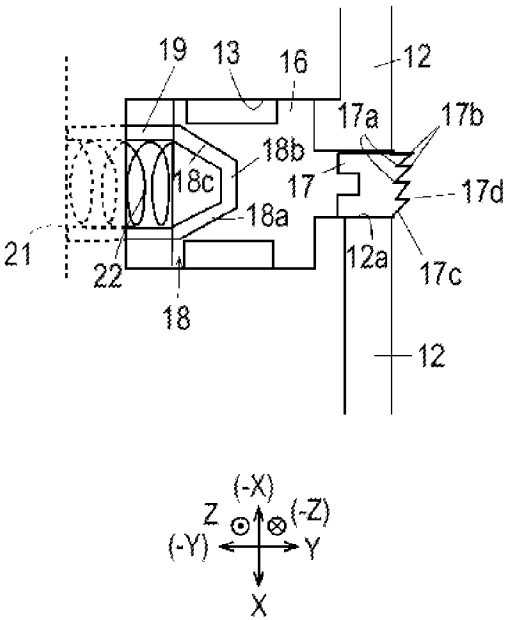

FIGS. 7A to 7C are diagrams illustrating an inner shutter lock according to the first example, where FIG. 7A is a diagram illustrating a state where the inner shutter lock moves to a locked position, FIG. 7B is a diagram illustrating a state where the inner shutter lock moves to an unlocked position, and FIG. 7C is an enlarged view of gear teeth.

A lock guide 13 as an example of a guide of the engaging portion extending to the left is formed on the left side of the lock passing hole 12*a*. In FIG. 6 and FIGS. 7A to 7C, an inner shutter lock 14 as an example of a movement restricting member of the first covering member is supported by the lock guide 13. The inner shutter lock 14 includes a lock slider 16 as an example of a guide of the movement restricting member that is supported by the inner surface of the lock guide 13 so as to be movable in the right-left direction. Accordingly, the inner shutter lock 14 is supported to be movable between a locked position as an example of a movement restricting position shown in FIG. 7A where the right end surface of the lock slider 16 comes in contact with the left surface of the lock side wall 12 and is stopped and an unlocked position as an example of a movement permitting position shown in FIG. 7B where the lock slider moves from the locked position to the left side.

A lock body 17 as an example of the engaging portion extending to the right and entering the inner shutter receiver 8 through the lock passing hole 12*a* is formed at the right end of the lock slider 16. The lock body 17 according to the first example comes in contact with the inner surface of the lock passing hole 12*a* and is guided thereby. The right end surface of the lock body 17 has a shape in which a concave portion 17*a* and a convex portion 17*b* protruding to the right are periodically formed. That is, the right end surface of the lock body 17 according to the first example has a gear teeth shape.

In FIG. 7C, the front surface 17*c*, which is an upstream surface in the rear direction which is the attaching direction of the toner cartridge TC, of the convex portion 17*b* in the first example is inclined to the right, which is a direction in which it approaches the inside of the lock receiver 8 as it goes rearward. The rear surface 17*d* of the convex portion 17*b* which is a downstream surface connected to the rear end of the front surface 17*c* is formed to be inclined to the front as it goes to the left. The inclination angle of the rear surface 17*d* is smaller in respect to the right-left direction than the front surface 17*c*. The rear surface 17*d* may be inclined to the front-left side from the rear-right side, but may be formed in the right-left direction.

In FIGS. 7A to 7C, a slide protrusion 18 as an example of a separation contact portion protruding upward is formed on the upper-left surface of the lock slider 16. The slider protrusion 18 includes a front guide surface 18*a* as an example of a first separation guiding portion inclined to the right as it goes backward from the front end, an intermediate guide surface 18*b* as an example of a second separation guiding portion extending rearward from the rear end of the front guide surface 18*a*, and a rear guide surface 18*c* as an example of a third separation guiding portion inclined to the left as it goes backward from the rear end of the intermediate guide surface 18*b*.

A cylindrical spring receiver 19 as an example of an urging member receiver extending to the left is formed at the left end of the lock slider 16.

A spring support 21 as an example of a support of a separation urging member is formed on the bottom surface of the bottom section 2*a* and a coil spring 22 as an example of an urging member received in the spring receiver 19 is disposed between the spring support 21 and the left surface of the lock slider 16. Accordingly, the lock slider 16 is normally urged to the right and the inner shutter lock 14 is urged to the locked position with the elastic force of the coil spring 22. The coil spring 22 is exemplified as the urging member, but the invention is not limited to this example. Any urging member formed of elastic rubber or the like can be employed.

Toner Cartridge

Figure 8:
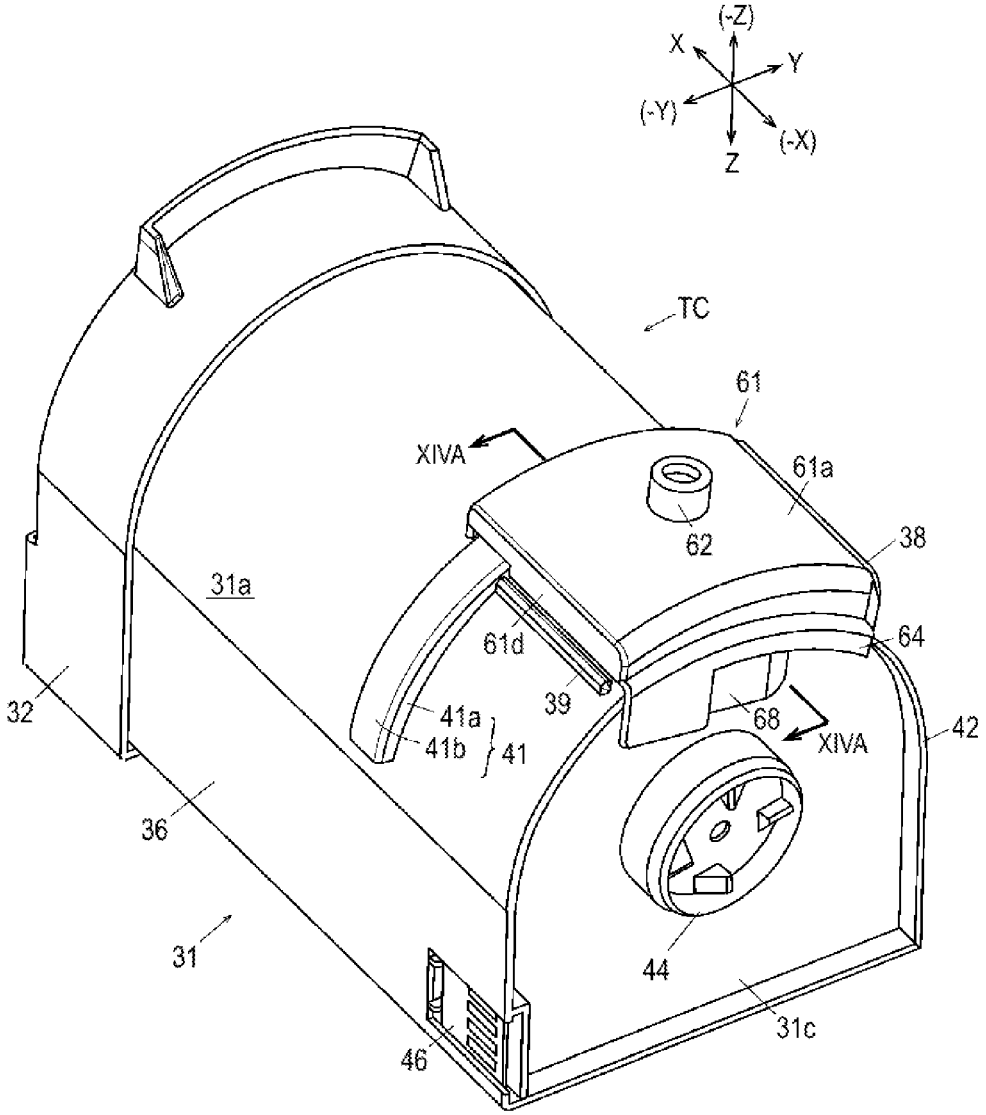
FIG. 8 is a diagram illustrating a toner cartridge according to the first example, where an outer shutter and an inner shutter move to covered positions.

FIG. 8 is a diagram illustrating the toner cartridge according to the first example, where an outer shutter and an inner shutter move to covered positions.

Figure 9:
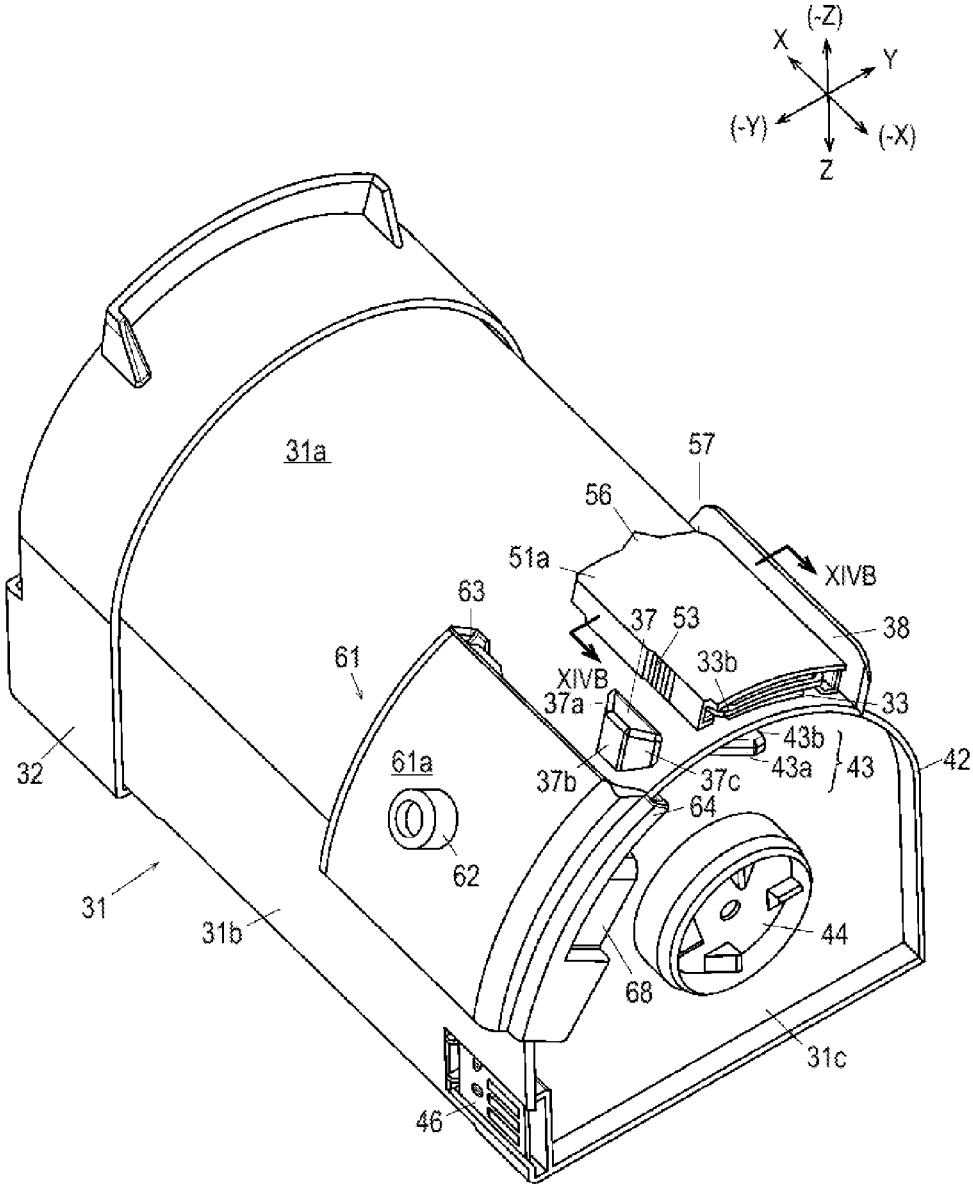
FIG. 9 is a diagram illustrating the toner cartridge according to the first example, where the outer shutter moves to an uncovered position and the inner shutter moves to the covered position.
Figure 10:
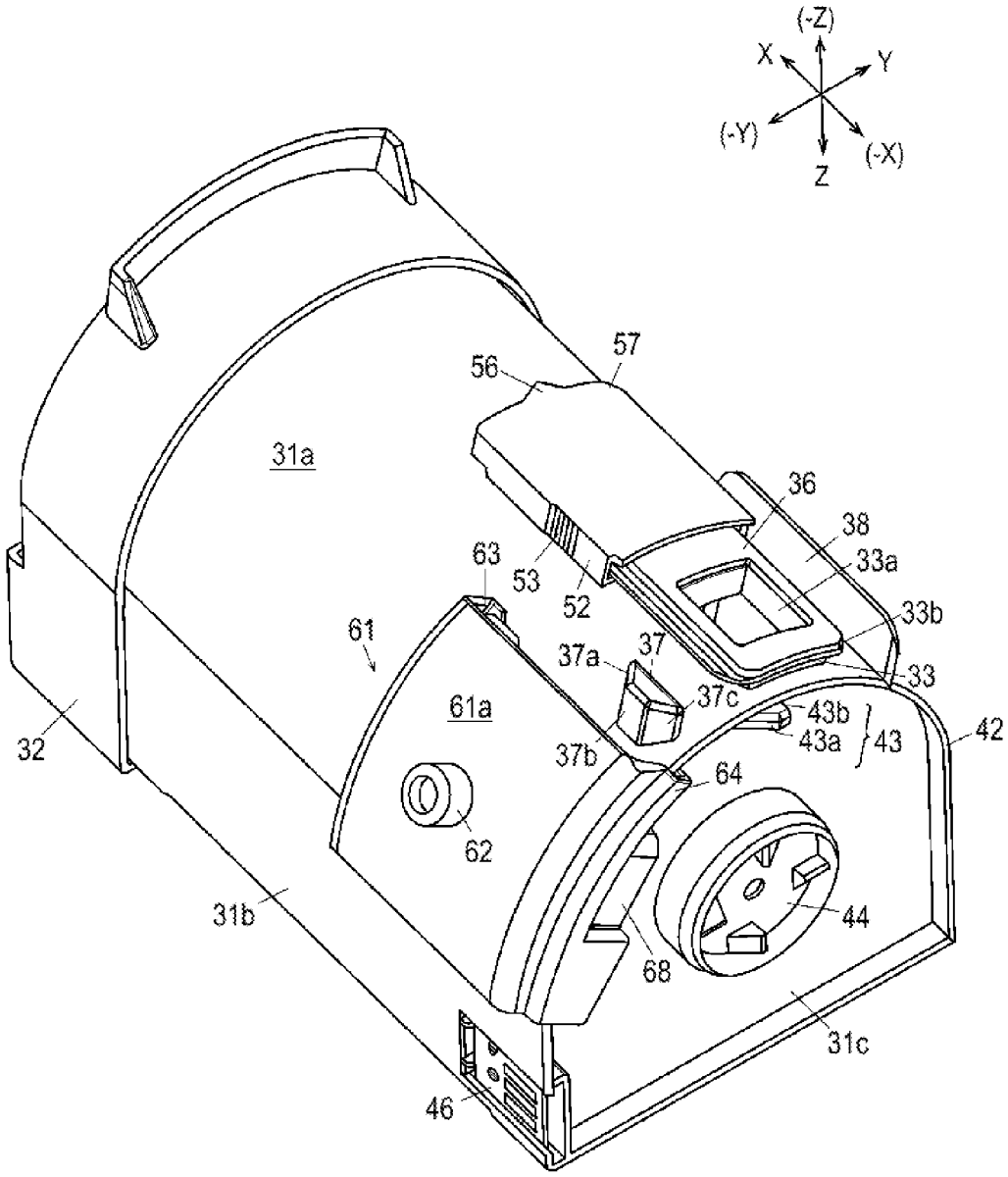
FIG. 10 is a diagram illustrating the toner cartridge according to the first example, where the outer shutter and the inner shutter move to the uncovered positions.

FIG. 9 is a diagram illustrating the toner cartridge according to the first example, where the outer shutter moves to an uncovered position and the inner shutter moves to the covered position. FIG. 10 is a diagram illustrating the toner cartridge according to the first example, where the outer shutter and the inner shutter move to the uncovered positions.

Figure 11:
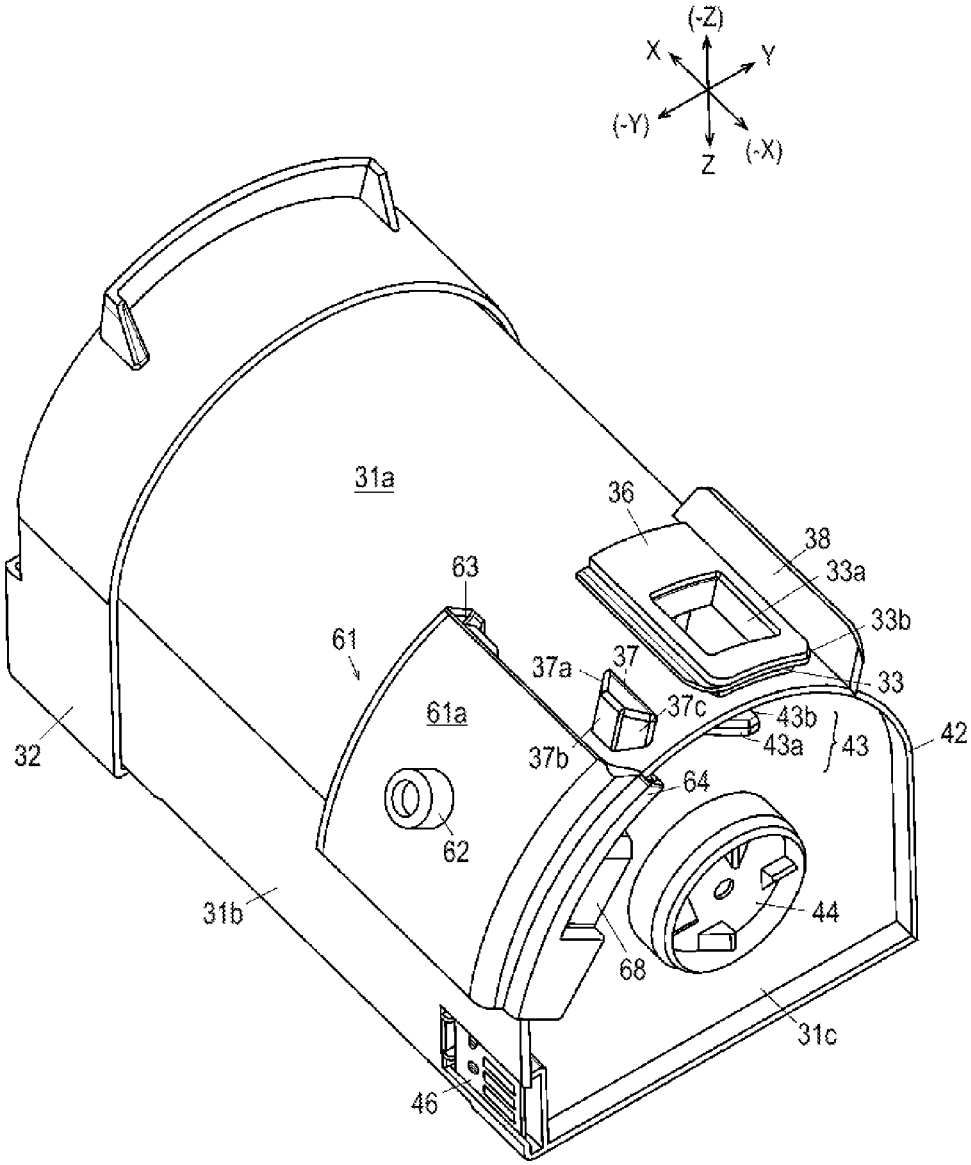
FIG. 11 is a diagram illustrating the toner cartridge according to the first example, where the inner shutter is removed from the state shown in FIG. 10.

FIG. 11 is a diagram illustrating the toner cartridge according to the first example, where the inner shutter is removed from the state shown in FIG. 10.

Figure 12A:
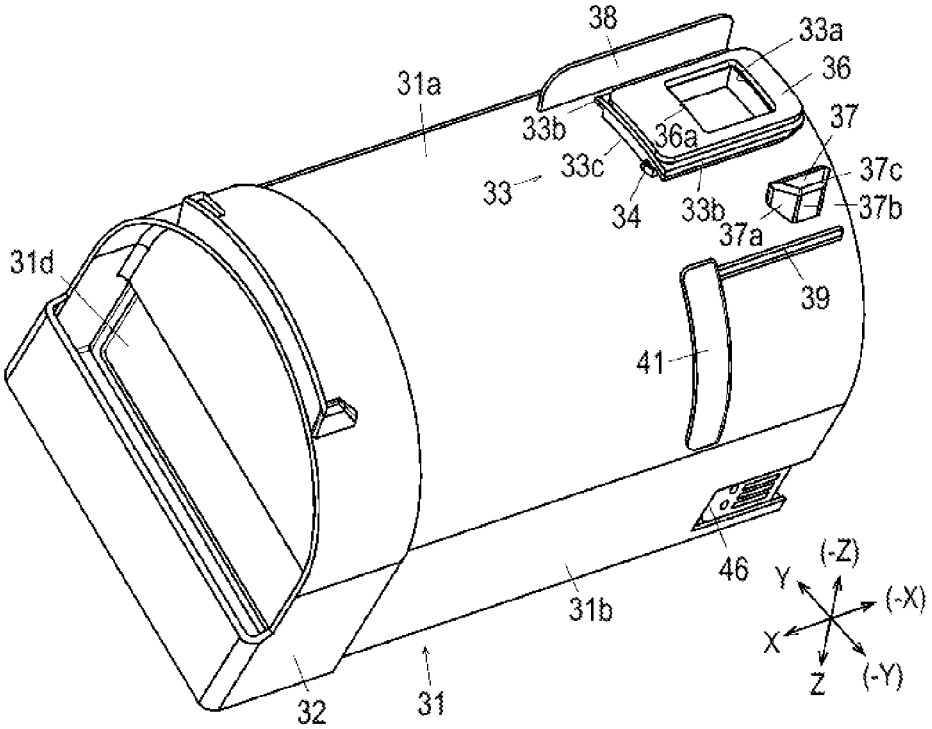
FIGS. 12A and 12B are diagrams illustrating the toner cartridge from which the outer shutter and the inner shutter are removed, where
Figure 12B:
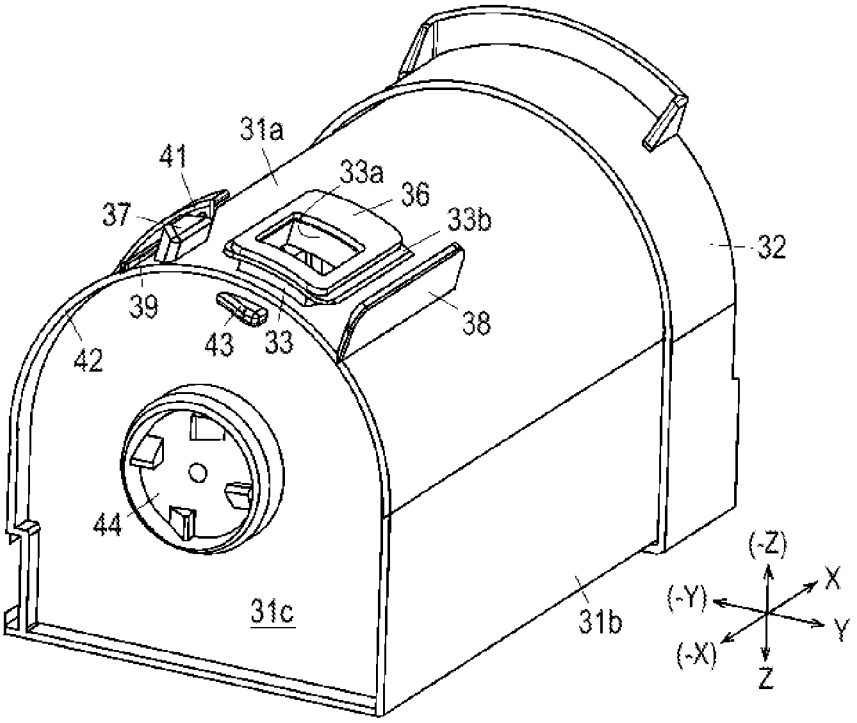

FIGS. 12A and 12B are diagrams illustrating the toner cartridge from which the outer shutter and the inner shutter are removed, where FIG. 12A is a view as obliquely viewed from the front-left downside and FIG. 12B is a view as obliquely viewed from the rear-right downside.

In FIGS. 8 to 12B, the toner cartridge TC according to the first example includes a cylindrical cartridge body 31 as an example of a container body extending in the front-rear direction so as to correspond to the inner surface 2*c* of the holder body 2. Similarly to the holder body 2, the cartridge body 31 includes a semi-cylindrical bottom wall 31*a*, a square-barrel top wall 31*b* formed continuously from the top portion of the bottom wall 31*a*, a plate-like rear wall 31*c* disposed at the rear end, and a plate-like front wall 31*d* disposed at the front end. New developer to be supplied to the developing device G is contained in the inside of the cartridge body 31 surrounded with the walls 31*a* to 31*d*.

A grip 32 as an example of an operating portion to be gripped when an operator moves the toner cartridge TC in the front-rear direction is supported at the front end of the cartridge body 31.

As an example of a second opening and an example of the support of the first covering member, a connection port portion 33 protruding downward is formed at the rear end portion of the bottom wall 31*a* of the cartridge body 31. A connection port 33*a* as an example of a second opening opened to the downside is formed in the rear part of the center in the front-rear direction of the connection port portion 33. As an example of a guide of the first covering member, a pair of left and right inner shutter guides 33*b* swelling in the right-left direction from the top end of the connection port portion 33 and extending in the front-rear direction is formed on both the left and right sides of the connection port portion 33.

Figure 13A:
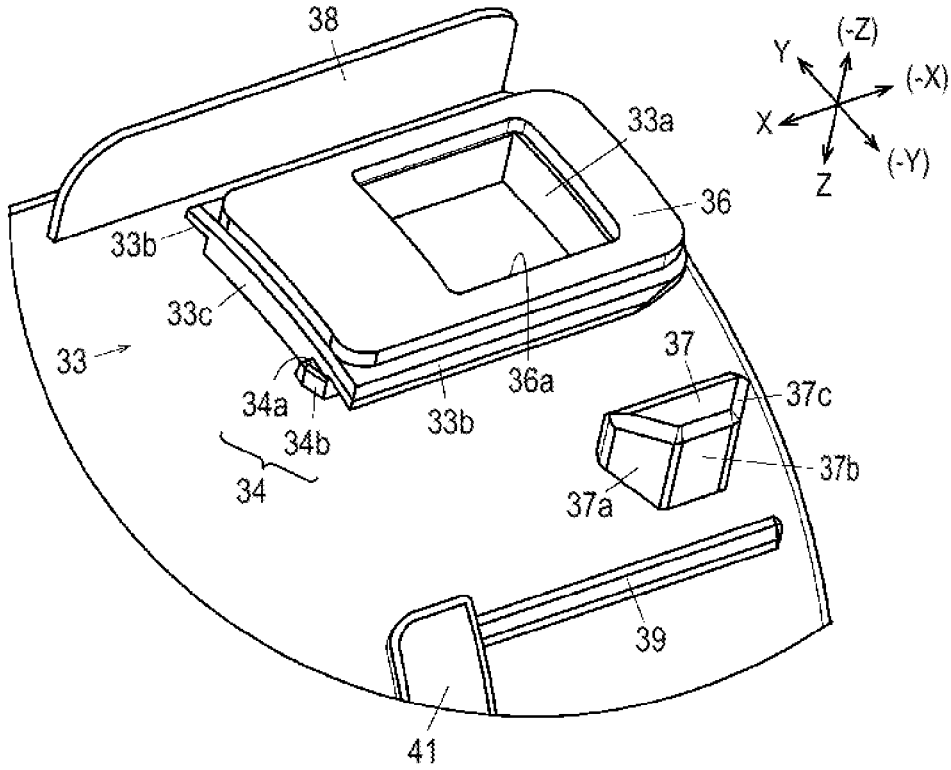
FIGS. 13A and 13B are diagrams illustrating a connection port of the toner cartridge, where
Figure 13B:
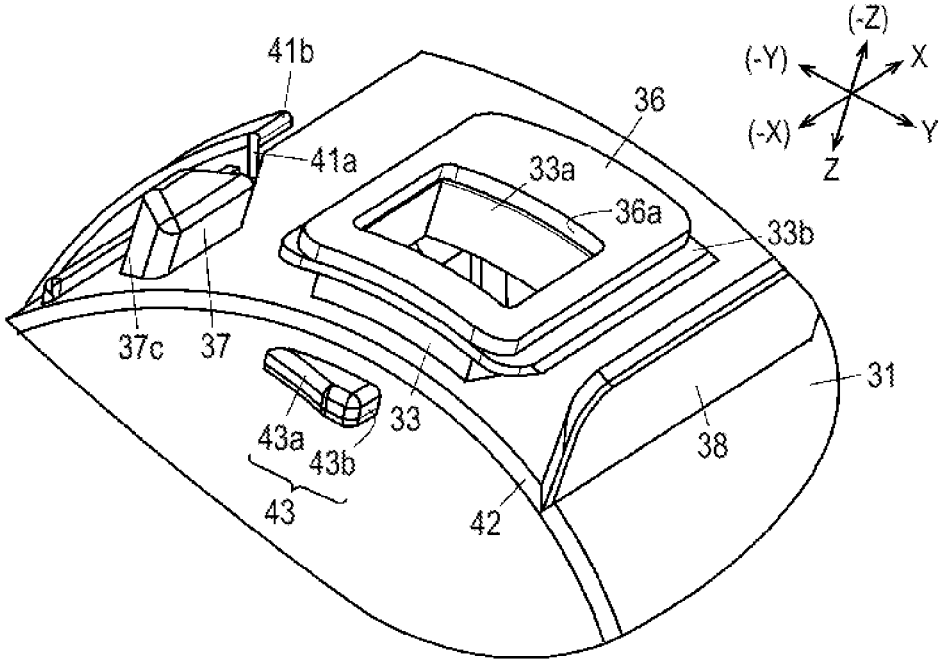

FIGS. 13A and 13B are diagrams illustrating a connection port of the toner cartridge, where FIG. 13A is a view as obliquely viewed from the front-left downside and FIG. 13B is a view as obliquely viewed from the rear-right downside.

In FIGS. 12A and 13A, an outer locking hook 34 as an example of the opening restricting portion protruding forward is formed at the left end of the front end surface 33*c* of the connection port portion 33. The outer locking hook 34 in the first example has a right triangular shape and includes a right end surface 34*a* as an example of a restricting portion body extending forward from the front end surface 33*c* of the connection port portion 33 and an outer lock guide surface

34*b* as an example of a restriction guiding portion inclined rearward as it goes to the left from the front end of the right end surface 34*a*.

A connection port seal 36 as an example of a leak preventing member is supported on the bottom surface which is the outer surface of the connection port portion 33. An opening 36*a* is formed at the center of the connection port seal 36 to correspond to the connection port 33*a*.

In FIGS. 12A and 12B and FIGS. 13A and 13B, an unlocking protrusion 37 as an example of a separation contact portion disposed at a position corresponding to the slider protrusion 18 of the inner shutter lock 14 and protruding downward is formed on the left side of the connection port portion 33. The unlocking protrusion 37 includes a front guide surface 37*a* as an example of a first separation guiding portion inclined to the left as it goes backward from the front end, an intermediate guide surface 37*b* as an example of a second separation guiding portion extending rearward from the rear end of the front guide surface 37*a*, and a rear guide surface 37*c* as an example of a third separation guiding portion inclined to the right as it goes backward from the rear end of the intermediate guide surface 37*b*.

An outer-shutter right stopper 38 as an example of a stopper of the second covering member extending in the front-rear direction is formed on the right side of the connection port portion 33.

As an example of a protrusion, a rib 39 extending in the front-rear direction so as to prevent the exposure of the inner shutter 51 to be described is formed on the left side of the unlocking protrusion 37.

As an example of a guide of a receiver, an outer-shutter front guide 41 extending in the peripheral direction of the outer peripheral surface of the semi-cylindrical shape of the cartridge body 31 is formed on the left and front side of the unlocking protrusion 37. The outer-shutter front guide 41 includes an upright wall 41*a* extending in the diameter direction of the outer peripheral surface of the cartridge body 31 and an arc-like arc plate portion 41*b* extending forward from the outer end of the upright wall 41*a*.

Figure 14B:
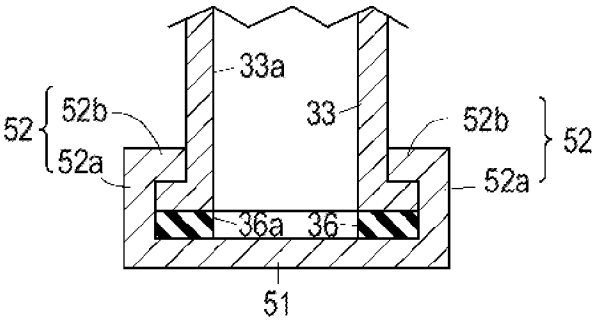
FIGS. 14A to 14C are partial sectional views of the connection port portion according to the first example, where
Figure 14A:
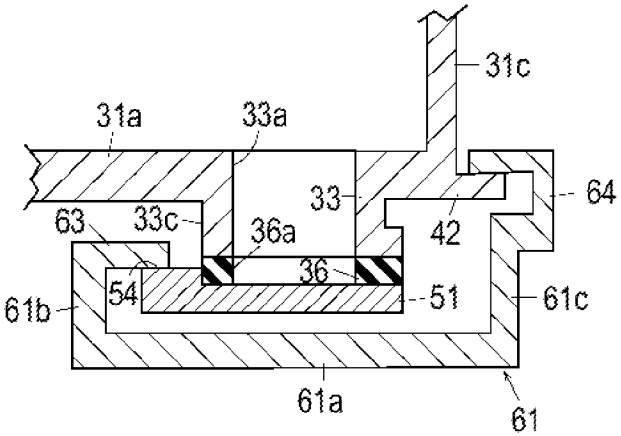
Figure 14C:
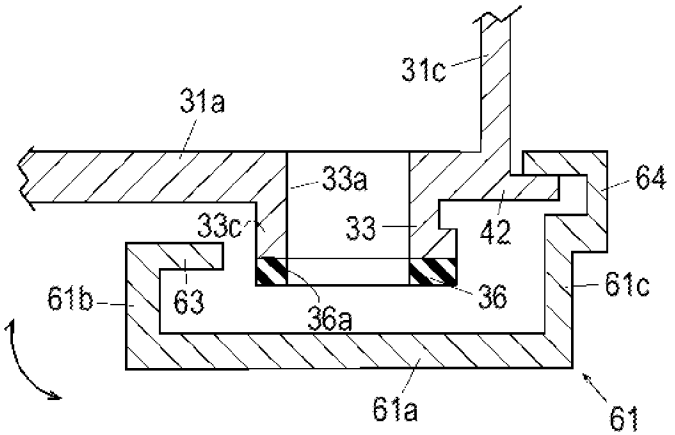

FIGS. 14A to 14C are partial sectional views of the connection port portion according to the first example, where FIG. 14A is a sectional view taken along line XIVA-XIVA of FIG. 8, FIG. 14B is a sectional view taken along line XIVB-XIVB of FIG. 9, and FIG. 14C is a diagram illustrating a state where the inner shutter is removed from the state shown in FIG. 14A.

In FIGS. 8 to 11 and FIGS. 12B, 13B, 14A, and 14C, an outer-shutter rear guide 42 as an example of the guide of the receiver protruding rearward is formed at the rear end of the cartridge body 31. The outer-shutter rear guide 42 in the first example is formed in the bottom wall 31*a* of the cartridge body 31 and the rear end portion of the top wall 31*b* and forms a step difference between the rear ends of the bottom wall 31*a* and the top wall 31*b* and the rear wall 31*c*.

In FIGS. 12B and 13B, a spring contact protrusion 43 as an example of an urged member protruding rearward is formed in the lower end portion of the rear wall 31*c*. The spring contact protrusion 43 in the first example has a right triangular shape and includes a spring guide portion 43*a* as an example of a guide inclined rearward as it goes from the left to the right and a right end portion 43*b* extending forward from the right end of the spring guide portion.

A coupling 44 as an example of a driving power transmission member is rotatably supported at the center of the rear wall 31*c*, and engages with a coupling (not shown) as an example of a driving power transmission member disposed at the rear end of the cartridge holder KH to transmit the driving power when the toner cartridge TC is mounted on the printer body U1. A known carriage member (not shown) of which the rear end is supported by the coupling 44 and that carries the developer in the cartridge body 31 to the connection port 33*a* when the driving power is transmitted is disposed inside the cartridge body 31.

In FIGS. 8 to 12B, a CRUM 46 as an example of a recording medium disposed at the position corresponding to the CRUM reader 4 is supported at the rear-left end of the top wall 31*b*. The CRUM 46 stores information regarding whether the toner cartridge TC is lacking developer and information can be read therefrom or written thereto by the CRUM reader 4 coming in contact therewith and being electrically connected thereto at the time of mounting the toner cartridge TC.

Inner Shutter

Figures 15A, 15B, 15C, 15D, 15E, 15F, 15G:
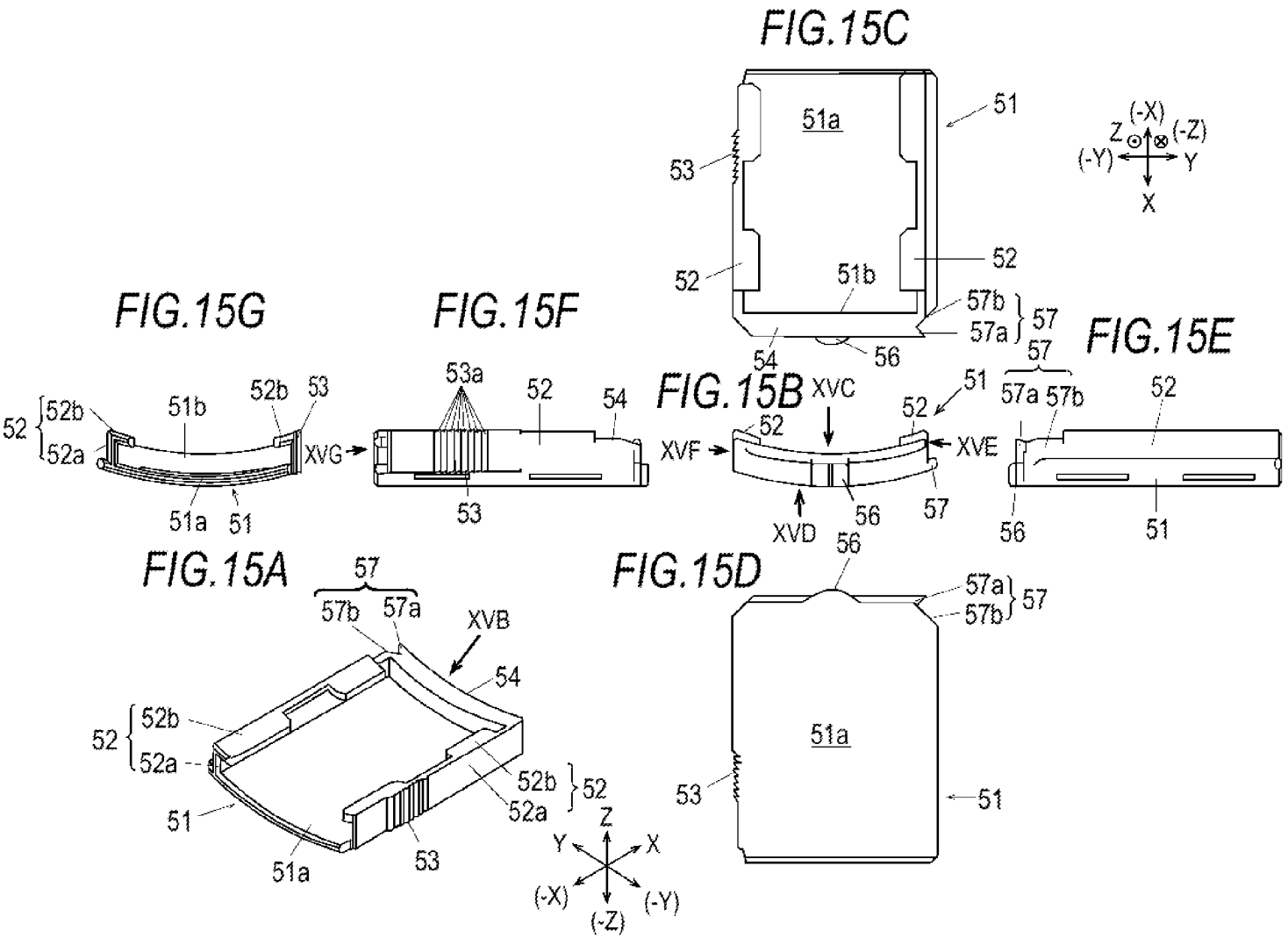
FIGS. 15A to 15G are diagrams illustrating the inner shutter according to the first example, where

FIGS. 15A to 15G are diagrams illustrating the inner shutter according to the first example, where FIG. 15A is a perspective view, FIG. 15B is a view as viewed in the direction of arrow XVB of FIG. 15A, FIG. 15C is a view as viewed in the direction of arrow XVC of FIG. 15B, FIG. 15D is a view as viewed in the direction of arrow XVD of FIG. 15B, FIG. 15E is a view as viewed in the direction of arrow XVE of FIG. 15B, FIG. 15F is a view as viewed in the direction of arrow XVF of FIG. 15B, and FIG. 15G is a view as viewed in the direction of arrow XVG of FIG. 15F.

In FIGS. 9 and 10, FIGS. 14A to 14C, and FIGS. 15A to 15G, the inner shutter 51 as an example of the first covering member is supported by the connection port portion 33. The inner shutter 51 according to the first example includes an inner shutter body 51*a* as an example of a covering member body having a plate shape facing the outer surface of the connection port portion 33 and coming in close contact with the connection port portion 33 by elastically deforming the connection port seal 36. A front wall 51*b* extending upward is formed at the front end of the inner shutter body 51*a*.

As an example of a guiding portion of the first covering member, an inner guide rail 52 extending in the front-rear direction and being supported by the inner shutter guide 33*b* so as to be movable in the front-rear direction is formed on both the left and right sides of the inner shutter body 51*a*. As an example of the side portion of the first covering member, the inner guide rail 52 according to the first example includes inner-shutter side walls 52*a* extending upward from both the left and right sides of the inner shutter body 51*a* and being disposed outside the inner shutter guide 33*b* and guiding portions 52*b* extending inwardly in the right-left direction from the top ends of the inner-shutter side walls 52*a* and coming in contact with the top surface of the inner-shutter guide 33*b* for guide.

Accordingly, in the inner shutter 51 according to the first example, the inner guide rail 52 is guided by the inner-shutter guide 33*b* and is supported so as to be movable relative to the connection port portion 33 between an inner-shutter closed position as an example of a first covered position shown in FIG. 9 where the connection port 33*a* is covered and an inner-shutter opened position as an example of a first uncovered position shown in FIG. 10 where the connection port 33*a* is uncovered.

An inner-shutter locking portion 53 as an example of an engaging portion engaging with the lock body 17 of the inner shutter lock 14 is formed in the rear part of the left inner shutter side wall 52*a*. In FIG. 7C and FIGS. 15A to 15G, the inner-shutter locking portion 53 in the first example has a gear teeth shape in which a convex portion 53*a* and a concave portion 53*b* are periodically formed so as to engage with the concave portions 17*a* and the convex portions 17*b* of the lock body 17. Accordingly, as shown in FIG. 7C, in the convex portion 53*a* of the inner-shutter locking portion 53 in the first example, the rear surface 53*c* is inclined to the right as it goes rearward and the front surface 53*d* is inclined forward as it goes to the left, so as to correspond to the front surface 17*c* and the rear surface 17*d* of the convex portion 17*b*.

In FIGS. 14A to 14C and FIGS. 15A to 15G, an outer-shutter extension guide 54 as an example of the guide of the second covering member and an example of a disengagement restricting portion protruding upward and being lower in height than the top end of the inner guide rail 52 is formed on the top surface of the front wall 51*b* of the inner shutter body 51*a*. The outer-shutter extension guide 54 in the first example is disposed as the position corresponding to an extension line of the arc-like plate portion 41*b* of the outer-shutter front guide 41 of the cartridge body 31 in the state where the inner shutter 51 moves to the inner-shutter closed position.

A pressed protrusion 56 as an example of a pressed portion protruding forward is formed in the bottom of the front surface of the front wall 51*b*. The pressed protrusion 56 in the first example is disposed at the center in the right-left direction of the inner shutter body 51*a* and has a triangular shape protruding forward.

As an example of an erroneous assembly preventing portion, a catching recess 57 recessed to the left is formed at the right end of the front wall 51*b*. The catching recess 57 in the first example includes a front catching portion 57*a* inclined to the left as it goes rearward from the front end and a rear catching portion 57*b* inclined to the right as it goes rearward from the rear end of the front catching portion 57*a*.

Outer Shutter

Figure 16A:
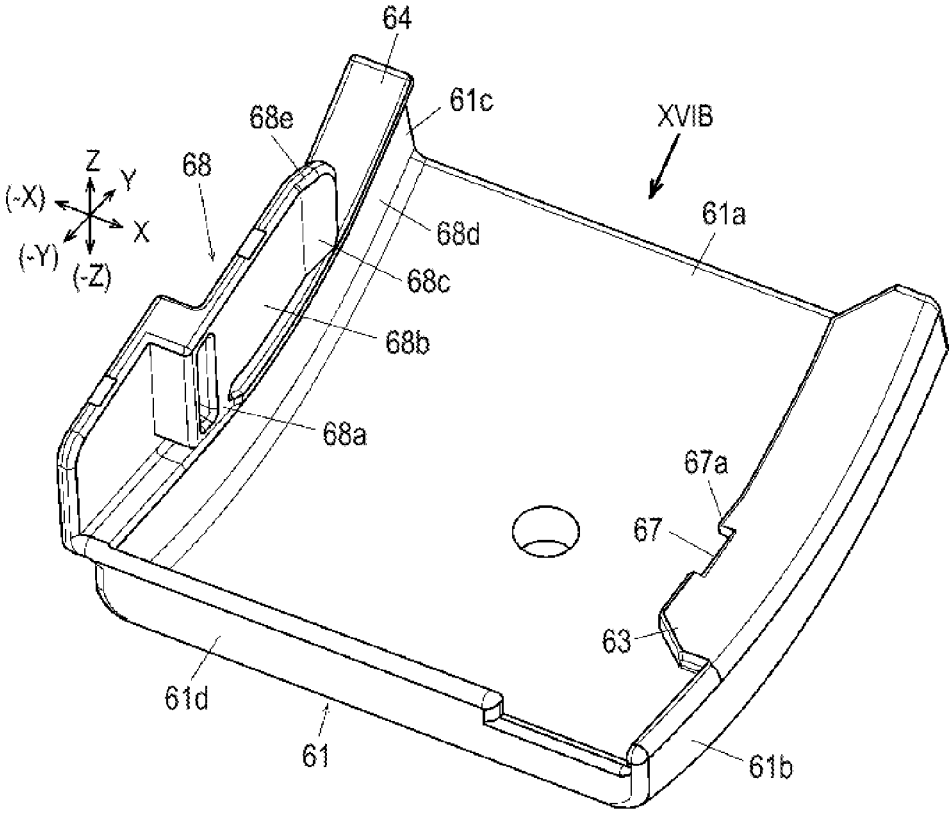
FIGS. 16A and 16B are diagrams illustrating the outer shutter according to the first example, where
Figure 16B:
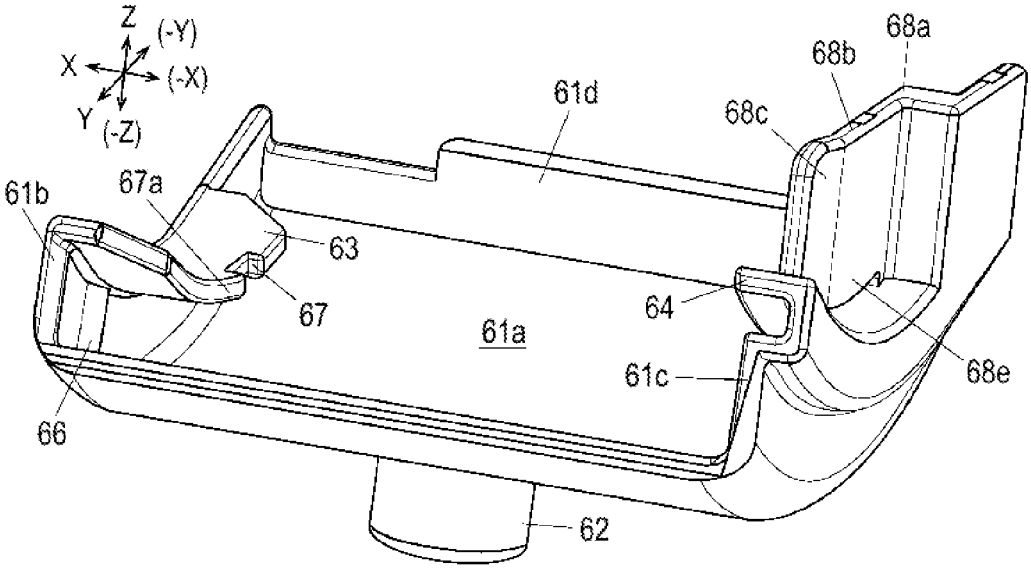

FIGS. 16A and 16B are diagrams illustrating the outer shutter according to the first example, where FIG. 16A is a view as obliquely viewed from the upside and FIG. 16B is a view as viewed in the direction of arrow XVIB of FIG. 16A.

Figures 17A, 17B, 17C, 17D, 17E, 17F, 17G, 17H:
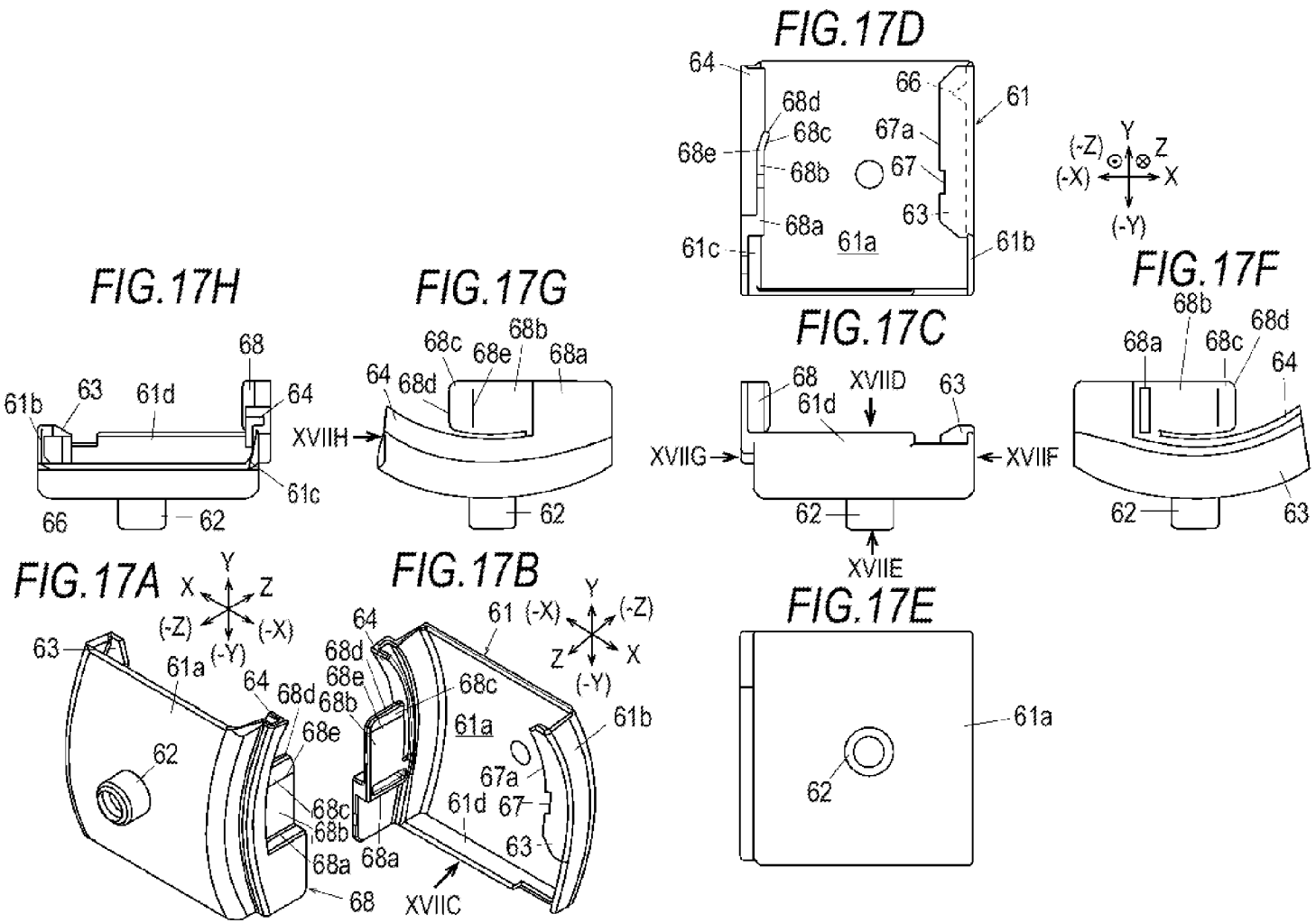
FIGS. 17A to 17H are diagrams illustrating the outer shutter according to the first example, where

FIGS. 17A to 17H are diagrams illustrating the outer shutter according to the first example, where FIG. 17A is a perspective view as obliquely viewed from the rear downside, FIG. 17B is a perspective view as obliquely viewed from the front upside, FIG. 17C is a view as viewed in the direction of arrow XVIIC of FIG. 17B, FIG. 17D is a view as viewed in the direction of arrow XVIID of FIG. 17C, FIG. 17E is a view as viewed in the direction of arrow XVIIE of FIG. 17C, FIG. 17F is a view as viewed in the direction of arrow XVIIF of FIG. 17C, FIG. 17G is a view as viewed in the direction of arrow XVIIG of FIG. 17C, and FIG. 17H is a view as viewed in the direction of arrow XVIIH of FIG. 17G.

In FIGS. 8 to 10, FIGS. 16A and 16B, and FIGS. 17A to 17H, the outer shutter 61 as an example of the second covering member is supported outside the inner shutter 51 of the cartridge body 31. The outer shutter 61 according to the first example includes a partially-cylindrical outer shutter body 61*a* as an example of the second covering member body extending along the bottom wall 51*a* of the cartridge body 31.

As an example of a covering contact portion of the second covering member, an outer covering protrusion 62 protruding outwardly is formed on the outer surface of the outer shutter body 61*a*. The outer covering protrusion 62 is inserted into the covering groove 3 of the holder body 2 and is guided along the covering groove 3. A front wall 61*b* and a rear wall 61*c* extending upward are formed on both ends in the front-rear direction of the outer shutter body 61*a* and a left wall 61*d* extending upward is formed at the left end.

As an example of a guiding portion of the second covering member and an example of a restricting portion for preventing the disengagement, a front guide rail 63 extending rearward and coming in contact with the top surface of the outer-shutter front guide 41 or the outer-shutter extension guide 54 for guidance is formed at the top end of the front wall 61*b*. The front guide rail 63 in the first example is formed from the right end of the front wall 61*b* to the center thereof and the length thereof in the right-left direction is set to be smaller than the distance between the outer-shutter right stopper 38 and the outer-shutter front guide 41 of the cartridge body 31.

As an example of a guiding portion of the second covering member, a rear guide rail 64 having a ⊂ shape as viewed from the right side and coming in contact with the top surface of the outer-shutter rear guide 42 for guidance is formed at the top end of the rear wall 61*c*. An outer guide rail 63+64 of the outer shutter 61 according to the first example is constructed by the front guide rail 63 and the rear guide rail 64. Accordingly, the outer shutter 61 is supported by the outer guide rail 63+64 so as to be movable between an outer-shutter closed position as an example of the second covered position shown in FIG. 8 where the connection port 33*a* is double covered and an outer-shutter opened position as an example of the second uncovered position shown in FIGS. 9 and 10 where the connection port 33*a* is uncovered to expose the inner shutter 51 to the outside.

The outer guide rail 63+64 in the first example is supported by the outer-shutter front guide 41, the outer-shutter rear guide 42, and the outer-shutter extension guide 54 with a margin, that is, clearance or looseness, in the front-rear direction so as to be loosened or inclined in the front-rear direction and not to be detached from the cartridge body 31.

In FIGS. 16B and 17D, a pressing protrusion 66 as an example of a pressing portion disposed to correspond to the pressed protrusion 56 of the inner shutter 51 and protruding inwardly, that is, rearward, is formed at the right end of the inner side wall of the front wall 61*b*. The pressing protrusion 66 in the first example can come in contact with the pressed protrusion 56 on the upstream side of the outer-shutter closed position to press the inner shutter 51 to the inner-shutter closed position when the outer shutter 61 moves to the outer-shutter closed position, and passes over the pressed protrusion 56 to the right so as to be located at a position apart from the pressed protrusion 56 in the state where the outer shutter moves to the outer-shutter closed position.

In FIGS. 16A and 16B and FIGS. 17B and 17D, an outer locking recess 67 as an example of an opening restricting portion disposed to correspond to the outer locking hook 34 and recessed forward is formed at the rear end of the left side of the front guide rail 63. The outer locking recess 67 in the first example has such a size that the outer locking hook 34 can be received therein in the state where the outer shutter 61 moves to the outer-shutter closed position, and the right end surface 34*a* of the outer locking hook 34 is caught so that the outer shutter 61 cannot move from the outer-shutter closed position, that is, enters a locked state. A swelling portion 67*a* swelling rearward from the rear end of the front guide rail 63 is formed on the right side of the outer locking recess 67 in the first example, that is, on the downstream side in the closing direction of the outer shutter 61.

In FIGS. 16A and 16B and FIGS. 17A to 17H, a leaf spring portion 68 as an example of an urging member is formed at the position corresponding to the spring contact protrusion 43 of the cartridge body 31 at the center in the right-left direction of the rear wall 61*c*. The leaf spring portion 68 in the first example includes a base end portion 68*a* at the left end, a leaf-like leaf spring body 68*b* extending to the right from the base end portion 68*a*, and an inclined portion 68*c* inclined forward from the right end of the leaf spring body 68*b*.

An upstream contact portion 68*d* as an example of a first urging portion disposed at the position contacting the spring contact protrusion 43 when the outer shutter 61 is located upstream in the closing direction from the outer-shutter closed position is formed at the end of the inclined portion 68*c* in the first example. A closed contact portion 68*e* as an example of a second urging portion disposed at the position contacting the spring contact protrusion 43 when the outer shutter 61 is located at the outer-shutter closed position is formed at the joint of the inclined portion 68*c* and the leaf spring body 68*b*.

FIG. 18 is a diagram illustrating the positional relation of the outer covering protrusion, the leaf spring portion, and the outer locking recess of the outer shutter according to the first example. In the outer shutter 61 according to the first example shown in FIG. 18, the outer covering protrusion 62 comes in contact with the spiral groove portion 3*b* and thus an opening force 69 acts as a reaction force from the spiral groove portion 3*b* on the outer covering protrusion 62, when the toner cartridge TC is inserted into the cartridge holder KH. By means of this opening force 69, the outer shutter 61 slides to the right in FIG. 18 up to the position where the outer locking hook 34 is caught by the outer locking recess 67 and is not movable. Here, the outer shutter 61 according to the first example can be inclined due to the looseness of the outer guide rail 63+64 and a force for rotating in a clockwise direction in FIG. 23A about the contact portion between the outer locking recess 67 and the outer locking hook 34 acts when the opening force 69 acts. The outer locking recess 67 according to the first example is located downstream in the inclination direction, that is, downstream in the clockwise direction in FIG. 18, about a virtual line 69*a* extending in the direction of the opening force 69. The contact portion of the leaf spring portion 68 and the spring contact protrusion 43 in the first example is located upstream in the clockwise direction in FIG. 18 about the virtual line 69*b* connecting the contact position of the outer locking recess 67 with the outer locking hook 34 and the operating point of the opening force 69 on the outer covering protrusion 62 so as not to interfere with the inclination of the outer shutter 61.

Operation of First Example

In the printer U according to the first example having the above-mentioned configuration, a latent image formed on the surface of the photosensitive member PR is developed in the developing area Q3 by the developing device G and the developer in the developing device G is consumed. When the developer in the developing device G is consumed, the supply auger V4 or the carriage member in the toner cartridge TC operates depending on the amount of consumed developer and the developer is supplied from the toner cartridge TC.

When the developer is supplied from the toner cartridge TC and thus the developer in the toner cartridge TC is used up or the toner cartridge TC is out of order, the toner cartridge TC is inserted and pulled out in the front-rear direction with respect to the printer body U1 and is replaced.

Mounting Operation of Cartridge

FIGS. 19A and 19B are diagrams illustrating an operation of mounting the toner cartridge according to the first example, where FIG. 19A is a diagram illustrating a state before the toner cartridge is mounted on the cartridge holder and FIG. 19B is a diagram illustrating a state where the toner cartridge is inserted rearward from the state shown in FIG. 19A and the outer covering protrusion reaches the front end of a spiral groove.

In FIGS. 19A and 19B, when the toner cartridge TC is inserted from the front side at the time of mounting the toner cartridge TC on the cartridge holder KH, the outer covering protrusion 62 of the outer shutter is inserted into the covering groove 3 and the outer covering protrusion 62 moves rearward along the front groove portion 3*a* of the covering groove 3 with the backward movement of the toner cartridge TC. Then, as shown in FIG. 19B, when the toner cartridge TC moves rearward, the outer covering protrusion 62 comes in contact with the spiral groove portion 3*b* from the front groove portion 3*a*.

FIGS. 20A and 20B are diagrams illustrating a subsequent operation of mounting the toner cartridge, where FIG. 20A is a diagram illustrating a state where the toner cartridge is further inserted rearward from the state shown in FIG. 19B and the outer shutter is opened halfway and FIG. 20B is a diagram illustrating a state where the toner cartridge is further inserted rearward from the state shown in FIG. 20A and the unlocking protrusion comes in contact with the front end of the slider protrusion.

When the toner cartridge TC is further inserted rearward from the state shown in FIG. 19B, the outer covering protrusion 62 is guided to the left along the spiral groove portion 3*b* and the outer shutter 61 moves to the left along the outer peripheral surface of the cartridge body 31, as shown in FIG. 20A, with the movement of the outer covering protrusion 62 to the left. That is, the outer shutter 61 moves to the outer-shutter opened position from the outer-shutter closed position.

When the toner cartridge TC is further inserted rearward from the state shown in FIG. 20A, the rear end of the inner shutter 51 exposed downward comes in contact with the slope 11 and is guided to the inner shutter receiver 8 along the slope. At this time, the slope 11 in the first example does not extend in the right-left direction along the rear end surface of the inner shutter 51 but is inclined about the right-left direction. The rear end of the inner shutter 51 does not come in surface-contact with the slope but the rear end comes in sequential contact from the right end to the left end with the insertion of the toner cartridge TC. Accordingly, the impact at the time of bringing the inner shutter 51 into contact with the slope 11 is reduced and the force for inserting the toner cartridge TC is suppressed from rapidly increasing.

In the first example, the slope 11 corresponds to the inclination of the spiral groove portion 3*b*, the reaction force acting on the outer shutter 61 from the holder body 2 at the time of opening the outer shutter 61 and the reaction force acting at the time of bringing the inner shutter 51 into contact with the slope 11 are both directed to the front-left side, and the force directed to the left acts on the toner cartridge TC. Accordingly, when the toner cartridge TC is mounted, the CRUM 46 is reliably brought into contact with the CRUM reader 4 disposed on the left side.

The slope 11 in the first example has the overlapping area 11*a* in which a part of the front side in the front-rear direction overlaps with a part of the rear side of the spiral groove portion 3*b* in the front-rear direction. That is, compared with the case where the overlapping area 11*a* is not provided, the length in the front-rear direction of the cartridge holder KH and the toner cartridge TC can be reduced in the toner cartridge TC having two shutters 51 and 61.

When the toner cartridge TC is further inserted rearward from the state shown in FIG. 20A and the inner shutter 51 disengages in the right-left direction from the inner shutter receiver 8 due to the clearance from the connection port portion 33 or the like or the posture is inclined, the right side surface of the inner shutter 51 comes in contact with the clearance plugging wall 9 to correct the posture. Accordingly, compared with the case where the clearance plugging wall 9 is not provided, the mounting failure that the engagement between the inner shutter 51 and the inner shutter lock 14 is not satisfactory or the like is prevented from occurring.

In FIGS. 20A and 20B, when the toner cartridge TC is further inserted rearward from the state shown in FIG. 20A, the outer covering protrusion 62 reaches the rear groove portion 3*c* and the outer shutter 61 moves to the uncovered position as shown in FIG. 20B. At this time, the inner shutter 51 moves rearward in the inner shutter receiver 8 while coming in contact with the guide rib 8*a*. That is, compared with the configuration in which the guide rib 8*a* is not provided, the friction is reduced and thus the toner cartridge TC is inserted in the state where the increase in the force for inserting the toner cartridge TC is reduced. Before the connection port portion 33 comes in contact with the inner shutter stopper surface 6*b* of the supply port portion 6, the rear guide surface 37*c* of the unlocking protrusion 37 comes in contact with the front guide surface 18*a* of the slider protrusion 18 of the inner shutter lock 14.

FIGS. 21A to 21D are diagrams illustrating a subsequent operation of mounting the toner cartridge, where FIG. 21A is a diagram illustrating a state where the toner cartridge is further inserted rearward from the state shown in FIG. 20B and the unlocking protrusion presses the slider protrusion to the left, FIG. 21B is a partially-enlarged view of the inner shutter lock shown in FIG. 21A, FIG. 21C is a diagram illustrating a state where the toner cartridge is further inserted rearward from the state shown in FIG. 21A and the inner shutter lock is located between the locked position and the unlocked position, and FIG. 21D is a partially-enlarged view of the inner shutter lock shown in FIG. 21C.

When the toner cartridge TC is further inserted rearward from the state shown in FIG. 20B, the unlocking protrusion 37 moves rearward and the inner shutter lock 14 moves to the left against the elastic force of the coil spring 22 with the contact with the rear guide surface 37*c* and the front guide surface 18*a*. Accordingly, the intermediate guide surface 18*b* and the intermediate guided surface 37*b* come in contact with each other as shown in FIGS. 21A and 21B, the inner shutter lock 14 moves to the unlocked position, and the lock body 17 retreats from the inner shutter receiver 8.

When the toner cartridge TC is further inserted rearward from the state shown in FIGS. 21A and 21B, the rear end of the connection port portion 33 of the toner cartridge TC comes in contact with the inner shutter stopper surface 6*b* and the inner shutter 51 is received in the inner shutter receiver 8, as shown in FIG. 21D. In this state, the front guide surface 37*a* of the unlocking protrusion 37 comes in contact with the rear guide surface 18*c* of the slider protrusion 18 and the lock body 17 is moving to the locked position from the unlocked position.

FIGS. 22A to 22D are diagrams illustrating a subsequent operation of mounting the toner cartridge, where FIG. 22A is a diagram illustrating a state where the toner cartridge is further inserted rearward from the state shown in FIG. 21C and the unlocking protrusion moves rearward of the slider protrusion, FIG. 22B is a partially-enlarged view of the inner shutter lock shown in FIG. 22A, FIG. 22C is a diagram illustrating a state where the toner cartridge is further inserted rearward from the state shown in FIG. 22A and the mounting is finished, and FIG. 22D is a partially-enlarged view of the inner shutter lock shown in FIG. 22C.

When the toner cartridge TC is further inserted rearward from the state shown in FIGS. 21C and 21D, the unlocking protrusion 37 moves rearward of the rear guide surface 18*c* of the slider protrusion 18 as shown in FIGS. 22A and 22B, and the inner shutter lock 14 moves to the locked position. When the inner shutter lock 14 moves to the locked position, the lock body 17 engages with the inner-shutter locking portion 53 and the inner shutter 14 is not movable, that is, is locked, in the front-rear direction.

Here, in the lock body 17 and the inner-shutter locking portion 53 in the first example, as shown in FIG. 7C, the rear surface 17*d* of the convex portion 17*b* is inclined forward as it goes to the left and the front surface 53*d* of the convex portion 53*a* is inclined forward as it goes to the left side. Accordingly, even when the lock body 17 does not retreat to the unlocked position before the inner-shutter locking portion 53 reaches the position of the lock body 17 or the lock body 17 is returned to the locked position before the rear end of the inner shutter 51 reaches the inner shutter stopper surface 6*b* due to a manufacturing error or an assembling error of the unlocking protrusion 37 or the slider protrusion 18, a force directed to the front-left side acts and a force directed to the left thus acts at the time of causing the front surface 53*d* of the convex portion 53*a* to press the rear surface 17*d* of the convex portion 17*b* with the insertion of the toner cartridge TC. Accordingly, the inner shutter lock 14 can move to the left unlocked position and the convex portions 53*a* of the inner shutter 51 can move forward over the convex portions 17*b* of the inner shutter lock 14.

When the toner cartridge is further made to move rearward from the state shown in FIGS. 22A and 22B, the inner shutter 51 comes in contact with the inner shutter stopper surface 6*b*, the inner shutter lock 14 is locked, the movement of the inner shutter 51 is stopped, and the connection port portion 33 moves rearward while being guided by the holder guide 7 of the supply port portion 6. That is, the inner shutter 51 moves relative to the connection port 33*a* and moves to the inner-shutter opened position from the inner-shutter closed position.

When the toner cartridge TC moves to the rear end of the cartridge holder KH, as shown in FIG. 22C, the inner shutter moves to the inner-shutter opened position and the connection port 33*a* is connected to the supply port 6*a*, whereby the mounting of the toner cartridge TC is finished. Accordingly, the developer can be supplied from the toner cartridge TC to the printer body U1.

Therefore, in the toner cartridge TC according to the first example, both the outer shutter 61 and the inner shutter 51 are opened and the connection port 33*a* is connected to the supply port 6*a* by only one operation of inserting the toner cartridge from the front side to the rear side. As a result, compared with the configuration in which two operations of inserting and rotating the toner cartridge to open the shutter need to be performed, it is possible to facilitate the insertion work.

In the toner cartridge TC according to the first example, the inner shutter 51 guides the outer shutter 61 at the time of opening and closing the outer shutter 61. When the inner shutter 51 does not guide the outer shutter 61, the opening and closing movement of the outer shutter 61 may not be stabilized. When a member guiding the outer shutter 61 is provided in the cartridge body 31 instead of the inner shutter 51, it may interfere with the opening and closing operation of the inner shutter 51 and the configuration employing two shutters 51 and 61 may not be implemented. In addition, there is also a problem in that the configuration is complicated due to the installation of a new guide. On the contrary, in the first example, the inner shutter 51 guides the outer shutter 61 by the use of the extension guide 54 and thus the movement of the outer shutter 61 is stabilized. In addition, the inner shutter 51 and the extension guide 54 are unified to simplify the configuration and no member interferes with the opening and closing movement of the inner shutter 51.

Detachment of Cartridge

When the toner cartridge TC is detached due to the consumption of the developer in the toner cartridge TC or the like, the toner cartridge TC is drawn forward from the state shown in FIG. 22C. At this time, the inner shutter lock 14 locks the inner shutter 51 to restrict the rearward movement of the inner shutter 51. Accordingly, in the configuration in which a portion is tucked in the downstream end in the drawing direction of the shutter as described in JP-A-2005-134452, a gap along the shutter moving direction cannot help being formed between the tucked portion and the shutter due to the manufacturing error or the like. Therefore, the shutter may disengage downstream to form a gap between the supply port portion and the shutter at the time of drawing out the toner cartridge, thereby causing the leakage of the developer.

On the contrary, in the first example, the movement of the inner shutter 51 from one side in the front-rear direction which is the mounting and demounting direction of the toner cartridge TC is restricted, thereby not forming a gap in the front-rear direction of the inner shutter 51. Accordingly, at the time of drawing out the toner cartridge TC, the inner shutter 51 is not easily separated from the inner shutter stopper surface 6*b* and a gap is not easily formed between the inner shutter 51 and the inner shutter stopper surface 6*b*. Therefore, when the connection port portion 33 passes over the part between the inner shutter 51 and the inner shutter stopper surface 6*b*, the developer is suppressed from leaking downward from the connection port 33*a* and gathering in the gap. As a result, the dirtying of the inner shutter 51 with the leaking developer is suppressed, the dirtying of the cartridge holder KH or the toner cartridge TC is suppressed, and the dirtying of an operator or a floor in which the printer U is installed with the drawing-out of the dirtied toner cartridge TC is suppressed.

Particularly, in the lock body 17 and the inner-shutter locking portion 53 in the first example, the front surface 17*d* of the convex portion 17*b* is inclined forward as it goes to the right and the rear surface 53*c* of the convex portion 53*a* is inclined rearward as it goes to the left, as shown in FIG. 7C. Accordingly, when the rear surface 53*c* of the convex portion 53*a* presses the front surface 17*c* of the convex portion 17*b* of the lock body 17 with the forward drawing-out of the toner cartridge TC, the force directed to the rear-right side acts and thus the force directed to the right acts. Therefore, the inner shutter lock 14 receives the force directed to the right from the locked position and the force directed to the unlocked position does not act on the inner shutter lock 14. As a result, even when a force for moving the inner shutter 51 forward acts due to the friction at the time of drawing out the toner cartridge TC forward, the force in the engaging direction is applied to the inner shutter lock 14 and the inner-shutter locking portion 53, the inner shutter 51 is not unlocked, and thus the rearward movement is restricted.

In the first example, the lock side wall 12 is disposed on both the front and rear sides of the lock body 17. Accordingly, even when a force directed to the rear side acts on the lock body 17, the lock side wall 12 comes in contact with the lock body 17 and the inclination or falling of the lock body 17 is restricted. Therefore, compared with the case where the lock side wall 12 is not provided, the rearward movement of the inner shutter 51 is more reliably restricted.

In FIGS. 22A to 22D, when the toner cartridge TC is drawn out from the state shown in FIG. 22C to the state shown in FIG. 22A, the inner shutter 51 moves relative to the connection port 33*a* and the connection port 33*a* is covered with the inner shutter 51. In this state, the front guide surface 37*a* of the unlocking protrusion 37 moves to the rear side of the rear guide surface 18*c* of the slider protrusion 18 and the inner shutter lock 14 is kept at the locked position.

When the toner cartridge TC is drawn out from the state shown in FIG. 22A to the state shown in FIG. 21C, the unlocking protrusion 37 comes in contact with the slider protrusion 18 of the inner shutter lock 14 and thus the inner shutter lock 14 starts its movement to the unlocked position. Accordingly, the inner shutter lock 14 is separated from the inner shutter 51 and the inner shutter 51 is unlocked. Therefore, the inner shutter 51 can move forward and the inner shutter 51 starts its forward movement in an integrated manner, as shown in FIGS. 21A and 20B, when the toner cartridge TC is drawn out forward.

When the toner cartridge TC is drawn out from the state shown in FIG. 20B, the outer covering protrusion 62 having been guided by the rear groove portion 3*c* reaches the spiral groove portion 3*b* as shown in FIG. 20A, and the outer shutter 61 starts its movement to the right, that is, to the outer-shutter closed position, along the cartridge body 31.

When the toner cartridge TC is further drawn out from the state shown in FIG. 20A, the outer covering protrusion 62 moves along the spiral groove portion 3*b* and the outer shutter 61 moves to the outer-shutter closed position to cover the outside of the inner shutter 51 as shown in FIG. 19B. At this time, in the cartridge holder KH according to the first example, the swelling portion 3*h* swelling to the right is disposed at the front end of the spiral groove portion 3*b* and the outer covering protrusion 62 is pushed to the right, that is, to the outer-shutter closed position. Accordingly, compared with the case where the swelling portion 3*h* is not provided, the outer shutter 61 can easily move to the outer-shutter closed position and the outer shutter is suppressed from being in a state where the outer shutter does not move to the outer-shutter closed position completely, that is, a so-called semi-opened state.

When the toner cartridge TC is further drawn out from the state shown in FIG. 19B, the toner cartridge TC is taken out of the printer body U1 and is in the state shown in FIG. 19A. Accordingly, in the toner cartridge TC according to the first example, both the inner shutter 51 and the outer shutter 61 are sequentially closed and the connection port 33*a* is covered by only one operation of drawing the toner cartridge from the rear side to the front side. Therefore, compared with the configuration in which two operations are necessary, it is possible to facilitate the drawing work.

In the toner cartridge TC according to the first example, the opening and closing direction of the inner shutter 51 intersects the opening and closing direction of the outer shutter 61. If the opening and closing directions of two shutters are parallel to each other, there is a problem in that the outer shutter needs to move to the outside of the range in which the inner shutter moves for opening and closing, the moving distance of the outer shutter increases, and the size of the toner cartridge TC increases. However, according to the first example, two shutters 51 and 61 move in the intersecting directions, thereby reducing the size of the toner cartridge TC.

Movement for Opening Outer Shutter

FIGS. 23A to 23C are diagrams partially illustrating the outer shutter according to the first example, where FIG. 23A is a diagram illustrating a state where the outer shutter moves to the outer-shutter opened position from the state shown in FIG. 18, FIG. 23B is a diagram illustrating a state where the outer shutter is inclined from the state shown in FIG. 23A, and FIG. 23C is a diagram illustrating states before and after the leaf spring portion is inclined.

In the state where the toner cartridge TC according to the first example is detached from the printer body U1, the leaf spring portion 68 is pressed and elastically deformed by the spring contact protrusion 43 and the outer shutter 61 is urged to the rear side, as shown in FIG. 18. Accordingly, the outer locking hook 34 is inserted into the outer locking recess 67 of the outer shutter 61. Therefore, even when an external force directed to the left outer-shutter opened position acts on the outer shutter 61 due to an operator's contact with the outer shutter 61 or the like, as shown in FIG. 23A, the outer locking recess 67 comes in the contact with the right end surface 34*a* of the outer locking hook 34 to restrict the rotation of the outer shutter 61.

When the toner cartridge TC is inserted into the cartridge holder KH and the outer covering protrusion 62 of the outer shutter 61 comes in contact with the spiral groove portion 3*b*, the opening force 69 directed to the front-left side acts on the outer covering protrusion 62 as shown in FIG. 18. When the opening force 69 acts, the forward component of the opening force 69 is opposite to the force by which the leaf spring portion 68 urges the outer shutter 61 to the rear side, the force directed to the left acts on the outer shutter 61, and the outer shutter 61 thus moves to the outer-shutter opened position until the outer locking recess 67 comes in contact with the right end surface 34*a* of the outer locking hook 34 as shown in FIG. 23A. That is, the outer shutter 61 has looseness in the state where it comes in contact with the outer locking hook 34.

When the outer shutter 61 moves up to the state shown in FIG. 23A, the movement of the outer shutter 61 is restricted due to the contact of the outer locking hook 34 with the outer locking recess 67 as described above. Here, in the first example, the contact portion of the outer locking recess 67 and the outer locking hook 34 is disposed downstream in the clockwise direction in FIGS. 18 and 23A from the extension line 69*a* of the opening force 69, and a force acts on the outer shutter 61 so as to rotate about the contact portion of the outer locking recess 67 and the outer locking hook 34 when the opening force 69 acts in the state shown in FIG. 23A. Accordingly, the outer shutter 61 is inclined in the clockwise direction in FIGS. 18 and 23A to 23C in the state where the outer locking recess 67 is in contact with the outer locking hook 34 until the left end of the outer guide rail 64 of the outer shutter 61 comes in contact with the outer-shutter rear guide 42 as shown in FIG. 23B. In the state shown in FIG. 23B, the outer locking recess 67 moves to the front-right side, that is, in a direction in which it is separated from the outer locking hook 34, with the inclination of the outer shutter 61 and the catching effect between the outer locking recess 67 and the outer locking hook 34 is reduced.

In FIG. 23B, when the outer shutter 61 is inclined, the base end portion 68*a* of the leaf spring portion 68 is inclined together and moves forward. Accordingly, as shown in FIG. 23C, the state of the non-inclined leaf spring portion 68 indicated by a solid line is changed to the state of the inclined leaf spring portion 68 indicated by a two-dot chained line. That is, compared with the state where it is not elastically deformed before and after the inclination as indicated by a broken line and a one-dot chained line, the amount of elastic deformation of the inclined leaf spring portion 68 becomes smaller than the amount of elastic deformation of the non-inclined leaf spring portion 68. Therefore, in the state shown in FIG. 23B, the force by which the leaf spring portion 68 urges the outer shutter 61 rearward is weakened, in comparison with the state shown in FIG. 23A.

When the opening force 69 acts on the outer shutter 61 in the state shown in FIG. 23B, the outer shutter 61 of which the movement and the inclination to the left are restricted moves forward with the forward component of the force against the urging force of the leaf spring portion 68. At this time, in the first example, the rearward urging force of the leaf spring portion 68 is weakened as described above and the force necessary for the forward movement of the outer shutter 61 is smaller than that in the case where the urging force is not weakened. Accordingly, the load on the operator or the insertion resistance at the time of inserting the toner cartridge TC is reduced. At this time, in the first example, the catching between the outer locking recess 67 and the outer locking hook 34 is reduced with the inclination of the outer shutter 61 and the catching between the outer locking recess 67 and the outer locking hook 34 is released with a small amount of force at the time of the forward movement of the outer shutter 61, as shown in FIG. 23B. That is, the amount of deformation of the leaf spring portion 68 with the forward movement of the outer shutter 61 is reduced and the load on the operator and the insertion resistance are reduced.

FIGS. 24A and 24B are diagrams partially illustrating the outer shutter according to the first example, where FIG. 24A is a diagram illustrating a state where the outer shutter is unlocked from the state shown in FIG. 23B and FIG. 24B are diagrams illustrating a state where the outer shutter moves to the outer-shutter opened position from the state shown in FIG. 24A.

Referring to FIGS. 23B and 24A, when the outer shutter 61 moves forward with the opening force 69 acting thereon, the outer locking recess 67 and the outer locking hook 34 disengage from each other and the outer shutter 61 is thus unlocked, as shown in FIG. 24A.

Referring to FIGS. 24A and 24B, the outer shutter 61 can move to the left, that is, to the outer-shutter opened position, in the state shown in FIG. 24A and the outer shutter 61 moves to the outer-shutter opened position with the left-directed component of the opening force 69 as shown in FIG. 24B.

Closing Movement of Inner Shutter

In FIGS. 22A and 21C, when the toner cartridge TC is detached from the printer body U1, the inner shutter 51 moves to the inner-shutter closed position where the connection port 33*a* is covered. However, due to the manufacturing error or the assembling error of components, the inner shutter does not move to the inner-shutter closed position completely, and thus the connection port 33*a* may be covered but the inner shutter 51 may not be closed completely.

particularly, when the time at which the inner shutter lock 14 is separated from the inner shutter 51 is set to coincide with the time at which the inner shutter 51 completely moves to the inner-shutter closed position, the time at which the inner shutter lock 14 is separated may be later than the time at which the inner shutter moves to the inner-shutter closed position due to the manufacturing error. In this case, even when the inner shutter 51 moves to the inner-shutter closed position and the inner shutter 51 is intended to move forward at the time of drawing out the toner cartridge TC, the inner shutter is locked and thus the toner cartridge TC may not be drawn out. Accordingly, the inner shutter lock 14 is set to be separated from the inner shutter 51 before the inner shutter 51 completely moves to the inner-shutter closed position, and the toner cartridge TC moves forward in the state where the inner shutter 51 is not closed completely.

FIGS. 25A and 25B are diagrams illustrating a state where the inner shutter according to the first example completely moves to an inner-shutter closed position, where FIG. 25A is a diagram illustrating an intermediate state where the outer shutter is moving to an outer-shutter closed position and FIG. 25B is a diagram illustrating a state where the outer shutter further moves to the outer-shutter closed position from the state shown in FIG. 25A and a pressing protrusion has started its contact with a pressed protrusion.

In FIG. 25A, when the toner cartridge TC is drawn out in the state where the inner shutter 51 is not completely closed, the outer covering protrusion 62 of the outer shutter 61 comes in contact with the spiral groove portion 3*b* and the outer shutter starts its movement to the outer-shutter closed position. In FIG. 25B, when the outer shutter 61 moves to the outer-shutter closed position, the pressing protrusion 66 of the outer shutter 61 comes in contact with the pressed protrusion 56 of the inner shutter 51. At this time, the end 68*a* of the leaf spring portion 68 of the outer shutter 61 starts its contact with the spring contact protrusion 43 and the leaf spring portion 68 starts its elastic deformation.

FIGS. 26A and 26B are diagrams illustrating an operation subsequent to the operation shown in FIGS. 25A and 25B, where FIG. 26A is a diagram illustrating a state where the outer shutter further moves to the outer-shutter closed position from the state shown in FIG. 25B and the pressing protrusion presses the pressed protrusion and FIG. 26B is a diagram illustrating a state where the outer shutter further moves to the outer-shutter closed position from the state shown in FIG. 26A and the pressing protrusion passes through the position of the pressed protrusion.

When the outer shutter 61 further moves to the outer-shutter closed position from the state shown in FIG. 25B, the front end of the pressed protrusion 56 and the rear end of the pressing protrusion 66 come in contact with each other as shown in FIG. 26A and the inner shutter 51 moves to the inner-shutter closed position. Accordingly, the inner shutter 51 completely moves to the inner-shutter closed position with the rotation of the outer shutter 61.

Particularly, according to the first example, in the state where the pressed protrusion 56 and the pressing protrusion 66 are in contact with each other, the leaf spring portion 68 comes in contact with the spring contact protrusion 43 and is elastically deformed and a force directed to the rear side, that is, to the inner-shutter closed position, acts on the outer shutter 61. Accordingly, the inner shutter 51 moves to the inner-shutter closed position with the urging force of the leaf spring portion 68, and the inner shutter 51 can be made to satisfactorily move to the inner-shutter closed position, compared with the configuration in which the urging force of the leaf spring portion 68 does not act.

In the first example, the pressed protrusion 56 is disposed at the center in the right-left direction of the inner shutter 51. When the pressed protrusion 56 is disposed on one side in the right-left direction and the pressed protrusion 56 is pressed, a rotating or inclining force is applied to the inner shutter 51 and the force directed to the inner-shutter closed position is not efficiently transmitted and thus the inner shutter may not move to the inner-shutter closed position completely. On the contrary, in the configuration according to the first example in which the pressed protrusion 56 is disposed at the center in the right-left direction, the force directed to the inner-shutter closed position is efficiently transmitted, there easily causing the inner shutter to move to the inner-shutter closed position.

FIG. 27 is a diagram illustrating an operation subsequent to the operation shown in FIGS. 26A and 26B, where the outer shutter moves to the outer-shutter closed position from the state shown in FIG. 26B.

In FIGS. 26A and 26B, when the outer shutter 61 moves from the state shown in FIG. 26A, the pressing protrusion 66 passes through the pressed protrusion 56 and the contact with the pressed protrusion 56 is released as shown in FIG. 26B. Even when the outer shutter 61 moves rearward with the urging force of the leaf spring portion 68, the contact between the pressed protrusion 56 and the pressing protrusion 66 is still released as shown in FIG. 27 and they are located so as not to interfere with the inclination at the time of the inclination of the outer shutter 61 as shown in FIGS. 23A and 23B.

The toner cartridge TC is shaken at the time of carrying or handling and thus a force directed to the inner-shutter opened position may be applied to the inner shutter 51. However, in the first example, the outer shutter 61 is locked by the use of the outer locking hook 34 in the state where it covers the outside of the inner shutter 51 and thus the opening of the inner shutter 51 is prevented. Particularly, when the inner shutter 51 is about to move to the inner-shutter opened position, the pressed protrusion 56 comes in rapid contact with the front wall 61*b* of the outer shutter 61 and the movement of the inner shutter 51 is restricted before the connection port 33*a* is opened inside the outer shutter 61.

Closing Movement of Outer Shutter

FIGS. 28A to 28C are diagrams illustrating a state where the outer shutter according to the first example completely moves to the outer-shutter closed position, where FIG. 28A is a diagram illustrating an intermediate state where the outer shutter is moving to the outer-shutter closed position, FIG. 28B is a diagram illustrating a state where the outer shutter moves to the outer-shutter closed position from the state shown in FIG. 28A and a front guide rail starts its contact with an outer locking hook, and FIG. 28C is a diagram illustrating a state where the rear end surface of the front guide rail is guided by the outer locking hook and the outer shutter moves to the outer-shutter opened position.

In FIGS. 28A to 28C and FIGS. 29A to 31B, the inner shutter 51 is not shown for the purpose of easily understanding the movement of the outer shutter 61.

In FIGS. 28A to 28C, when the outer shutter 61 according to the first example moves to the outer-shutter closed position, the front guide rail 63 of the outer shutter 61 is guided to the outer-shutter extension guide 54 from the outer-shutter front guide 41 and moves to the right.

In FIG. 28B, when the outer shutter 61 moves to the outer-shutter closed position in the state where it disengages rearward, the right end of the front guide rail 63 is guided by the outer lock guide surface 34*b* of the outer locking hook and moves to the front side, that is, is loosened. Accordingly, when the outer shutter 61 further moves to the outer-shutter closed position from the state shown in FIG. 28B, the rear end surface of the front guide rail 63 is guided by the outer locking hook 34 and moves to the right as shown in FIG. 28C.

FIGS. 29A and 29B are diagrams illustrating an operation subsequent to the operation shown in FIGS. 28A to 28C, where FIG. 29A is a diagram illustrating a state where the leaf spring portion starts its contact with the spring contact protrusion and FIG. 29B is a diagram illustrating a state where the outer shutter further moves to the outer-shutter closed position from the state shown in FIG. 29A just before the outer locking recess and the outer locking hook engage with each other.

When the outer shutter 61 is guided by the outer locking hook 34 and moves to the outer-shutter closed position from the state shown in FIG. 28C, the upstream contact portion 68*d* of the leaf spring portion 68 starts its contact as shown in FIG. 29A and the leaf spring portion 68 starts its flexure. That is, the leaf spring portion 68 starts its elastic deformation and the elastic force for urging the outer shutter 61 to the rear side is generated.

In FIGS. 29A and 29B, when the outer shutter 61 further moves to the outer-shutter closed position from the state shown in FIG. 29A, the outer locking hook 34 comes in contact with the swelling portion 67*a* of the front guide rail 63 in the front of the outer locking recess 67 as shown in FIG. 29B. Accordingly, the outer shutter 61 moves forward, the amount of flexure of the leaf spring portion 68 increases with the forward movement of the outer shutter 61, and the elastic force also increases.

FIGS. 30A and 30B are diagrams illustrating an operation subsequent to the operation shown in FIGS. 29A and 29B, where FIG. 30A is a diagram illustrating a state where the outer shutter further moves to the outer-shutter closed position from the state shown in FIG. 29B and the outer locking recess and the outer locking hook engage with each other and FIG. 30B is a view as viewed in the direction of arrow XXXB of FIG. 30A.

When the outer shutter 61 further moves to the outer-shutter closed position from the state shown in FIG. 29B, the outer locking hook 34 engages with the outer locking recess 67 as shown in FIGS. 30A and 30B. At this time, as shown in FIG. 29B, the elastic force of the leaf spring portion 68 is great to urge the outer shutter 61 to the rear side. For example, when the toner cartridge TC is drawn out rapidly and thus the outer shutter 61 rapidly moves to the outer-shutter closed position, it is possible to satisfactorily cause the outer locking hook 34 and the outer locking recess 67 to engage with each other, thereby locking the outer shutter 61.

FIGS. 31A and 31B are diagrams illustrating an operation subsequent to the operation shown in FIGS. 30A and 30B, where FIG. 31A is a diagram illustrating a state where the outer shutter completely moves to the outer-shutter closed position and FIG. 31B is a view as viewed in the direction of arrow XXXIB of FIG. 31A.

In FIGS. 30A and 30B, the outer shutter 61 according to the first example does not completely move to the outer-shutter closed position and a gap is formed between the right end of the outer shutter 61 and the outer-shutter right stopper 38. On the contrary, in the leaf spring portion 68 in the first example, the inclined portion 68*c* comes in contact with the spring contact protrusion 43 but does not come in contact with the closed contact portion 68*e*, as shown in FIGS. 30A and 30B. Accordingly, in the state shown in FIG. 30B, the reaction force 71 which is applied to the inclined portion 68*c* from the spring contact protrusion 43 has a right-directed component and the force directed to the right, that is, to the outer-shutter closed position, is applied to the outer shutter 61.

Accordingly, the spring contact protrusion 43 is guided along the surface of the inclined portion 68*c*, the outer shutter 61 moves to the position shown in FIGS. 31A and 31B from the state shown in FIGS. 30A and 30B, the outer shutter 61 completely moves to the outer-shutter closed position. In the state shown in FIGS. 31A and 31B, the spring contact protrusion 43 comes in contact with the closed contact portion 68*e*, the deformation of the leaf spring portion 68 is reduced, and the elastic force is reduced, compared with the case where the spring contact protrusion comes in contact with the inclined portion 68*c*. When the spring contact protrusion 43 comes in contact with the base end portion 68*a* of the leaf spring body 68*b* other than the closed contact position 68*e*, the deformation of the leaf spring portion 68 increases to enhance the elastic force and is returned to the closed contact position 68*e* having a smaller elastic force. That is, in the configuration according to the first example, the spring contact protrusion is kept in contact with the closed contact position 68*e* where the elastic force of the leaf spring portion 68 is the minimum, that is, the outer shutter 61 is naturally kept at the outer-shutter closed position.

Prevention of Disengagement of Outer Shutter

When the outer shutter 61 according to the first example is attached to the cartridge body 31, the rear guide rail 64 of the outer shutter 61 engages with the outer-shutter rear guide 42 from the state shown in FIGS. 12A and 12B. At this time, as shown in FIG. 14C, the inner shutter 51 is not attached to the connection port portion 33 and the front guide rail 63 can be attached without interfering with the inner shutter 51. In addition, as shown in FIGS. 29A to 31B, when the inner shutter 51 does not exist, the front guide rail 63 can be attached without interfering with the outer-shutter front guide 41.

When the outer shutter 61 moves to the outer-shutter opened position from this state, the state shown in FIG. 11 is obtained. In the state shown in FIG. 11, the rear guide rail 64 of the outer shutter 61 engages with the outer-shutter rear guide 42 and the front guide rail 63 engages with the outer-shutter front guide 41, whereby the outer shutter 61 is not detached from the cartridge body 31.

In the state where the outer shutter 61 moves to the outer-shutter opened position, when the inner shutter 51 is attached from the front side and is made to move from the inner-shutter opened position shown in FIG. 10 to the inner-shutter closed position shown in FIG. 9, the inner shutter 51 is attached to the connection port portion 33.

When the outer shutter 61 is made to move to the outer-shutter closed position in the state shown in FIG. 9 in which the inner shutter 51 is attached to the cartridge body 31, the outer shutter 61 is closed into the state shown in FIG. 8. At this time, as shown in FIG. 14A, the front guide rail 63 of the outer shutter 61 is supported by the extension guide 54 of the inner shutter 51. Accordingly, as shown in FIGS. 14A and 14C, when the inner shutter 51 is attached, the outer shutter 61 comes in contact with the extension guide 54 of the inner shutter 51 and the detachment of the outer shutter from the cartridge body 31 is also restricted at the outer-shutter closed position. Therefore, the inner shutter 51 according to the first example guides the outer shutter 61 while preventing the detachment thereof, and commonly and simultaneously performs three functions of covering and uncovering the connection port 33*a*, guiding the outer shutter 61, and preventing the detachment of the outer shutter 61.

Prevention of Erroneous Assembly of Inner Shutter

FIGS. 32A and 32B are diagrams illustrating an operation of preventing an erroneous assembly according to the first example, where FIG. 32A is a diagram illustrating a state where the inner shutter according to the first example is erroneously assembled and FIG. 32B is a diagram illustrating a configuration not provided with an erroneous assembly preventing portion.

In FIGS. 9 and 10, when the inner shutter 51 according to the first example is attached to the connection port portion 33, it is attached thereto from the front side, but may be erroneously attached from the rear side, that is, may be erroneously assembled. In this case, the front wall 51*b* of the inner shutter 51 comes in contact with the rear end of the connection port portion 33 and is stopped, but the position of the catching recess 57 is set to correspond to the position where it interferes with the rear guide rail 64 of the outer shutter 61 or the rear wall 61*c* in the first example. Accordingly, as shown in FIG. 32A, when the outer shutter 61 is made to move the outer-shutter closed position in the state where the inner shutter 51 is erroneously assembled, the rear guide rail 64 engages with the catching recess 57 and thus the outer shutter 61 cannot move to the outer-shutter closed position.

In the configuration in which the catching recess 57 is not provided as shown in FIG. 32B, when the rear guide rail 64 comes in contact with the corner 01 of the inner shutter 51 and the outer shutter 61 has looseness, the rear guide rail 64 may go over the corner 01 and may move to the outer-shutter closed position. That is, the outer shutter may be closed with the inner shutter erroneously assembled. On the contrary, the catching recess 57 in the first example includes the front catching portion 57*a* and the rear catching portion 57*b* and the rear guide rail 64 to be inserted is guided to the recessed central portion, whereby the rear guide rail does not move to disengage from the catching recess 57. Therefore, the problem that the outer shutter 61 is closed with the inner shutter 51 erroneously assembled is prevented.

SECOND EXAMPLE

FIGS. 33A to 33C are diagrams illustrating an inner shutter lock according to a second example of the invention, where FIG. 33A is a perspective view, FIG. 33B is a diagram illustrating a state where a first engaging portion and a second engaging portion disengage with each other, and FIG. 33C is a view as viewed in the direction of arrow XXXIIIC of FIG. 33A.

FIGS. 34A and 34B are diagrams illustrating the inner shutter lock according to the second example, where FIG. 34A is a plan view and FIG. 34B is a sectional view taken along line XXXIVB-XXXIVB of FIG. 34A.

The second example of the invention will be described below. In describing the second example, elements corresponding to the elements in the first example are referenced by the same reference numerals and description thereof is not repeated. The second example is different from the first example in the following points and the other points are the same as described in the first example.

In FIGS. 33A to 33C and FIGS. 34A and 34B, an inner shutter lock 81 as an example of a movement restricting member of a covering member in the second example includes an upper lock 82 as an example of a first engaging portion having a thickness set to the half of the thickness in the top-bottom direction of the inner shutter lock 14 in the first example. The upper lock 82 in the second example includes an upper lock slider 82*a* having a thickness set to the half of the thickness in the top-bottom direction of the lock slider 16 in the first example. A pair of cylindrical interlocking protrusions 82*b* protruding downward is formed as an example of a movement restricting interlocking portion in the bottom surface of the upper lock slider 82*a*. The upper lock 82 in the second example includes an upper lock body 82*c*, a slider protrusion 82*d*, an upper spring receiver 82*e*, an upper coil spring 82*f* supported by the spring support 21, which have the same configurations as the lock body 17, the slider protrusion 18, the spring receiver 19, the spring support 21, and the coil spring 22 of the inner shutter lock 14 in the first example, except that the thickness in the top-bottom direction is a half.

A lower lock 83 having the same thickness as the upper lock 82 is disposed as an example of a second engaging portion under the upper lock 82. The lower lock 83 in the second example includes a lower lock slider 83*a* disposed opposite to the upper lock slider 82*a* of the upper lock 82. A pair of longitudinal interlocking recesses 83*b* being disposed to correspond to the interlocking protrusions 82*b* and extending in the right-left direction is formed as an example of a movement restricting interlocking portion in the lower lock slider 83*a*. The lower lock 83 includes a lower lock body 83*c*, a lower spring receiver 83*e*, and a lower coil spring 83*f* supported by the spring support 21, which have the same configurations as the upper lock body 82*c*, the upper spring receiver 82*e*, and the upper coil spring 82*f*. In the lower lock body 83*c* of the lower lock 83 in the second example, concave portions 83*c*1 and convex portions 83*c*2 are formed to have the same shapes as concave portions 82*c*1 and convex portions 82*c*2 of the upper lock body 82*c* but at positions different therefrom. The upper lock 82 and the lower lock 83 constitute the inner shutter lock 81 in the second example.

FIGS. 35A to 35D are diagrams illustrating moving states of the inner shutter lock according to the second example, where FIG. 35A is a diagram illustrating a state where an upper lock engages with a locked portion of the inner shutter, FIG. 35B is a diagram illustrating a state where a lower lock engages with the locked portion of the inner shutter, FIG. 35C is a diagram illustrating an intermediate state where the inner shutter lock is moving to the unlocked position, and FIG. 35D is a diagram illustrating a state where the inner shutter lock moves to the unlocked position.

In FIGS. 35A to 35D, the upper lock 82 and the lower lock 83 of the inner shutter lock 81 in the second example can move independently in the right-left direction in a state where the unlocking protrusion 37 does not come in contact with the slider protrusion 82*d*. Accordingly, as shown in FIGS. 35A and 35B, one of the upper lock 82 and the lower lock 83 engages with the locking portion 53 of the inner-shutter 51 and the other comes in contact with the outer surface of the locking portion 53, depending on the position in the front-rear direction of the locking portion 53.

When the unlocking protrusion 37 comes in contact with the slider protrusion 82*d*, the interlocking protrusions 82*b* of the upper lock 82 come in contact with the left end surfaces of the interlocking concave portions 83*b* of the lower lock 83 to move the lower lock 83 to the left with the movement of the unlocking protrusion to the unlocked position on the left side as shown in FIGS. 35C and 35D. That is, the upper lock 82 and the lower lock 83 move to the unlocked position in cooperation with each other. Accordingly, even when any of the upper lock 82 and the lower lock 83 engages, the locked state is released.

Operation in Second Example

In a printer U according to the second example having the above-mentioned configuration, the upper lock 82 and the lower lock 83 of the inner shutter lock 81 have different gear teeth periods, that is, gear teeth pitches. Accordingly, even when the inner-shutter locking portion 53 is irregular in position due to irregularity or individual differences such as the manufacturing error of the inner shutter 51 mounted thereon, the inner shutter is locked by engaging with one of the upper and lower locks 82 and 83 in the state where the inner shutter 51 and the inner shutter stopper surface 6*b* come in contact with each other. Accordingly, in spite of the individual difference of the inner shutter 51, it is possible to reduce the clearance between the inner shutter 51 and the inner shutter stopper surface 6*b*.

THIRD EXAMPLE

FIGS. 36A to 36C are diagrams illustrating a disengagement restricting portion according to a third example of the invention, where FIG. 36A is a diagram illustrating a state where the inner shutter is not attached, FIG. 36B is a diagram illustrating a state where the inner shutter is attached, and FIG. 36C is a partially-enlarged view of a disengagement restricting member shown in FIG. 36A.

The third example of the invention will be described below. In describing the third example, elements corresponding to the elements in the first example are referenced by the same reference numerals and description thereof is not repeated.

The third example is different from the first example in the following points and the other points are the same as described in the first example.

In FIGS. 36A to 36C, a groove 86 extending in the front-rear direction is formed as an example of a disengagement restricting portion receiver on one side in the right-left direction of the cartridge body 31 according to the third example.

In the groove 86, an interlocking arm 87 as an example of an interlocking member of the disengagement restricting portion is supported to be movable in the front-rear direction. The interlocking arm 87 includes an arm body 87*a* extending in the right-left direction as an example of an interlocking member body. A pair of long guide holes 87*b* extending in the right-left direction is formed as an example of a guided portion in the arm body 87*a* and horizontal guide pins 88 as an example of a guide member supported in the groove 86 are inserted through the long guide holes 87*b*, respectively. Accordingly, the interlocking arm 87 in the third example is supported to be movable in the front-rear direction. An inner shutter contact portion 87*c* extending vertically is formed as an example of a contact portion at the rear end of the arm body 87*a*. A cam face 87*d* inclined downward as it goes to the front side is formed as an example of a vertical moving portion at the front end of the arm body 87*a*.

A coil spring 89 as an example of an urging member urging the interlocking arm 87 forward is supported between the rear end of the arm body 87*a* and the rear end surface of the groove 86.

A disengagement restricting member 91 is disposed on the front top surface of the arm body 87*a*. A pair of vertical long guide holes 91*a* extending in the top-bottom direction is formed as an example of a guide portion in the disengagement restricting member 91 in the third example. Vertical guide pins 92 as an example of a guide member are inserted through the vertical long guide holes 91*a*, respectively. In FIG. 36C, a coil spring 93 as an example of an urging member attached to the corresponding vertical guide pin 92 is disposed in each vertical long guide holes 91*a*, whereby the disengagement restricting member is urged upward.

Accordingly, the disengagement restricting member 91 is supported by the vertical guide pins 92 and the vertical long guide holes 91*a* so as to be movable in the top-bottom direction, and is normally urged upward with the elastic force of the coil spring 93. A disengagement restricting rib 91*b* extending forward and being disposed to correspond to the front guide rail 63 of the outer shutter 61 is formed as an example of the disengagement restricting portion at the lower end of the disengagement restricting member 91.

Operation of Third Example

In the printer U according to the third example having the above-mentioned configuration, in the state where the inner shutter 51 is not attached, the interlocking arm 87 moves forward with the elastic force of the coil spring 89 to a restriction releasing position at which the disengagement restricting member 91 is received in the groove 86, as shown in FIG. 36A. Accordingly, in this state, the outer shutter 61 can be attached and detached at the outer-shutter closed position before attaching the inner shutter 51.

When the inner shutter 51 is attached, the inner-shutter contact portion 87*c* comes in contact with the inner shutter 51 and is pushed rearward, as shown in FIG. 36B. Accordingly, the coil springs 89 and 93 are elastically deformed, and the interlocking arm 87 moves rearward to a disengagement restricted position at which the disengagement restricting member 91 is pushed by the cam face 87*d* and protrudes downward. Therefore, when the inner shutter 51 is attached in the state where the outer shutter 61 moves to the outer-shutter opened position, the disengagement restricting member 91 protrudes downward. When the outer shutter 61 moves to the outer-shutter closed position, the front guide rail 63 engages therewith. As a result, the downward detachment of the outer shutter 61 is restricted.

Modifications

While the exemplary embodiments of the invention have been described in detail, the invention is not limited to the exemplary embodiments but can be modified in various forms within the concept of the invention described in the claims. Modifications (H01) to (H018) will be described below.

(H01) In the above-mentioned exemplary embodiments, the printer U has been exemplified as an example of the image forming apparatus, but the invention is not limited to this configuration. The invention can be applied to a copier, a FAX, or a multifunction machine having these functions. The invention is not limited to a single-color image forming apparatus, but can be applied to a multi-color image forming apparatus.

(H02) In the above-mentioned exemplary embodiments, the cartridge K containing new developer to be supplied to the developing device G has been exemplified as an example of the developer container, but the invention is not limited to this configuration. For example, the invention can be applied to a configuration having a covering member in a used toner box as an example of a container containing the developer recovered from a photosensitive cleaner CLp or a belt cleaner CLb or a detachable developing device G as an example of a container containing developer.

(H03) In the above-mentioned exemplary embodiments, the outer shape of the toner cartridge TC or the cartridge holder KH may be changed to any shape.

(H04) In the above-mentioned exemplary embodiments, the shape of the covering groove 3 may be changed to any shape. For example, the front groove portion 3*a* may be removed so that the spiral groove portion 3*b* is formed from the front end. The slope angle of the spiral groove portion 3*b* may be changed to any angle. The swelling portion 3*h* may be provided, but may be removed.

(H05) In the above-mentioned exemplary embodiments, the position or configuration of the CRUM reader 4 or the CRUM 46 may be changed. The transmission and reception of information between the CRUM reader 4 and the CRUM 46 is not limited to the wired type by contact, but may be carried out wirelessly using RF waves.

(H06) In the above-mentioned exemplary embodiments, the guide rib 8*a*, the clearance plugging portion 9, the slope 11, and the lock side wall 12 may be provided, but may be removed. The slope angle of the slope 11 may be set to correspond to the spiral groove portion 3*b*, but the slope angle may be set to be greater or smaller than that of the spiral groove portion 3*b* or the slope angle may be set to be great so as to correspond to the horizontal direction. The overlapping area 11*a* may be removed. The supply port 6*a* may be provided with a shutter.

(H07) In the above-mentioned exemplary embodiments, the shape of the slider protrusion 18 or the unlocking protrusion 37 is not limited to the shape described in the exemplary embodiments, but may be changed to any shape. For example, the intermediate guide surface 18*b* or the intermediate guide surface 37*b* may be removed.

(H08) In the above-mentioned exemplary embodiments, the outer-shutter right stopper 38 may be removed.

(H09) In the above-mentioned exemplary embodiments, the outer shutter guides 41 and 42 and the outer-shutter guide rails 63+64 are not limited to the configurations described in the exemplary embodiments, but the position, size, length, and the like thereof may be changed variously.

(H010) In the above-mentioned exemplary embodiments, the inner shutter 51 may be provided with the extension guide portion 54 guiding the outer shutter 61, but the extension guide portion 54 may be provided to the cartridge body 31 or may be removed.

(H011) In the above-mentioned exemplary embodiments, the configuration for locking the outer shutter 61 is not limited to the combination of the outer locking hook 37 and the outer locking recess 67 described in the exemplary embodiments, but the position or configuration thereof may be changed. For example, the relation of the outer locking hook and the outer locking recess may be inverted or they may be disposed on the rear side instead of the front side of the outer shutter 67. The swelling portion 67*a* may be provided, but may be removed. The configuration for locking the outer shutter 61 or the configuration for restricting the movement of the inner shutter 51 may be provided, but may be removed.

(H012) In the above-mentioned exemplary embodiments, the catching recess 57 is exemplified as an example of the erroneous assembly preventing portion, but the invention is not limited to this configuration. The shape, position, or size of the catching recess may be changed. The erroneous assembly preventing portion may be provided, but may be removed.

(H013) In the above-mentioned exemplary embodiments, the shape, size, or position of the outer covering protrusion 62 may be changed or may be removed in a configuration in which the spiral groove portion 3*b* has a large width so as to guide the entire outer shutter 61.

(H014) In the above-mentioned exemplary embodiments, the configuration of the inner shutter lock 14 or the locking portion 53 of the inner shutter 51 is not limited to the configuration described in the exemplary embodiments, but may be changed to any configuration. For example, the concave and convex portions may have such a configuration to get over the convex portions at the time of attachment and to engage with each other at the time of detachment, but may have such a configuration to get over the convex portions at the time of both attachment and detachment. The inner shutter lock and the locking portion may have a gear teeth shape in which the convex portion and the concave portion are periodically formed, but may have, for example, a configuration in which one of the inner shutter lock and the locking portion has a gear teeth shape and the other has a single convex portion or a configuration in which one is a convex portion and the other is a concave portion. The inner shutter lock 14 is not limited to the configuration in which it comes in contact from one side, which is described in the exemplary embodiments, but may have any configuration such as the configuration described in JP-A-2005-134452.

(H015) In the above-mentioned exemplary embodiments, it may be that the extension guide 54 of the inner shutter 51 additionally has the function as the disengagement restricting portion of the outer shutter 61, but the invention is not limited to this configuration. The disengagement restricting portion may be disposed at a position different from the extension guide 54 of the inner shutter 51. For example, a disengagement restricting portion engaging with the front guide rail 63 of the outer shutter 61 with a snap-fit structure may be provided to the cartridge body 31.

(H016) In the above-mentioned exemplary embodiments, the shapes of the leaf spring portion 68 and the spring contact protrusion 43 are not limited to the shapes described in the exemplary embodiments, but the position, shape, or size thereof may be changed. For example, the inclined portion 68*c* may be provided to the leaf spring portion 68, but may be removed. The leaf spring portion may be disposed in the cartridge body 31 and the spring contact protrusion may be disposed in the outer shutter 61. The leaf spring portion 68 and the spring contact protrusion 43 may be removed.

(H017) In the above-mentioned exemplary embodiments, the configuration in which the inner shutter 51 is pressed by the use of the pressed protrusion 56 and the pressing protrusion 66 is exemplified, but the position, shape, or size may be changed. For example, the pressed protrusion 56 may be disposed at an end in the right-left direction or on the bottom surface of the inner shutter 51, or the shape may be changed to a shape such as a trapezoid shape other than the triangular shape. The configuration in which the inner shutter 51 is pressed by the use of the pressed protrusion 56 and the pressing protrusion 66 may be provided, but may be removed.

(H018) In the above-mentioned exemplary embodiments, the outer shutter 61 may be inclined at the time of opening the outer shutter to suppress the increasing operational force, but the invention is not limited to this configuration. The outer shutter may not be inclined, may move forward to release the locked state, and may then move to the left side. That is, the clearance or looseness between the outer guide rail 63+64 and the guides 41, 42, and 54 may be removed.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explaining the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A powder container comprising:

a container section that contains powder;

an opening that is formed in the container section to pass the powder therethrough;

a first covering member that is supported by the container section so as to be movable between a first uncovered position where the opening is uncovered and a first covered position where the opening is covered;

a second covering member that is supported by the container section so as to be movable between a second covered position where the opening is double covered by covering the outside of the first covering member and a second uncovered position where the first covering member is externally exposed;

a disengagement restricting portion that is disposed in an area where the second covering member moves between the second uncovered position and the second covered position; and a restricted portion that is disposed in the second covering member and restricts the disengagement of the second covering member by coming in contact with the disengagement restricting portion when the second covering member having moved to the second covered position moves to disengage from the container section.

2. The powder container according to claim 1, wherein the disengagement restricting portion is disposed in the first covering member and guides movement of the second covering member between the second uncovered position and the second covered position when the first covering member moves to the first covered position.

3. The powder container according to claim 2, wherein the second covering member includes a portion that is disposed to be opposed to the first uncovered position of the first covering member and that restricts movement of the first covering member to the first uncovered position when the second covering member moves to the second covered position.

4. The powder container according to claim 1, further comprising:

an erroneous attachment preventing portion that is disposed in the first covering member and interferes with the second covering member moving to the second covered position when the first covering member is erroneously attached to the container section in a direction other than a predetermined direction.

5. The powder container according to claim 4, wherein the second covering member includes a portion that is disposed to be opposed to the first uncovered position of the first covering member and that restricts movement of the first covering member to the first uncovered position when the second covering member moves to the second covered position.

6. The powder container according to claim 1, wherein the second covering member includes a portion that is disposed to be opposed to the first uncovered position of the first covering member and that restricts movement of the first covering member to the first uncovered position when the second covering member moves to the second covered position.

7. An image forming apparatus comprising:

an image holding member that rotates;

a developing device that develops a latent image formed on a surface of the image holding member into a visible image;

a transfer device that transfers the visible image on the surface of the image holding member to a medium;

a fixing device that fixes the visible image transferred to the medium; and the powder container according to claim 1 that contains powder to be supplied to the developing device and that is supported to be attachable to or detachable from a body of the image forming apparatus.

8. A cover moving method with which an opening of a powder container is uncovered or covered, the powder container including a container section that contains powder and the opening that is formed in the container section to pass the powder therethrough, the cover moving method comprising:

moving a first covering member between a first uncovered position where the opening is uncovered and a first covered position where the opening is covered, the first covering member being supported by the container section;

moving a second covering member between a second covered position where the opening is double covered by covering the outside of the first covering member and a second uncovered position where the first covering member is externally exposed, the second covering member being supported by the container section;

disposing a disengagement restricting portion in an area where the second covering member moves between the second uncovered position and the second covered position;

disposing a restricted portion in the second covering member; and restricting the disengagement of the second covering member by coming in contact with the disengagement restricting portion when the second covering member having moved to the second covered position moves to disengage from the container section.

* * * * *